US006063560A

United States Patent [19]

Suzuki et al.

[11] Patent Number: 6,063,560

[45] Date of Patent: May 16, 2000

[54] PHOTOGRAPHIC PHOTOTHERMOGRAPHIC MATERIAL

[75] Inventors: Keiichi Suzuki; Toru Harada, both of Kanagawa, Japan

[73] Assignee: Fuji Photo Film Co., Ltd, Kanagawa, Japan

[21] Appl. No.: 08/941,908

[22] Filed: Oct. 1, 1997

[30] Foreign Application Priority Data

Oct. 1, 1996 [JP] Japan ..... 8-279961
Jan. 16, 1997 [JP] Japan ..... 9-005665

[51] Int. Cl.[7] ..... G03C 1/498

[52] U.S. Cl. ..... 430/619; 430/264; 430/510; 430/517

[58] Field of Search ..... 430/619, 264, 430/517, 510, 944

[56] References Cited

U.S. PATENT DOCUMENTS 5,156,939 10/1992 Koide ..... 430/203
5,380,635 1/1995 Gomez et al. .
5,496,695 3/1996 Simpson et al. .
5,545,515 8/1996 Murray et al. .

*Primary Examiner*—Thorl Chea
*Attorney, Agent, or Firm*—Birch, Stewart, Kolasch & Birch, LLP

[57] ABSTRACT

In a photographic photothermographic material comprising a organic silver salt, a silver halide, and a reducing agent on a transparent support, a specific hydrazine derivative and a specific squarylium dye are contained in suitable photosensitive or non-photosensitive layers on the support. The material is improved in Dmax, contrast, resolution, and residual color after processing.

11 Claims, No Drawings

PHOTOGRAPHIC PHOTOTHERMOGRAPHIC MATERIAL

BACKGROUND OF THE INVENTION

This invention relates to a photothermographic material capable of forming an image faithful to exposure and more particularly, to a photographic photothermographic material suitable for printing plate application.

As scanners and image setters capable of exposure with lasers and light-emitting diodes become widespread as output devices in the graphic printing field, there is a demand for graphic printing photosensitive material having high sensitivity, Dmax, contrast and image quality. From the contemporary standpoints of environmental protection and space saving, it is strongly desired to reduce the quantity of spent solution associated with conventional wet system photographic silver halide photosensitive material. One approach for reducing the spent solution to zero is the utilization of thermographic photographic recording material.

In order that photographic photothermographic material produce an image faithful to exposure and having high resolution, it is effective to add an anti-irradiation dye or provide an anti-halation layer like the conventional wet system photographic silver halide photosensitive material. The anti-irradiation dye is mainly added to the photosensitive layer while the anti-halation layer is disposed between the support and the photosensitive layer or on that side of the support remote from the photosensitive layer. For example, where an output of a near infrared laser is to be recorded, a dye having absorption in the infrared region is necessary. Exemplary infrared dyes include indolenine cyanine dyes as described in JP-A 182640/1992 and dihydroperimidine squarylium dyes having squaric acid bonded to a dihydroperimidine nucleus at its para-position as described in U.S. Pat. No. 5,380,635.

One method for producing photographic photothermographic material having high Dmax and contrast is to add hydrazine derivatives to photosensitive material as described in U.S. Pat. No. 5,496,695. Although a photographic photothermographic material having high Dmax and ultrahigh contrast is obtained, it still has the drawback that upon exposure by means of a laser image setter, images in exposed areas thicken and large spots collapse. Since the recent further advance of laser image setters enables high precision exposure, there is a strong need for a photosensitive material capable of forming images faithful to exposure in a reproducible manner.

U.S. Pat. No. 5,545,515 describes a photographic photothermographic material comprising a hydrazine derivative of specific structure. It is also disclosed that an indolenine cyanine dye is added to an anti-halation or back layer. However, there is not available a dye which can prevent irradiation within the photosensitive layer or prevent halation between the photosensitive layer and the support. To produce an ultrahigh contrast image faithful to exposure, an anti-irradiation or anti-halation dye having no influence on image formation within the photosensitive layer is needed.

SUMMARY OF THE INVENTION

An object of the present invention is to provide a photographic photothermographic material featuring high Dmax, ultrahigh contrast, good resolution, and minimized residual color after processing.

According to the invention, there is provided a photographic photothermographic material comprising a silver organic acid, a silver halide, and a reducing agent on a transparent support. The photothermographic material further contains a hydrazine derivative of the following general formula (H). At least one of squarylium dyes of the following general formulae (I) to (V) is contained in at least one of the following layers: (1) a photosensitive layer on one surface of the support, (2) a layer disposed between the support and the photosensitive layer, (3) a layer coated on the opposite surface of the support to the photosensitive layer, and (4) a layer disposed on the same surface of the support as the photosensitive layer and more remote from the support than the photosensitive layer.

General formula (H):

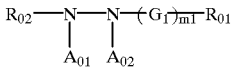

In formula (H), $R_{02}$ is an aliphatic, aromatic or heterocyclic group, $R_{01}$ is hydrogen or a block group, $G_1$ is a group represented by —CO—, —COCO—, —C(=S)—, —$SO_2$—, —SO— or —PO($R_{03}$)— or iminomethylene group wherein $R_{03}$ is a group selected from the same range as defined for $R_{01}$ and may be identical with or different from $R_{01}$, $A_{01}$ and $A_{02}$ are both hydrogen atoms, or one of $A_{01}$ and $A_{02}$ is a hydrogen atom and the other is a substituted or unsubstituted alkylsulfonyl group, substituted or unsubstituted arylsulfonyl group or substituted or unsubstituted acyl group, and letter m1 is equal to 0 or 1, with the proviso that $R_{01}$ is an aliphatic, aromatic or heterocyclic group when m1 is 0.

General formula (I):

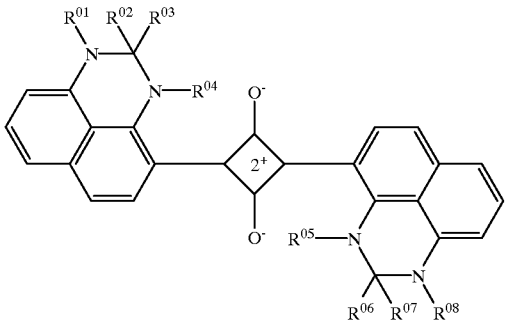

In formula (I), $R^{01}$, $R^{02}$, $R^{03}$, $R^{04}$, $R^{05}$, $R^{06}$, $R^{07}$, and $R^{08}$ are independently selected from the class consisting of hydrogen, alkyl, cycloalkyl and aryl groups, or $R^{01}$ and $R^{02}$, and/or $R^{03}$ and $R^{04}$, and/or $R^{05}$ and $R^{06}$, and/or $R^{07}$ and $R^{08}$, or $R^{02}$ and $R^{03}$, and/or $R^{06}$ and $R^{07}$, taken together, may form a 5- or 6-membered ring.

General formula (II):

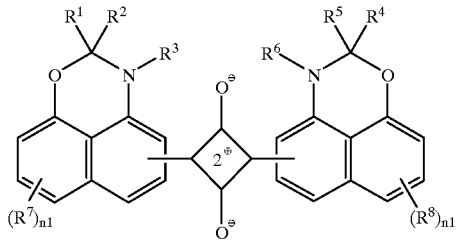

In formula (II), $R^1$, $R^2$, $R^3$, $R^4$, $R^5$, and $R^6$ are independently selected from the class consisting of hydrogen, alkyl, cycloalkyl, aryl, heterocyclic and aralkyl groups, or $R^1$ and $R^2$, and/or $R^4$ and $R^5$, taken together, may form a 5- or 6-membered ring, $R^7$ and $R^8$ each are hydrogen or a monovalent group, and letter n1 is an integer of 1 to 3.

General formula (III):

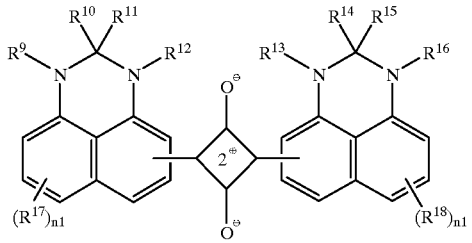

In formula (III), each of $R^9$, $R^{12}$, $R^{13}$ and $R^{16}$ is hydrogen or an alkyl group, $R^{10}$, $R^{11}$, $R^{14}$, and $R^{15}$ are independently selected from the class consisting of hydrogen, alkyl, cycloalkyl, aryl, aralkyl, and heterocyclic groups, or $R^9$ and $R^{10}$, and/or $R^{11}$ and $R^{12}$, and/or $R^{13}$ and $R^{14}$, and/or $R^{15}$ and $R^{16}$, or $R^{10}$ and $R^{11}$, and/or $R^{14}$ and $R^{15}$, taken together, may form a 5- or 6-membered ring, each of $R^{17}$ and $R^{18}$ is a monovalent group, with the proviso that $R^{17}$ and $R^{18}$ may be hydrogen when $R^{10}$, $R^{11}$, $R^{14}$ or $R^{15}$ is a heterocyclic group, and letter n1 is an integer of 1 to 3.

General formula (IV):

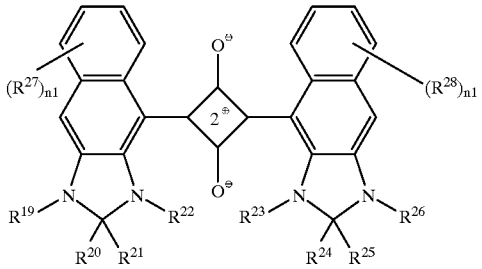

In formula (IV), $R^{19}$, $R^{20}$, $R^{21}$, $R^{22}$, $R^{23}$, $R^{24}$, $R^{25}$, and $R^{26}$ are independently selected from the class consisting of hydrogen, alkyl, cycloalkyl, aryl, aralkyl, and heterocyclic groups, or $R^{19}$ and $R^{20}$, and/or $R^{21}$ and $R^{22}$, and/or $R^{23}$ and $R^{24}$, and/or $R^{25}$ and $R^{26}$, or $R^{20}$ and $R^{21}$, and/or $R^{24}$ and $R^{25}$, taken together, may form a 5- or 6-membered ring, each of $R^{27}$ and $R^{28}$ is hydrogen or a monovalent substituent group, and letter n1 is an integer of 1 to 3.

General formula (V):

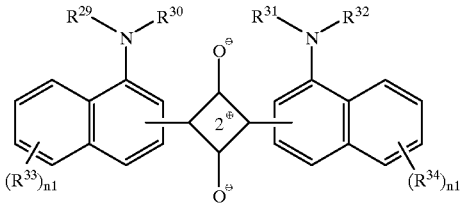

In formula (V), $R^{29}$, $R^{30}$, $R^{31}$, and $R^{32}$ are independently selected from the class consisting of hydrogen, alkyl, cycloalkyl, aryl, aralkyl, and heterocyclic groups, each of $R^{33}$ and $R^{34}$ is hydrogen or a monovalent substituent group, and letter n1 is an integer of 1 to 3.

Preferably, the squarylium dye is contained in the photosensitive layer containing the photosensitive silver halide.

The hydrazine derivative is preferably at least one member selected from hydrazine derivatives of the following general formulae (H-I) to (H-VIII):

general formula (H-I)

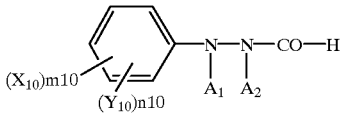

general formula (H-II)

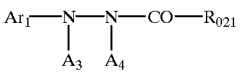

general formula (H-III)

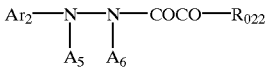

general formula (H-IV)

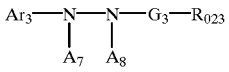

general formula (H-V)

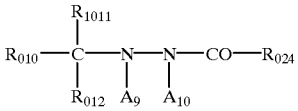

general formula (H-VI)

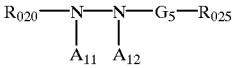

general formula (H-VII)

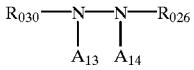

general formula (H-VIII)

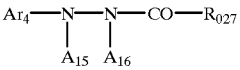

In formula (H-I), $Y_{10}$ is a nitro, methoxy, alkyl or acetamide group, $X_{10}$ is a substituent group other than $Y_{10}$, letter m10 is an integer of 0 to 5, n10 is an integer of 0 to 4, the sum of m10 and n10 is not more than 5, $A_1$ and $A_2$ are both hydrogen atoms or one of $A_1$ and $A_2$ is a hydrogen atom and the other is a substituted or unsubstituted alkylsulfonyl group, substituted or unsubstituted arylsulfonyl group or substituted or unsubstituted acyl group, with the proviso that either of $A_1$ and $A_2$ is not hydrogen when m10 is 0.

In formula (H-II), $Ar_1$ is an aromatic or heterocyclic group, $A_3$ and $A_4$ are as defined for $A_1$ and $A_2$ in formula (H-I), and $R_{021}$ is selected from the class consisting of an alkyl group having at least one electron attractive group substituted thereon, aryl group having at least one electron attractive group substituted thereon, alkenyl group, alkynyl group, heterocyclic group, amino group (inclusive of unsubstituted amino, alkylamino, arylamino, and heterocyclic amino groups), hydrazino group, alkoxy group, and aryloxy group.

In formula (H-III), $Ar_2$ is an aromatic or heterocyclic group, $A_5$ and $A_6$ are as defined for $A_1$ and $A_2$ in formula (H-I), and $R_{022}$ is hydrogen or a block group.

In formula (H-IV), $Ar_3$ is an aromatic or heterocyclic group, $A_7$ and $A_8$ are as defined for $A_1$ and $A_2$ in formula (H-I), $R_{023}$ is hydrogen or a block group, and $G_3$ is a group represented by —C(=S)—, —$SO_2$—, —SO— or —PO($R_{033}$)— or iminomethylene group wherein $R_{033}$ is a group selected from the same range as defined for $R_{023}$ and may be identical with or different from $R_{023}$.

In formula (H-V), each of $R_{010}$, $R_{011}$, and $R_{012}$ is hydrogen or a monovalent substituent group, with the proviso that all $R_{010}$, $R_{011}$, and $R_{012}$ are not aromatic groups at the same time, $A_9$ and $A_{10}$ are as defined for $A_1$ and $A_2$ in formula (H-I) , and $R_{024}$ is hydrogen or a block group.

In formula (H-VI), $R_{020}$ is an aliphatic group, $R_{025}$ is hydrogen or a block group, $G_5$ is a group —COCO— or a group as defined for $G_3$ in formula (H-IV), and $A_{11}$ and $A_{12}$ are as defined for $A_1$ and $A_2$ in formula (H-I), with the proviso that $R_{025}$ is not an unsubstituted anilino group when $G_5$ is a group —C(=S)—.

In formula (H-VII), $R_{030}$ is an aliphatic group, $R_{026}$ is an aliphatic, aromatic or heterocyclic group, and $A_{13}$ and $A_{14}$ are as defined for $A_1$ and $A_2$ in formula (H-I), with the proviso that $R_{026}$ is not an unsubstituted phenyl group when $R_{030}$ is a trityl group.

In formula (H-VIII), $Ar_4$ is an aromatic or heterocyclic group, $R_{027}$ is an unsubstituted amino, alkylamino, heterocyclic amino or alkynyl group, and $A_{15}$ and $A_{16}$ are as defined for $A_1$ and $A_2$ in formula (H-I).

Quite unexpectedly from the conventional wet system photographic silver halide photosensitive material, the photothermographic material using a specific hydrazine derivative in combination with a specific squarylium dye according to the invention can produce ultrahigh contrast images faithful to exposure. Although the mechanism is not well understood, it is believed that in a photosensitive material using the hydrazine derivative, the squarylium dye restrains slight fluorescence which is produced by dyes or similar components in the photosensitive layer, thereby preventing an image from expanding from the exposed area to unexposed areas therearound.

DETAILED DESCRIPTION OF THE INVENTION

Photothermographic materials which are processed by a thermographic process to form photographic images are disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., Chap. 2, 1969.

The photothermographic material of the invention is to form photographic images through a thermographic process and generally contains a reducible silver source (that is, organic silver salt), a catalytic amount of silver halide, a reducing agent, and optionally a toner for controlling the tonality of silver, typically dispersed in a binder matrix. The photothermographic material of the invention is stable at room temperature. It is developed after exposure by heating at an elevated temperature (e.g., 80° C. or higher). Upon heating, redox reaction takes place between the organic silver salt (functioning as an oxidizing agent) and the reducing agent to form silver. This redox reaction is promoted by the catalysis of a latent image produced in the silver halide by exposure. Silver formed by reaction of the organic silver salt in exposed regions provides black images in contrast to unexposed regions, eventually forming an image. Since this reaction process proceeds without external supply of water, it yields no spent solution and is friendly to the environment.

Hydrazine Derivative

The photothermographic material of the invention further contains a hydrazine derivative of the general formula (H), which is described below in detail.

General formula (H):

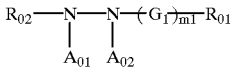

In formula (H), $R_{02}$ is an aliphatic, aromatic or heterocyclic group. $R_{01}$ is hydrogen or a block group. $G_1$ is a group represented by —CO—, —COCO—, —C(=S)—, —$SO_2$—, —SO— or —PO($R_{03}$)— or iminomethylene group wherein $R_{03}$ is a group selected from the same range as defined for $R_{01}$ and may be identical with or different from $R_{01}$. $A_{01}$ and $A_{02}$ are both hydrogen atoms, or one of $A_{01}$ and $A_{02}$ is a hydrogen atom and the other is a substituted or unsubstituted alkylsulfonyl group, substituted or unsubstituted arylsulfonyl group or substituted or unsubstituted acyl group. Letter m1 is equal to 0 or 1. $R_{01}$ is an aliphatic, aromatic or heterocyclic group when m1 is 0.

In formula (H), the aliphatic groups represented by $R_{02}$ are preferably substituted or unsubstituted, normal, branched or cyclic alkyl, alkenyl and alkynyl groups having 1 to 30 carbon atoms.

In formula (H), the aromatic groups represented by $R_{02}$ are preferably monocyclic or fused ring aryl groups, for example phenyl and naphthyl groups. The heterocyclic groups represented by $R_{02}$ are preferably monocyclic or fused ring, saturated or unsaturated, aromatic or non-aromatic heterocyclic groups while the heterocycles in these groups include pyridine, pyrimidine, imidazole, pyrazole, quinoline, isoquinoline, benzimidazole, thiazole, benzothiazole, piperidine, triazine, morpholine, and piperazine rings.

Aryl and alkyl groups are most preferred as $R_{02}$.

The group represented by $R_{02}$ may have a substituent. Exemplary substituents include halogen atoms (e.g., fluorine, chlorine, bromine and iodine), alkyl groups (inclusive of aralkyl, cycloalkyl and active methine groups), alkenyl groups, alkynyl groups, aryl groups, heterocyclic groups, heterocyclic groups containing a quaternized nitrogen atom (e.g., pyridinio), acyl groups, alkoxycarbonyl groups, aryloxycarbonyl groups, carbamoyl groups, carboxy groups or salts thereof, sulfonylcarbamoyl groups, acylcarbamoyl groups, sulfamoylcarbamoyl groups, carbazoyl groups, oxalyl groups, oxamoyl groups, cyano groups, thiocarbamoyl groups, hydroxy groups, alkoxy groups (inclusive of groups having recurring ethylenoxy or propylenoxy units), aryloxy groups, heterocyclic oxy groups, acyloxy groups, (alkoxy or aryloxy)carbonyloxy groups, carbamoyloxy groups, sulfonyloxy groups, amino groups, (alkyl, aryl or heterocyclic) amino groups, N-substituted nitrogenous heterocyclic groups, acylamino groups, sulfonamide groups, ureido groups, thioureido groups, imide groups, (alkoxy or aryloxy)carbonylamino groups, sulfamoylamino groups, semicarbazide groups, thiosemicarbazide groups, hydrazino groups, quaternary ammonio groups, oxamoylamino groups, (alkyl or aryl)sulfonylureido groups, acylureido groups, acylsulfamoylamino groups, nitro groups, mercapto groups, (alkyl, aryl or heterocyclic) thio groups, (alkyl or aryl)sulfonyl groups, (alkyl or aryl)sulfinyl groups, sulfo groups or salts thereof, sulfamoyl groups, acylsulfamoyl groups, sulfonylsulfamoyl groups or salts thereof, and groups containing a phosphoric amide or phosphoric ester structure. These substituents may be further substituted with such a substituent.

Preferred substituents that $R_{02}$ may have include, where $R_{02}$ is an aromatic or heterocyclic group, alkyl (inclusive of active methylene), aralkyl, heterocyclic, substituted amino, acylamino, sulfonamide, ureido, sulfamoylamino, imide, thioureido, phosphoric amide, hydroxy, alkoxy, aryloxy, acyloxy, acyl, alkoxycarbonyl, aryloxycarbonyl, carbamoyl, carboxy (inclusive of salts thereof), (alkyl, aryl or heterocyclic) thio, sulfo (inclusive of salts thereof), sulfamoyl, halogen, cyano, and nitro groups.

Where $R_{02}$ is an aliphatic group, preferred substituents include alkyl, aryl, heterocyclic, amino, acylamino, sulfonamide, ureido, sulfamoylamino, imide, thioureido, phosphoric amide, hydroxy, alkoxy, aryloxy, acyloxy, acyl, alkoxycarbonyl, aryloxycarbonyl, carbamoyl, carboxy (inclusive of salts thereof), (alkyl, aryl or heterocyclic) thio, sulfo (inclusive of salts thereof), sulfamoyl, halogen, cyano, and nitro groups.

In formula (H), $R_{01}$ is hydrogen or a block group. Examples of the block group include aliphatic groups (e.g., alkyl, alkenyl and alkynyl groups), aromatic groups (monocyclic or fused ring aryl groups), heterocyclic groups, alkoxy, aryloxy, amino and hydrazino groups.

The alkyl groups represented by $R_{01}$ are preferably substituted or unsubstituted alkyl groups having 1 to 10 carbon atoms, for example, methyl, ethyl, trifluoromethyl, difluoromethyl, 2-carboxytetrafluoroethyl, pyridiniomethyl, difluoromethoxymethyl, difluorocarboxymethyl, 3-hydroxypropyl, 3-methanesulfonamidopropyl, phenylsulfonylmethyl, o-hydroxybenzyl, methoxymethyl, phenoxymethyl, 4-ethylphenoxymethyl, phenylthiomethyl, t-butyl, dicyanomethyl, diphenylmethyl, triphenylmethyl, methoxycarbonyldiphenylmethyl, cyanodiphenylmethyl, and methylthiodiphenylmethyl groups. The alkenyl groups are preferably those having 1 to 10 carbon atoms, for example, vinyl, 2-ethoxycarbonylvinyl, and 2-trifluoro-2-methoxycarbonylvinyl groups. The alkynyl groups are preferably those having 1 to 10 carbon atoms, for example, ethynyl and 2-methoxycarbonylethynyl groups. The aryl groups are preferably monocyclic or fused ring aryl groups, especially those containing a benzene ring, for example, phenyl, perfluorophenyl, 3,5-dichlorophenyl, 2-methanesulfonamidophenyl, 2-carbamoylphenyl, 4,5-dicyanophenyl, 2-hydroxymethylphenyl, 2,6-dichloro-4-cyanophenyl, and 2-chloro-5-octylsulfamoylphenyl groups.

The heterocyclic groups represented by $R_{01}$ are preferably 5- and 6-membered, saturated or unsaturated, monocyclic or fused ring, heterocyclic groups containing at least one of nitrogen, oxygen and sulfur atoms, for example, morpholino, piperidino (N-substituted), imidazolyl, indazolyl (e.g., 4-nitroindazolyl), pyrazolyl, triazolyl, benzimidazolyl, tetrazolyl, pyridiyl, pyridinio (e.g., N-methyl-3-pyridinio), quinolinio and quinolyl groups.

The alkoxy groups are preferably those having 1 to 8 carbon atoms, for example, methoxy, 2-hydroxyethoxy, benzyloxy, and t-butoxy groups. The aryloxy groups are preferably substituted or unsubstituted phenoxy groups. The amino groups are preferably unsubstituted amino, alkylamino having 1 to 10 carbon atoms, arylamino, and saturated or unsaturated heterocyclic amino groups (inclusive of nitrogenous heterocyclic amino groups containing a quaternized nitrogen atom). Examples of the amino group include 2,2,6,6-tetramethylpiperidin-4-ylamino, propylamino, 2-hydroxyethylamino, anilino, o-hydroxyanilino, 5-benzotriazolylamino, and N-benzyl-3-pyridinioamino groups.

The hydrazino groups are preferably substituted or unsubstituted hydrazino groups and substituted or unsubstituted phenylhydrazino groups (e.g., 4-benzenesulfonamidophenylhydrazino).

The groups represented by $R_{01}$ may be substituted ones, with examples of the substituent being as exemplified for the substituent on $R_{02}$.

In formula (H), $R_{01}$ may be such a group as to induce cyclization reaction to cleave a $G_1$-$R_{01}$ moiety from the remaining molecule to generate a cyclic structure containing the atoms of the -$G_1$-$R_{01}$ moiety. Such examples are described in JP-A 29751/1988, for example.

The hydrazine derivative of formula (H) may have incorporated therein a group capable of adsorbing to silver halide. Such adsorptive groups include alkylthio, arylthio, thiourea, thioamide, mercapto heterocyclic and triazole groups as described in U.S. Pat. Nos. 4,385,108 and 4,459,347, JP-A 195233/1984, 200231/1984, 201045/1984, 201046/1984, 201047/1984, 201048/1984, 201049/1984, 170733/1986, 270744/1986, 948/1987, 234244/1988, 234245/1988, and 234246/1988. These adsorptive groups to silver halide may take the form of precursors. Such precursors are exemplified by the groups described in JP-A 285344/1990.

$R_{01}$ and $R_{02}$ in formula (H) may have incorporated therein a ballast group or polymer commonly used in immobile photographic additives such as couplers. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

$R_{01}$ or $R_{02}$ in formula (H) may have a plurality of hydrazino groups as a substituent. In this case, the compounds of formula (H) are polymeric with respect to hydrazino group. Exemplary polymeric compounds are described in JP-A 86134/1989, 16938/1992, 197091/1993, WO 95-32452 and 95-32453, Japanese Patent Application Nos. 351132/1995, 351269/1995, 351168/1995, 351287/1995, and 351279/1995.

$R_{01}$ or $R_{02}$ in formula (H) may contain a cationic group (e.g., a group containing a quaternary ammonio group and a nitrogenous heterocyclic group containing a quaternized nitrogen atom), a group containing recurring ethylenoxy or propylenoxy units, an (alkyl, aryl or heterocyclic) thio group, or a group which is dissociatable with a base (e.g., carboxy, sulfo, acylsulfamoyl, and carbamoylsulfamoyl). Exemplary compounds containing such a group are described in, for example, in JP-A 234471/1995, 333466/1993, 19032/1994, 19031/1994, 45761/1993, 259240/1991, 5610/1995, and 244348/1995, U.S. Pat. Nos. 4,994,365 and 4,988,604, and German Patent No. 4006032.

In formula (H), each of $A_{01}$ and $A_{02}$ is a hydrogen atom, a substituted or unsubstituted alkyl- or arylsulfonyl group having up to 20 carbon atoms (preferably a phenylsulfonyl group or a phenylsulfonyl group substituted such that the sum of Hammette's substituent constants may be −0.5 or more), or a substituted or unsubstituted acyl group having up to 20 carbon atoms (preferably a benzoyl group, a benzoyl group substituted such that the sum of Hammette's substituent constants may be −0.5 or more, or a linear, branched or cyclic, substituted or unsubstituted, aliphatic acyl group wherein the substituent is selected from a halogen atom, ether group, sulfonamide group, carbonamide group, hydroxyl group, carboxy group and sulfo group). Most preferably, both $A_{01}$ and $A_{02}$ are hydrogen atoms.

Illustrative, non-limiting, examples of the compound represented by formula (H) are given below.

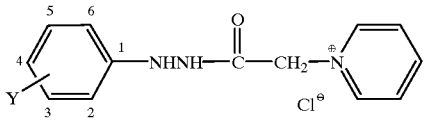

Y =

H-201

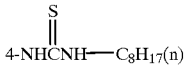

H-202

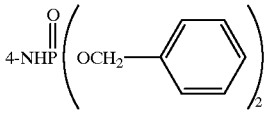

H-203

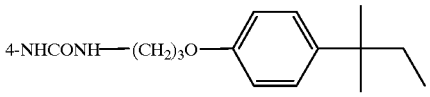

-continued

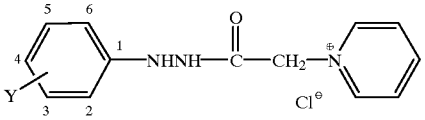

Y =

H-204

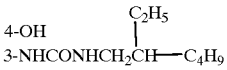

H-205

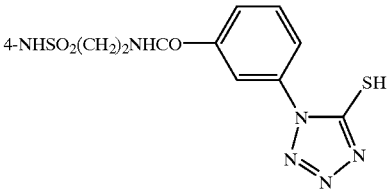

H-206

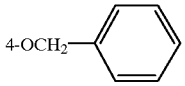

H-207

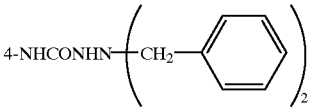

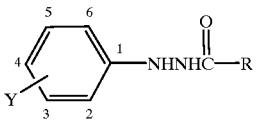

R =

| Y = | | —H | 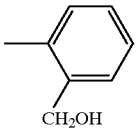 | 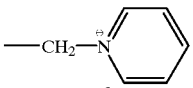 |
|---|---|---|---|---|
| H-208 | 2-$OCH_3$ 5-$OCH_3$ | H-208a | H-208c | H-208f |
| H-209 | 4-$C_8H_{17}$(t) | H-209a | H-209c | H-209f |
| H-210 | 3-$OCH_3$ | H-210a | H-210c | H-210f |
| H-211 | 3-$NO_2$ | H-211a | H-211c | H-211f |

-continued
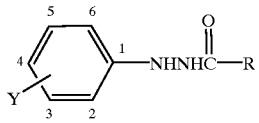
| Y = | R = —H | 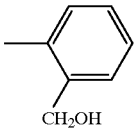 | 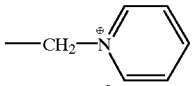 |
|---|---|---|---|
| H-212 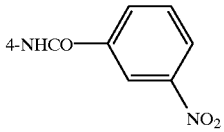 | H-212a | H-212c | H-212f |
| H-213 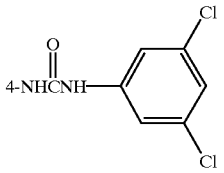 | H-213a | H-213c | H-213f |
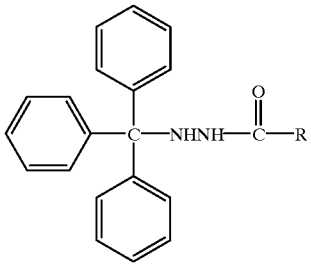
R =
| | |
|---|---|
| H-214 | 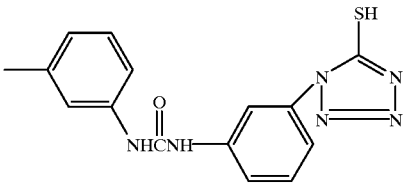 |
| H-215 | 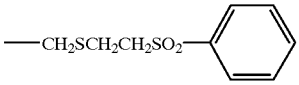 |
| H-216 | $—CH_2OCH_2CH_2SCH_2CH_2OCH_3$ |
| H-217 | $—CF_2CF_2COOH$ |
| H-218 | 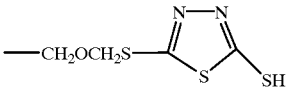 |
-continued
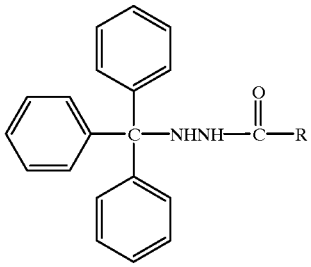
R =
| | |
|---|---|
| H-219 | 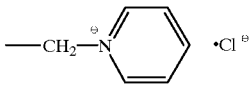 |
| H-220 | 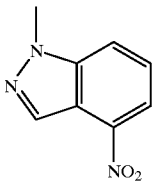 |

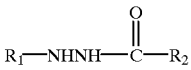
| | $R_1$ = | $R_2$ = | | | |
|---|---|---|---|---|---|
| | | 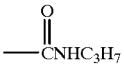 | 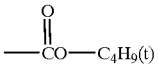 |  | 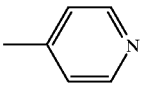 |
| H-221 | 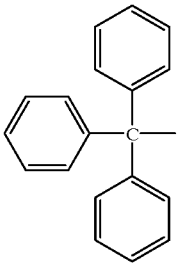 | H-221s | H-221x | H-221y | H-221w |
| H-222 | 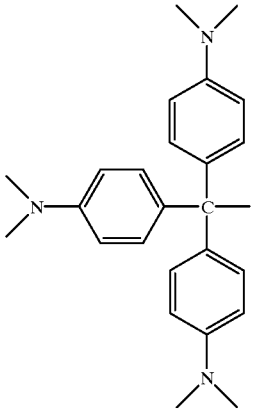 | H-222s | H-222x | H-222y | H-222w |
| H-223 | 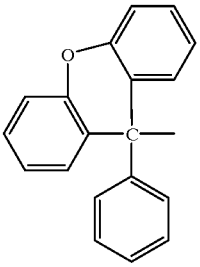 | H-223s | H-223x | H-223y | H-223w |
| H-224 | 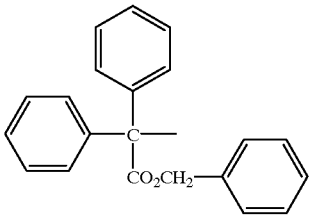 | H-224s | H-224x | H-224y | H-224w |

-continued
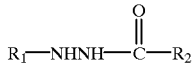
| | $R_1$ = | $R_2$ = | | | |
|---|---|---|---|---|---|
| | | 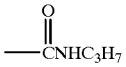 | 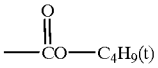 |  | 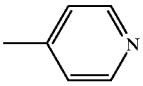 |
| H-225 | 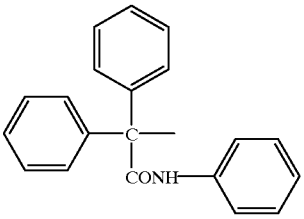 | H-225s | H-225x | H-225y | H-225w |

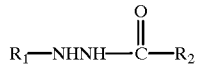
| | $R_1$ = | $R_2$ = —H | —$CH_2O$—$C_6H_4$—$NO_2$ | —$C_6H_4$—N($CH_3$)$_2$ | —NH—$C_6H_4$ |
|---|---|---|---|---|---|
| H-226 | 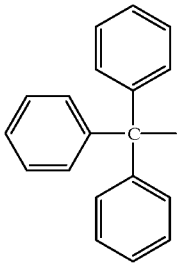 | H-226a | H-226u | H-226v | H-226t |
| H-227 | 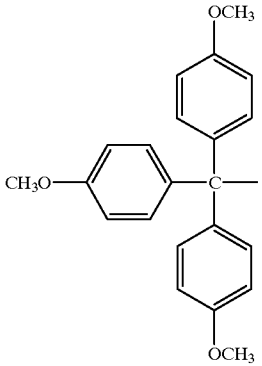 | H-227a | H-227u | H-227v | H-227t |

-continued
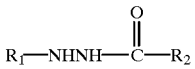
| $R_1$ = | | $R_2$ = —H | —$CH_2O$— 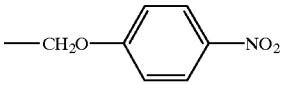 | 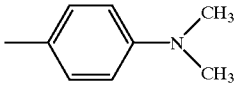 | —NH— 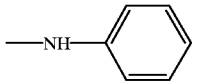 |
|---|---|---|---|---|---|
| H-228 | 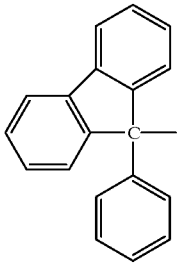 | H-228a | H-228u | H-228v | H-228t |
| H-229 | 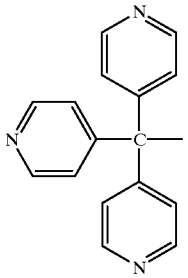 | H-229a | H-229u | H-229v | H-229t |
| H-230 | 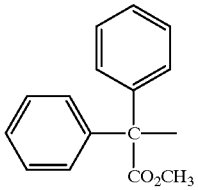 | H-230a | H-230u | H-230v | H-230t |

-continued
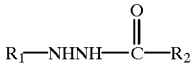
| $R_1$ = | $R_2$ = —H | 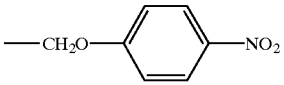 | 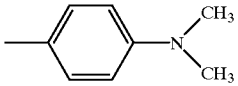 | 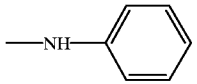 |
|---|---|---|---|---|
| H-231 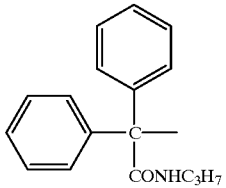 | H-231a | H-231u | H-231v | H-231t |

Next, preferred hydrazine derivatives of the general formulae (H-I) to (H-VIII) are described in detail.

general formula (H-I)

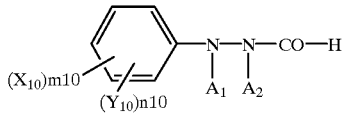

general formula (H-II)

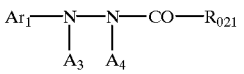

general formula (H-III)

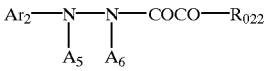

general formula (H-IV)

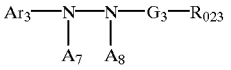

general formula (H-V)

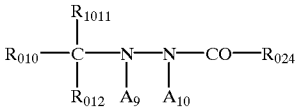

general formula (H-VI)

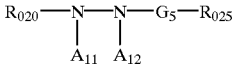

general formula (H-VII)

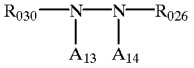

general formula (H-VIII)

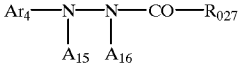

In formula (H-I), each of $A_1$ and $A_2$ is a hydrogen atom, a substituted or unsubstituted alkyl- or arylsulfonyl group having up to 20 carbon atoms (preferably a phenylsulfonyl group or a phenylsulfonyl group substituted such that the sum of Hammette's substituent constants may be −0.5 or more), or a substituted or unsubstituted acyl group having up to 20 carbon atoms (preferably a benzoyl group or a benzoyl group substituted such that the sum of Hammette's substituent constants may be −0.5 or more, or linear, branched or cyclic substituted or unsubstituted aliphatic acyl group wherein exemplary substituents include halogen, ether, sulfonamide, carbonamide, hydroxy, carboxy, and sulfo groups). Most preferably, $A_1$ and $A_2$ are hydrogen atoms.

It is noted that either of $A_1$ and $A_2$ is not hydrogen when m10 is 0, that is, where m10 is 0 and n10 is 0 or where m10 is 0 and n10 is 1 to 4, In formula (H-I), it is most preferred that m10 is 1 or 2 and n10 is 0 or that m10 is 1 and n10 is 1.

$X_{10}$ in formula (H-I) is preferably a sulfonamide, ureido, thioureido, alkoxy having at least 2 carbon atoms in total, acylamino having at least 3 carbon atoms in total, carbamoyl, sulfamoyl, or carboxy (inclusive of salts) group.

$Y_{10}$ in formula (H-I) is a nitro, methoxy, alkyl (preferably having 1 to 10 carbon atoms, for example, methyl, ethyl, propyl, isopropyl, t-butyl, t-pentyl and t-octyl) or acetamide group.

In formula (H-II), $Ar_1$ is an aromatic or heterocyclic group. The aromatic groups are monocyclic or fused ring aryl groups, for example, phenyl and naphthyl groups. The heterocyclic groups include monocyclic or fused ring, saturated or unsaturated, aromatic or non-aromatic heterocyclic groups while the heterocycles in these groups include pyridine, pyrimidine, imidazole, pyrazole, quinoline, isoquinoline, benzimidazole, thiazole, benzothiazole, piperidine, triazine, morpholino, pyrrolidine, indazole, and tetrazole rings. Preferably, $Ar_1$ is an aryl group, especially phenyl.

The group represented by $Ar_1$ may have a substituent. Exemplary substituents include halogen atoms (e.g., fluorine, chlorine, bromine and iodine), alkyl groups (inclusive of aralkyl, cycloalkyl and active methine groups), alkenyl groups, alkynyl groups, aryl groups, heterocyclic groups, heterocyclic groups containing a quaternized nitrogen atom (e.g., pyridinio), acyl groups, alkoxycarbonyl groups, aryloxycarbonyl groups, carbamoyl groups, carboxy groups or salts thereof, sulfonylcarbamoyl groups, acylcarbamoyl groups, sulfamoylcarbamoyl groups, carbazoyl groups, oxalyl groups, oxamoyl groups, cyano groups, thiocarbamoyl groups, hydroxy groups, alkoxy groups (inclusive of groups having recurring ethylenoxy or propylenoxy units), aryloxy groups, heterocyclic oxy groups, acyloxy groups, (alkoxy or aryloxy)carbonyloxy groups, carbamoyloxy groups, sulfonyloxy groups, amino groups, (alkyl, aryl or heterocyclic) amino groups, N-substituted nitrogenous heterocyclic groups, acylamino groups, sulfonamide groups, ureido groups, thioureido groups, imide groups, (alkoxy or aryloxy)carbonylamino groups, sulfamoylamino groups, semicarbazide groups, thiosemicarbazide groups, hydrazino groups, quaternary ammonio groups, oxamoylamino groups, (alkyl or aryl)sulfonylureido groups, acylureido groups, acylsulfamoylamino groups, nitro groups, mercapto groups, (alkyl, aryl or heterocyclic) thio groups, (alkyl or aryl)sulfonyl groups, (alkyl or aryl)sulfinyl groups, sulfo groups or salts thereof, sulfamoyl groups, acylsulfamoyl groups, sulfonylsulfamoyl groups or salts thereof, and groups containing a phosphoric amide or phosphoric ester structure. These substituents may be further substituted with such a substituent.

Preferred examples of the substituent $Ar_1$ may have include alkyl (inclusive of active methylene groups), aralkyl, heterocyclic, substituted amino, acylamino, sulfonamide, ureido, sulfamoylamino, imide, thioureido, phosphoric amide, hydroxy, alkoxy, aryloxy, acyloxy, acyl, alkoxycarbonyl, aryloxycarbonyl, carbamoyl, carboxy (inclusive of salts thereof), (alkyl, aryl or heterocyclic) thio, sulfo (inclusive of salts thereof), sulfamoyl, halogen, cyano and nitro groups.

Where $Ar_1$ is a substituted phenyl group, the substituent is preferably a sulfonamide, ureido, thioureido, alkoxy, acylamino, carbamoyl, sulfamoyl, nitro, chloro or carboxy (inclusive of salts thereof) group, especially a sulfonamide, ureido, alkoxy, acylamino, nitro or carboxy group.

In formula (H-II), $R_{021}$ is an alkyl group having at least one electron attractive group substituted thereon, aryl group having at least one electron attractive group substituted thereon, alkenyl group, alkynyl group, heterocyclic group, amino group (inclusive of unsubstituted amino, alkylamino, arylamino, and heterocyclic amino groups), hydrazino group, alkoxy group or aryloxy group.

The electron attractive group is a substituent whose Hammette's substituent constant $\sigma_m$ has a positive value. Exemplary electron attractive groups are the following specific groups excluding alkyl and pyridinio groups, that is, halogen atoms, nitro, cyano, acyl, alkoxycarbonyl, aryloxycarbonyl, sulfonamide, sulfamoyl, carbamoyl, acyloxy, (alkyl or aryl)sulfonyl, alkoxy, aryloxy, (alkyl or aryl)thio, hydroxy, sulfo, aryl, phosphonyl, and imide groups.

The alkyl groups having at least one electron attractive group substituted thereon, represented by $R_{021}$, are preferably those having 1 to 10 carbon atoms, for example, trifluoromethyl, difluoromethyl, 2-carboxytetrafluoroethyl, difluoromethoxymethyl, difluorocarboxymethyl, 3-methanesulfonamidopropyl, phenylsulfonylmethyl, o-hydroxybenzyl, methoxymethyl, phenoxymethyl, 4-ethylphenoxymethyl, phenylthiomethyl, cyanomethyl, diphenylmethyl, di(methylthio)methyl, succinimidomethyl, and 2-hydroxyethyl groups.

The aryl groups having at least one electron attractive group substituted thereon are preferably monocyclic aryl groups, especially substituted phenyl groups, for example, perfluorophenyl, 3,5-dichlorophenyl, 2-methanesulfonamidophenyl, 2-carbamoylphenyl, 4,5-dicyanophenyl, 2,6-dichloro-4-cyanophenyl, 2-chloro-5-octylsulfamoylphenyl, and 3-methoxyphenyl groups.

The alkenyl groups are preferably those having 1 to 10 carbon atoms, for example, vinyl, 2-ethoxycarbonylvinyl, and 2-trifluoro-2-methoxycarbonylvinyl groups. The alkynyl groups are preferably those having 1 to 10 carbon atoms, for example, ethynyl, 2-methoxycarbonylethynyl, and 2-trifluoroethynyl groups.

The heterocyclic groups are preferably 5- and 6-membered, saturated or unsaturated, monocyclic or fused ring, heterocyclic groups containing at least one of nitrogen, oxygen and sulfur atoms, for example, morpholino, piperidino (N-substituted), imidazolyl, indazolyl (e.g., 4-nitroindazolyl), pyrazolyl, triazolyl, benzimidazolyl, tetrazolyl, pyridiyl, pyridinio (e.g., N-methyl-3-pyridinio), quinolinio and quinolyl groups.

The alkoxy groups are preferably those having 1 to 8 carbon atoms, for example, methoxy, 2-hydroxyethoxy, benzyloxy, and t-butoxy groups. The aryloxy groups are preferably substituted or unsubstituted phenoxy groups. The amino groups are preferably unsubstituted amino, alkylamino having 1 to 10 carbon atoms, arylamino, and saturated or unsaturated heterocyclic amino groups (inclusive of nitrogenous heterocyclic amino groups containing a quaternized nitrogen atom). Examples of the amino group include 2,2,6,6-tetramethylpiperidin-4-ylamino, propylamino, 2-hydroxyethylamino, anilino, o-hydroxyanilino, 5-benzotriazolylamino, and N-benzyl-3-pyridinioamino groups. The hydrazino groups are preferably substituted or unsubstituted hydrazino groups and substituted or unsubstituted phenylhydrazino groups (e.g., 4-benzenesulfonamidophenylhydrazino).

The groups represented by $R_{021}$ may be substituted ones, with examples of the substituent being as exemplified for the substituent on $Ar_1$.

In formula (H-II), $R_{021}$ is preferably an alkyl group having at least one electron attractive group substituted thereon, an aryl group having at least one electron attractive group substituted thereon, or a heterocyclic group, more preferably an alkyl group having at least one electron attractive group substituted thereon wherein the electron attractive group is preferably a fluorine atom, chlorine atom, alkylsulfonyl, arylsulfonyl, alkoxy, aryloxy, alkylthio or arylthio group, more preferably a fluorine atom, chlorine atom, alkoxy or aryloxy group.

In formula (H-II), $A_3$ and $A_4$ are as defined for $A_1$ and $A_2$ in formula (H-I), with their preferred range being also the same.

Among the compounds of formula (H-II), most preferred are those wherein $Ar_1$ is a substituted phenyl group having a sulfonamide, ureido, thioureido, alkoxy, acylamino, carbamoyl, sulfamoyl, nitro, chloro or carboxy (inclusive of salts thereof) group substituted thereon, $R_{021}$ is a substituted alkyl group having a fluorine atom, chlorine atom, alkoxy or aryloxy group substituted thereon, and $A_3$ and $A_4$ are hydrogen.

In formula (H-III), $Ar_2$ is as defined for $Ar_1$ in formula (H-II), with its preferred range being also the same. $A_5$ and $A_6$ are as defined for $A_1$ and $A_2$ in formula (H-I), with their preferred range being also the same.

$R_{022}$ is hydrogen or a block group. Examples of the block group include aliphatic groups (e.g., alkyl, alkenyl and alkynyl groups), aromatic groups (e.g., monocyclic or fused ring aryl groups), heterocyclic groups, alkoxy, aryloxy, amino (inclusive of unsubstituted amino, alkylamino, arylamino, and heterocyclic amino groups) and hydrazino groups. Preferred examples of these groups are the same as the illustrative examples of $R_{021}$ in formula (H-II) while the alkyl and aryl groups may be unsubstituted ones or have any substituent (as exemplified for the substituent on $Ar_1$ in formula (H-II)). For example, the alkyl groups include methyl, ethyl, 2-carboxyethyl, t-butyl, pyridiniomethyl, and ammoniomethyl groups, and the aryl groups include phenyl, 4-methoxyphenyl, and o-hydroxymethylphenyl groups.

In formula (H-III), $R_{022}$ is preferably a substituted amino group, more preferably an alkylamino group having 1 to 10 carbon atoms, arylamino group, or saturated or unsaturated heterocyclic amino group (inclusive of a nitrogenous heterocyclic amino group having a quaternized nitrogen atom). Illustrative examples of these groups are as exemplified for $R_{021}$ in formula (H-II).

Among the compounds of formula (H-III), most preferred are those wherein $Ar_2$ is a substituted phenyl group having a sulfonamide, ureido, thioureido, alkoxy, acylamino, carbamoyl, sulfamoyl, nitro, chloro or carboxy (inclusive of salts thereof) group substituted thereon, $R_{022}$ is an alkylamino, arylamino or saturated or unsaturated heterocyclic amino group, and $A_5$ and $A_6$ are hydrogen.

In formula (H-IV), $Ar_3$ is as defined for $Ar_1$ in formula (H-II), with its preferred range being also the same. $A_7$ and $A_8$ are as defined for $A_1$ and $A_2$ in formula (H-I), with their preferred range being also the same. $R_{023}$ is hydrogen or a block group which is as defined for $R_{022}$ in formula (H-III). $G_3$ is a group represented by —C(=S)—, —$SO_2$—, —SO— or —PO($R_{033}$)— or iminomethylene group wherein $R_{033}$ is a group selected from the same range as defined for $R_{023}$ and may be identical with or different from $R_{023}$.

In formula (H-IV), $G_3$ is preferably a group represented by —C(=S)—, —$SO_2$— or —PO($R_{033}$)—. $R_{023}$ is preferably an amino or hydrazino group when $G_3$ is —C(=S)—, an alkyl, aryl or amino group when $G_3$ is —$SO_2$—, and an amino, alkoxy, aryloxy, alkyl or aryl group when $G_3$ is —PO($R_{033}$)—. Most preferably, $G_3$ is —$SO_2$—.

Among the compounds of formula (H-IV), most preferred are those wherein $Ar_3$ is a substituted phenyl group having a sulfonamide, ureido, thioureido, alkoxy, acylamino, carbamoyl, sulfamoyl, nitro, chloro or carboxy (inclusive of salts thereof) group substituted thereon, G, is —$SO_2$—, $R_{023}$ is an alkyl, aryl or amino group, and $A_7$ and $A_8$ are hydrogen.

In formula (H-V), $A_9$ and $A_{10}$ are as defined for $A_1$ and $A_2$ in formula (H-I), with their preferred range being also the same. $R_{024}$ is hydrogen or a block group which is as defined for $R_{022}$ in formula (H-III). $R_{024}$ is preferably a hydrogen atom, alkyl, aryl, heterocyclic, amino, alkoxy or aryloxy group, more preferably a hydrogen atom, alkyl, aryl, heterocyclic, amino or alkoxy group.

In formula (H-V), each of $R_{010}$, $R_{011}$, and $R_{012}$ is hydrogen or a monovalent substituent group. The monovalent substituent is as exemplified for the substituent on $Ar_1$ in formula (H-II). It is noted that all $R_{010}$, $R_{011}$, and $R_{012}$ are not aromatic groups (inclusive of aromatic heterocyclic groups) at the same time.

Preferred examples of the substituent represented by $R_{010}$, $R_{011}$, and $R_{012}$ include alkyl, aryl, heterocyclic, halogen, cyano, alkoxycarbonyl, aryloxycarbonyl, carbamoyl, sulfamoyl, alkoxy, aryloxy, amino, (alkyl, aryl and heterocyclic) amino, and (alkyl, aryl and heterocyclic) thio groups, more preferably alkyl, aryl, cyano, alkoxycarbonyl, aryloxycarbonyl, carbamoyl, and (alkyl, aryl and heterocyclic) thio groups.

Examples of the methyl group having $R_{010}$, $R_{011}$, and $R_{012}$ substituted thereon include t-butyl, dicyanomethyl, cyanodimethylmethyl, diphenylmethyl, triphenylmethyl (or trityl), methoxycarbonyldiphenylmethyl, cyanodiphenylmethyl, methylthiodiphenylmethyl, cyclopropyldiphenylmethyl, di(methylthio)methyl, and 1,3-dithiolan-2-ylmethyl groups.

Preferably, at least one of $R_{010}$, $R_{011}$, and $R_{012}$ is an aryl group. More preferably, two of $R_{010}$, $R_{011}$, and $R_{012}$ are aryl groups. Herein, the aryl group is most preferably a substituted or unsubstituted phenyl group.

Among the compounds of formula (H-V), most preferred are those wherein one or two of $R_{010}$, $R_{011}$, and $R_{012}$ are aryl groups, especially substituted or unsubstituted phenyl groups, $R_{024}$ is hydrogen or an alkyl, aryl, heterocyclic, amino or alkoxy group, and $A_9$ and $A_{10}$ are hydrogen.

In formula (H-VI), $A_{11}$ and $A_{12}$ are as defined for $A_1$ and $A_2$ in formula (H-I), with their preferred range being also the same. $R_{025}$ is hydrogen or a block group which is as defined for $R_{022}$ in formula (H-III). $G_5$ is a group represented by —COCO—, —C(=S)—, —$SO_2$—, —SO— or —PO($R_{055}$)— or iminomethylene group wherein $R_{055}$ is a group selected from the same range as defined for $R_{025}$ and may be identical with or different from $R_{025}$. It is noted that $R_{025}$ is not an unsubstituted anilino group when $G_5$ is a group —C(=S)—.

In formula (H-VI), $R_{020}$ is an aliphatic group. Preferred aliphatic groups are alkyl groups having 1 to 30 carbon atoms, especially substituted methyl groups wherein the substituent is as defined for the substituents represented by $R_{010}$, $R_{011}$, and $R_{012}$ in formula (H-V), with its preferred range being the same. It is noted that in formula (H-VI), the substituent may also be a methyl group having three aromatic or aromatic heterocyclic groups substituted thereon, for example, triphenylmethyl (or trityl), tri(4-methoxyphenyl)methyl, and 9-phenylxanthen-9-yl groups. More preferably, $R_{020}$ is a di- or tri-substituted methyl group having at least two aryl groups substituted thereon, most preferably a trityl group.

In formula (H-VI), $G_5$ is preferably —COCO—, —$SO_2$— or —PO($R_{055}$)—. When $G_5$ is —COCO—, $R_{025}$ is preferably selected from substituted amino groups, especially alkylamino groups having 1 to 10 carbon atoms, arylamino groups, and saturated or unsaturated heterocyclic amino groups (inclusive of nitrogenous heterocyclic amino groups containing a quaternized nitrogen atom). When $G_5$ is —$SO_2$—, $R_{025}$ is preferably selected from alkyl, aryl and amino groups. When $G_5$ is —PO($R_{055}$)—, $R_{025}$ is preferably selected from amino, alkoxy, aryloxy, alkyl, and aryl groups. Most preferably, $G_5$ is —COCO—.

Among the compounds of formula (H-VI), most preferred are those wherein $R_{020}$ is a di- or tri-substituted methyl group having at least two aryl groups substituted thereon, $G_5$ is —COCO—, $R_{025}$ is an alkylamino, arylamino or saturated or unsaturated heterocyclic amino group, and $A_{11}$ and $A_{12}$ are hydrogen.

In formula (H-VII), $A_{13}$ and $A_{14}$ are as defined for $A_1$ and $A_2$ in formula (H-I), with their preferred range being also the same. $R_{030}$ is an aliphatic group which is as defined for $R_{020}$ in formula (H-VI), with its preferred range being also the same. $R_{026}$ is an aliphatic, aromatic or heterocyclic group. It is noted that $R_{026}$ is not an unsubstituted phenyl group when $R_{030}$ is a trityl group.

Where $R_{026}$ is an aliphatic group, its preferred range is the same as the aliphatic group represented by $R_{020}$ in formula (H-VI). Where $R_{026}$ is an aromatic or heterocyclic group, their preferred range is the same as the aromatic or heterocyclic group represented by $Ar_1$ in formula (H-II).

$R_{026}$ is preferably an aromatic or aliphatic group, more preferably a substituted phenyl group or substituted methyl group. Where $R_{026}$ is a substituted phenyl group, preferred examples of the substituent include sulfonamide, ureido, thioureido, alkoxy, acylamino, carbamoyl, sulfamoyl, nitro, chloro, cyano, and carboxy (inclusive of salts thereof) groups. Where $R_{026}$ is a substituted methyl group, the preferred range of the substituent is the same as the preferred range of the substituent described where the aliphatic group represented by $R_{020}$ in formula (H-VI) is a substituted methyl group.

Among the compounds of formula (H-VII), most preferred are those wherein each of $R_{030}$ and $R_{026}$ is a di- or tri-substituted methyl group having at least two aryl groups substituted thereon, or $R_{030}$ is a di- or tri-substituted methyl group having at least two aryl groups substituted thereon, and $R_{026}$ is a substituted phenyl group having a sulfonamide, ureido, thioureido, alkoxy, acylamino, carbamoyl, sulfamoyl, nitro, chloro, cyano or carboxy (inclusive of salts thereof) group substituted thereon, and $A_{13}$ and $A_{14}$ are hydrogen.

In formula (H-VIII), $A_{15}$ and $A_{16}$ are as defined for $A_1$ and $A_2$ in formula (H-I), with their preferred range being also the same. $Ar_4$ is as defined for $Ar_1$ in formula (H-II), with its preferred range being also the same. $R_{027}$ is an unsubstituted amino, alkylamino, heterocyclic amino or alkynyl group. Illustrative examples of these groups are as exemplified in conjunction with $R_{021}$ in formula (H-II). $R_{27}$ is preferably an alkylamino or heterocyclic amino group.

Among the compounds of formula (H-VIII), most preferred are those wherein $Ar_4$ is a substituted phenyl group having a sulfonamide, ureido, thioureido, alkoxy, acylamino, carbamoyl, sulfamoyl, nitro, chloro or carboxy (inclusive of salts thereof) group substituted thereon, $R_{027}$ is an alkylamino or heterocyclic amino group, and $A_{15}$ and $A_{16}$ are hydrogen.

In formula (H-IV) or (H-V), each of $R_{023}$ and $R_{024}$ may be such a group as to induce cyclization reaction to cleave a -$G_3$-$R_{023}$ or —CO—$R_{024}$ moiety from the remaining molecule to generate a cyclic structure containing the atoms of the -$G_3$-$R_{023}$ or —CO—$R_{024}$ moiety. Such examples are described in JP-A 29751/1988, for example.

The hydrazine derivatives of formulae (H-I) to (H-VIII) may have incorporated therein a group capable of adsorbing to silver halide. Such adsorptive groups include alkylthio, arylthio, thiourea, thioamide, mercapto heterocyclic and triazole groups as described in U.S. Pat. Nos. 4,385,108 and 4,459,347, JP-A 195233/1984, 200231/1984, 201045/1984, 201046/1984, 201047/1984, 201048/1984, 201049/1984, 170733/1986, 270744/1986, 948/1987, 234244/1988, 234245/1988, and 234246/1988. These adsorptive groups to silver halide may take the form of precursors. Such precursors are exemplified by the groups described in JP-A 285344/1990.

The hydrazine derivatives of formulae (H-I) to (H-VIII) may have incorporated therein a ballast group or polymer commonly used in immobile photographic additives such as couplers. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

The hydrazine derivatives of formulae (H-I) to (H-VIII) may have a plurality of hydrazino groups as a substituent. In this case, these compounds are polymeric with respect to hydrazino group. Exemplary polymeric compounds are described in JP-A 86134/1989, 16938/1992, 197091/1993, WO 95-32452 and 95-32453, Japanese Patent Application Nos. 351132/1995, 351269/1995, 351168/1995, 351287/1995, and 351279/1995.

The hydrazine derivatives of formulae (H-I) to (H-VIII) may contain a cationic group (e.g., a group containing a quaternary ammonio group and a nitrogenous heterocyclic group containing a quaternized nitrogen atom), a group containing recurring ethylenoxy or propylenoxy units, an (alkyl, aryl or heterocyclic) thio group, or a group which is dissociatable with a base (e.g., carboxy, sulfo, acylsulfamoyl, and carbamoylsulfamoyl). Exemplary compounds containing such a group are described in, for example, in JP-A 234471/1995, 333466/1993, 19032/1994, 19031/1994, 45761/1993, 259240/1991, 5610/1995, and 244348/1995, U.S. Pat. Nos. 4,994,365 and 4,988,604, and German Patent No. 4006032.

Among the hydrazine derivatives of formulae (H-I) to (H-VIII), the hydrazine derivatives of formulae (H-II) to (H-VIII) are preferred; the hydrazine derivatives of formulae (H-II), (H-III), (H-V), (H-VI) and (H-VIII) are more preferred; the hydrazine derivatives of formulae (H-II), (H-III), and (H-VI) are further preferred; and the hydrazine derivatives of formulae (H-II) are most preferred.

Illustrative, non-limiting, examples of the compounds represented by formulae (H-I) to (H-VIII) are given below.

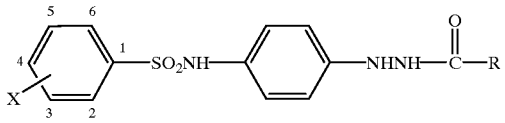

| | X = | R = —H | —$C_2F_4$—COOH or (—$C_2F_4$—$COO^{\ominus}K^{\oplus}$) | 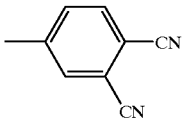 | 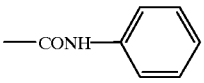 |
|---|---|---|---|---|---|
| H-1 | 3-NHCO—$C_9H_{19}$(n) | 1a | 1b | 1c | 1d |
| H-2 | 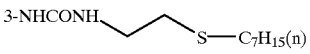 | 2a | 2b | 2c | 2d |
| H-3 | 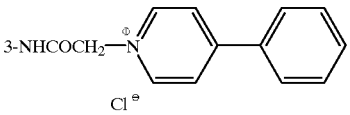 | 3a | 3b | 3c | 3d |
| H-4 | 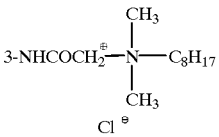 | 4a | 4b | 4c | 4d |
| H-5 | 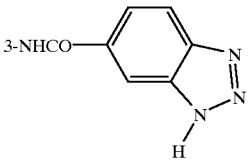 | 5a | 5b | 5c | 5d |

-continued
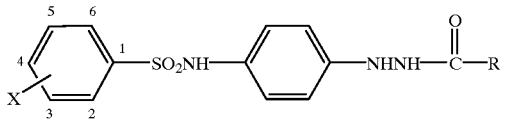
| | X = | R = —H | —$C_2F_4$—COOH or (—$C_2F_4$—$COO^{\ominus}K^{\oplus}$) | 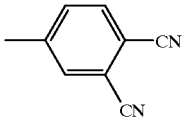 | 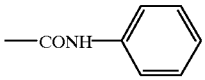 |
|---|---|---|---|---|---|
| H-6 | 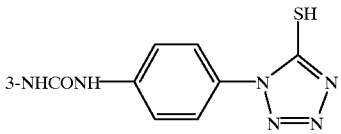 | 6a | 6b | 6c | 6d |
| H-7 | 2,4-$(CH_3)_2$-3-$SC_2H_4$—$(OC_2H_4)_4$—$OC_8H_{17}$ | 7a | 7b | 7c | 7d |
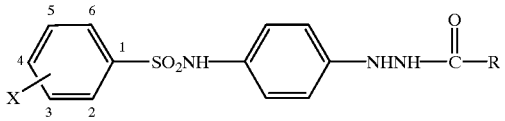
| | X = | R = —H | —$CF_2H$ | 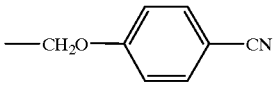 | 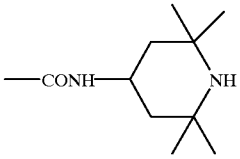 |
|---|---|---|---|---|---|
| H-8 | 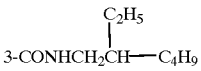 | 8a | 8e | 8f | 8g |
| H-9 | 6-$OC_4H_9$-3-$C_5H_{11}$(t) | 9a | 9e | 9f | 9g |
| H-10 | 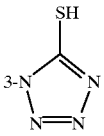 | 10a | 10e | 10f | 10g |
| H-11 | 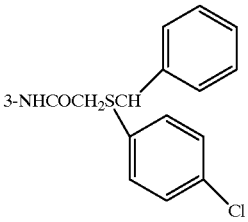 | 11a | 11e | 11f | 11g |
| H-12 | 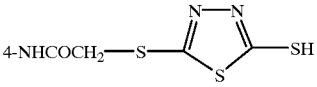 | 12a | 12e | 12f | 12g |

-continued
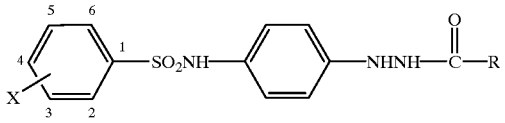
| | X = | R = —H | —$CF_2H$ | —$CH_2O$— 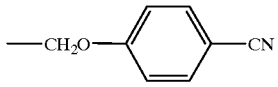 | —CONH— 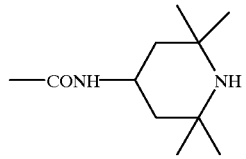 |
|---|---|---|---|---|---|
| H-13 | 3-NHCOCH(—$CH_2COOH$)—$C_8H_{17}$ | 13a | 13e | 13f | 13g |
| H-14 | 3,5—(CONHCH$_2$CH($C_2H_5$)—$C_4H_9$)$_2$ | 14a | 14e | 14f | 14g |
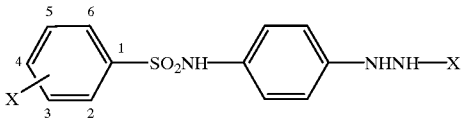
| | Y = | X = —CHO | —$COCF_3$ | —$SO_2CH_3$ | —P(=O)(OC$_2$H$_5$)$_2$ |
|---|---|---|---|---|---|
| H-15 | 3-NHCOCH$_2$N$^{\oplus}$(Cl$^{\ominus}$)—CONHC$_4$H$_9$ | 15a | 15h | 15i | 15j |
| H-16 | 4-NHCO(CH$_2$)$_2$N$^{\oplus}$(Cl$^{\ominus}$)—$C_6H_{13}$ | 16a | 16h | 16i | 16j |
| H-17 | 3-$SO_2$NH—(CH$_2$)$_4$—O—(CH$_2$)$_4$—$OC_4H_9$ | 17a | 17h | 17i | 17j |
| H-18 | 3,4-(COOCH($CH_3$)COOC$_4$H$_9$)$_2$ | 18a | 18h | 18i | 18j |
| H-19 | 3-NHCO—(CH$_2$)$_4$— 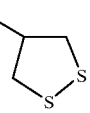 | 19a | 19h | 19i | 19j |

-continued
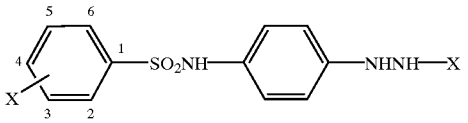
| | Y = | X = —CHO | —COCF$_3$ | —SO$_2$CH$_3$ | —P(=O)(OC$_2$H$_5$)$_2$ |
|---|---|---|---|---|---|
| H-20 | 3-NHSO$_2$NH—C$_8$H$_{17}$ | 20a | 20h | 20i | 20j |
| H-21 | 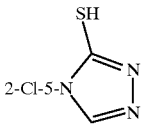 | 21a | 21h | 21i | 21j |

| | | R = | | | |
|---|---|---|---|---|---|
| | | —H | —$CF_3$ | 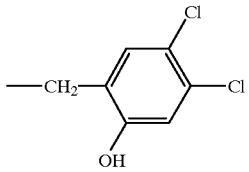 | 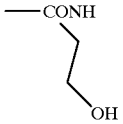 |
| H-22 | 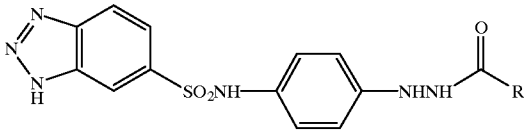 | 22a | 22h | 22k | 22l |
| H-23 | 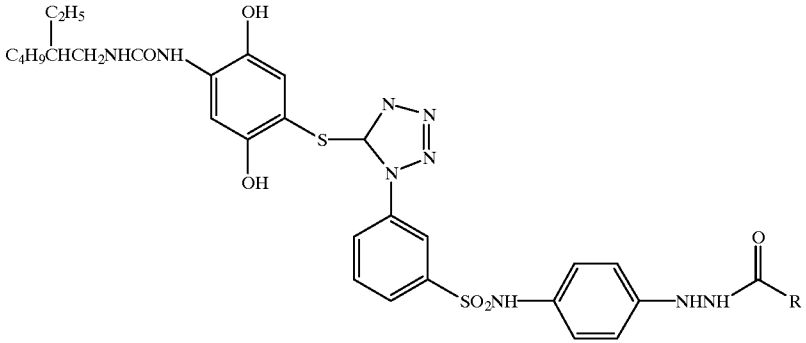 | 23a | 23h | 23k | 23l |

-continued
| | | R = | | | |
|---|---|---|---|---|---|
| | | —H | —$CF_3$ | 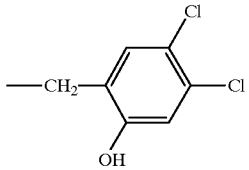 | 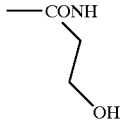 |
| H-24 | 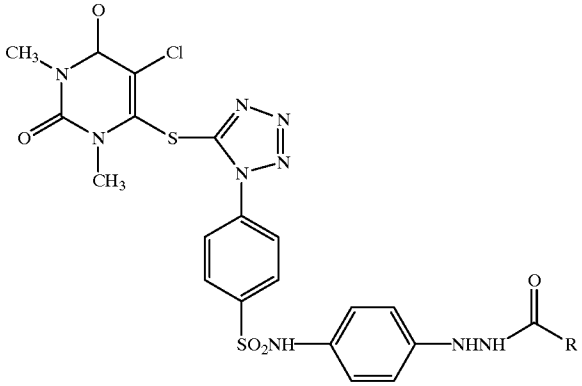 | 24a | 24h | 24k | 24l |
| H-25 | 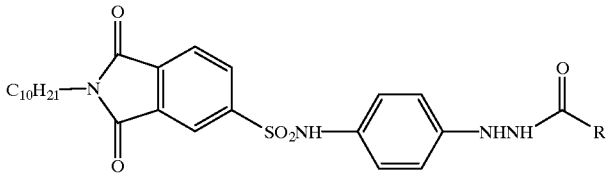 | 25a | 25h | 25k | 25l |

-continued
| | | R = | | | |
|---|---|---|---|---|---|
| | | —H | —$CF_3$ | 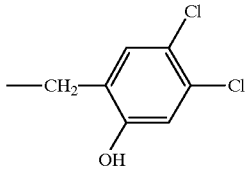 | 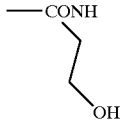 |
| H-26 | 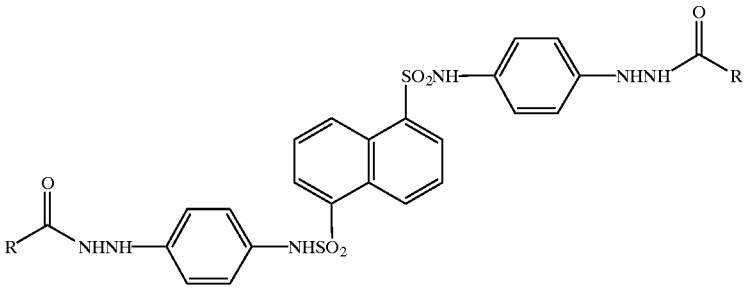 | 26a | 26h | 26k | 26l |
| H-27 | 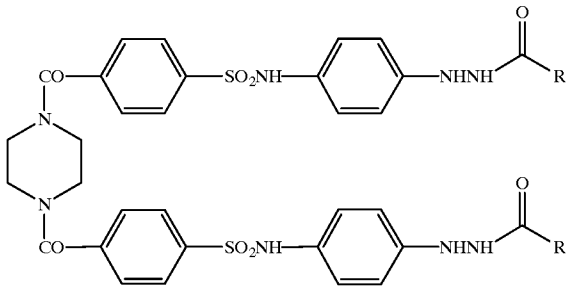 | 27a | 27h | 27k | 27l |

-continued
| | | R = | | | |
|---|---|---|---|---|---|
| | | —H | —$CF_3$ | 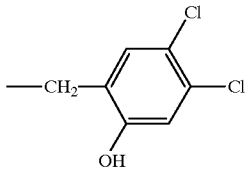 | 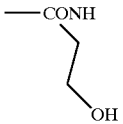 |
| H-28 | 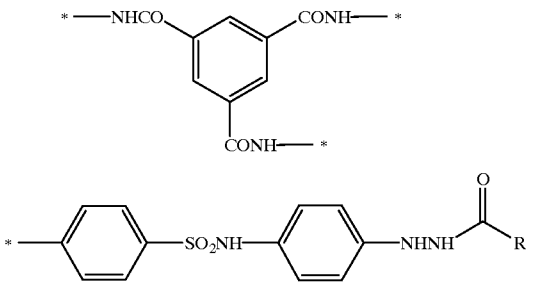 | 28a | 28h | 28k | 28l |

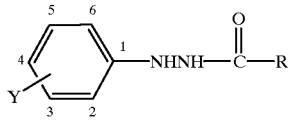
| | Y = | R = —H | —$CH_2OCH_3$ | 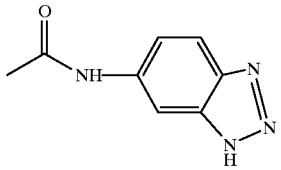 | 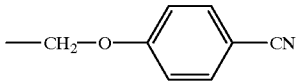 |
|---|---|---|---|---|---|
| H-29 | 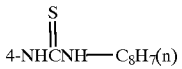 | 29a | 29m | 29n | 29f |
| H-30 | 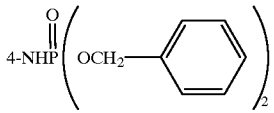 | 30a | 30m | 30n | 30f |
| H-31 | 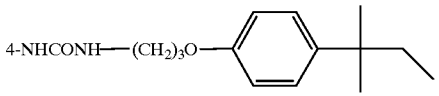 | 31a | 31m | 31n | 31f |
| H-32 | 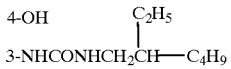 | 32a | 32m | 32n | 32f |
| H-33 | 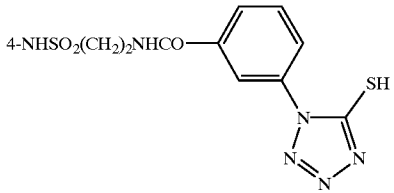 | 33a | 33m | 33n | 33f |

-continued
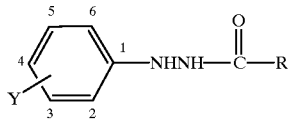
| | | R = | | | |
|---|---|---|---|---|---|
| | Y = | —H | —$CH_2OCH_3$ | 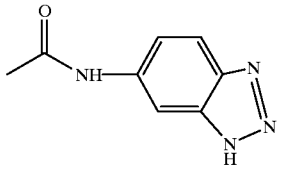 | 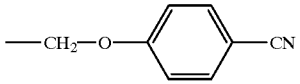 |
| H-34 | 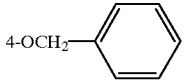 | 34a | 34m | 34n | 34f |
| H-35 | 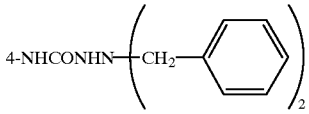 | 35a | 35m | 35n | 35f |

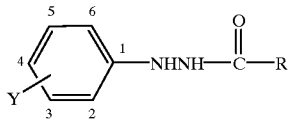
| | Y = | R = —H | —$CF_2SCH_3$ | —$CONHCH_3$ | 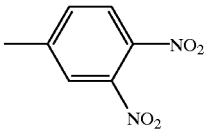 |
|---|---|---|---|---|---|
| H-36 | 2-$NHSO_2CH_3$— 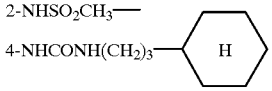 | 36a | 36o | 36p | 36q |
| H-37 | 2-$OCH_3$-<br>4-$NHSO_2C_{12}H_{25}$ | 37a | 37o | 37p | 37q |
| H-38 | 3-$NHCOC_{11}H_{23}$-<br>4-$NHSO_2CF_3$ | 38a | 38o | 38p | 38q |
| H-39 | 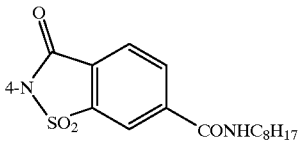 | 39a | 39o | 39p | 39q |
| H-40 | 4-$OCO(CH_2)_2COOC_6H_{13}$ | 40a | 40o | 40p | 40q |
| H-41 | 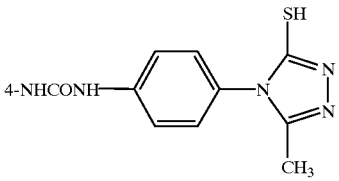 | 41a | 41o | 41p | 41q |
| H-42 | 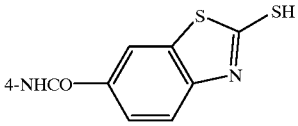 | 42a | 42o | 42p | 42q |
| H-43 | 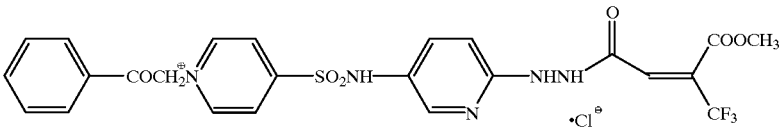 | | | | |
| H-44 | 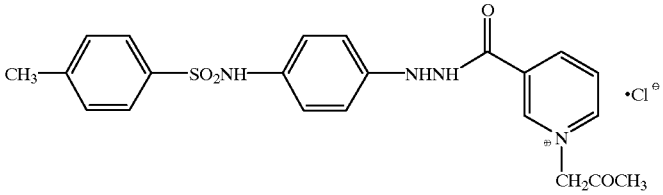 | | | | |
| H-45 | 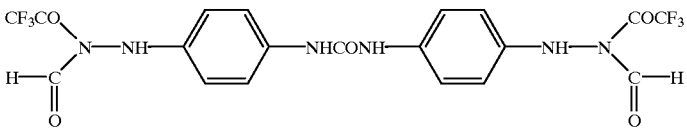 | | | | |

-continued
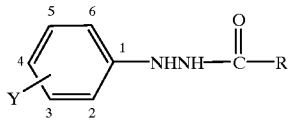
| Y = | R = | | |
|---|---|---|---|
| | —H | —$CF_2SCH_3$ | —$CONHCH_3$ |
H-46
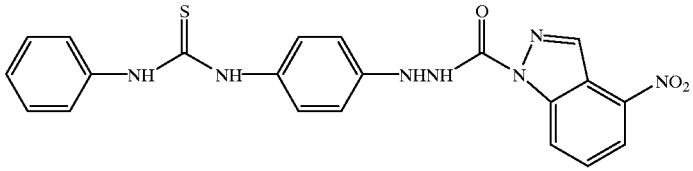
H-47
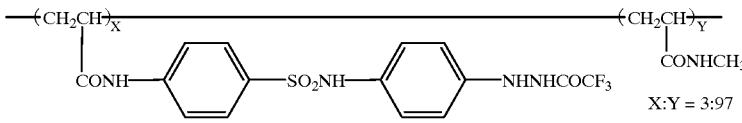
X:Y = 3:97
average molecular weight
~100,000
H-48
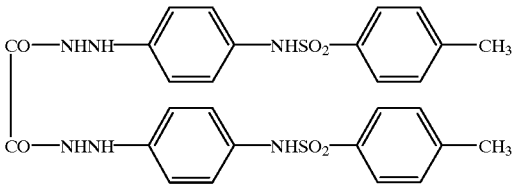
H-49
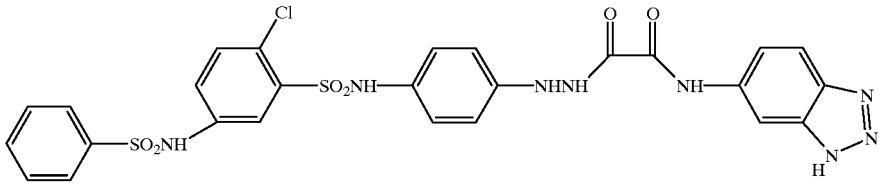
H-50
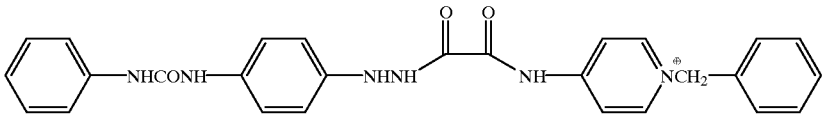
H-51
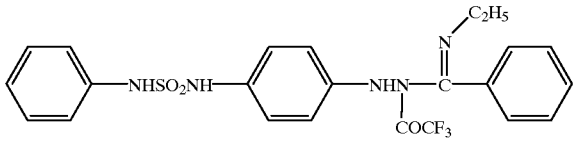

-continued
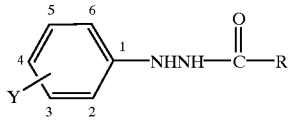
| Y = | R = —H | —$CF_2SCH_3$ | —$CONHCH_3$ | 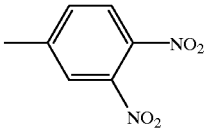 |
|---|---|---|---|---|
| H-52 | 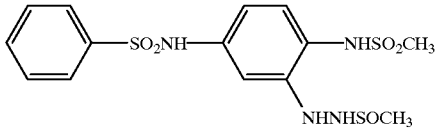 | | | |
| H-53 | 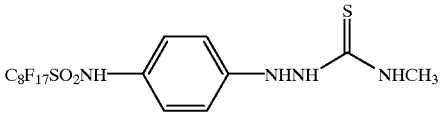 | | | |
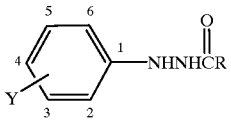
| Y = | R = —H | —$CH_2OCH_3$ | 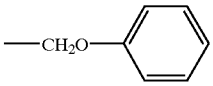 | —$CONHC_3H_7$ |
|---|---|---|---|---|
| H-54 2-$OC_2H_5$ | 54a | 54m | 54r | 54s |
| H-55 2-$OC_4H_9$ 5-$C_8H_{17}$(t) | 55a | 55m | 55r | 55s |
| H-56 4-$NO_2$ | — | 56m | 56r | 56s |
| H-57 4-$CH_3$ | — | 57m | 57r | 57s |
| H-58 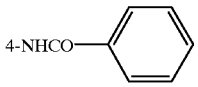 | 58a | 58m | 58r | 58s |
| H-59 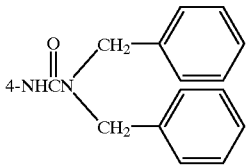 | 59a | 59m | 59r | 59s |

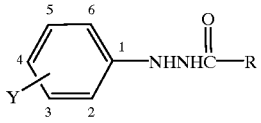
| | | R = | | | |
|---|---|---|---|---|---|
| | Y = | —$CF_2COOH$ | 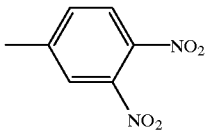 | 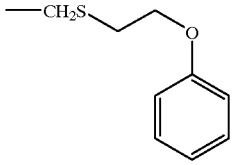 | 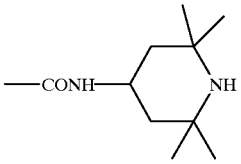 |
| H-60 | 2-$OCH_3$ 5-$OCH_3$ | 60u | 60q | 60t | 60g |
| H-61 | 4-$C_8H_{17}$(t) | 61u | 61q | 61t | 61g |
| H-62 | 4-$OCH_3$ | 62u | 62q | 62t | 62g |
| H-63 | 3-$NO_2$ | 63u | 63q | 63t | 63g |
| H-64 | 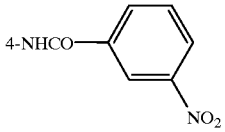 | 64u | 64q | 64t | 64g |
| H-65 | 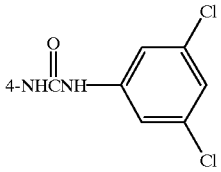 | 65u | 65q | 65t | 65g |
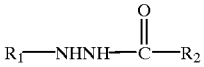
| | | $R_2$ = | | | |
|---|---|---|---|---|---|
| | $R_1$ = | —C≡C—$COOCH_3$ | —$NHC_3H_7$ | 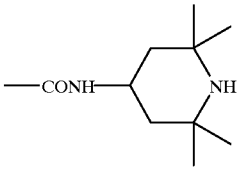 | 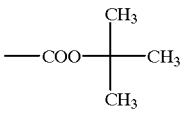 |
| H-66 | 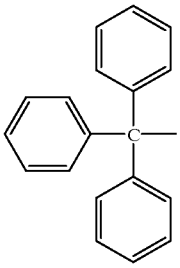 | 66v | 66w | 66g | 66x |

-continued
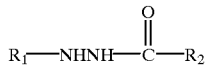
$R_2$ =
| | $R_1$ = | —C≡C—COOCH$_3$ | —NHC$_3$H$_7$ | —CONH— NH | —COO— C(CH$_3$)$_3$ |
|---|---|---|---|---|---|
| H-67 | 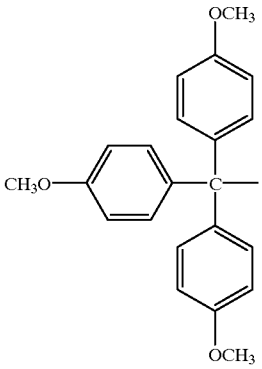 | 67v | 67w | 67g | 67x |
| H-68 | 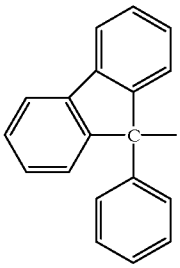 | 68v | 68w | 68g | 68x |
| H-69 | 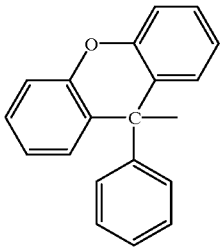 | 69v | 69w | 69g | 69x |
| H-70 | 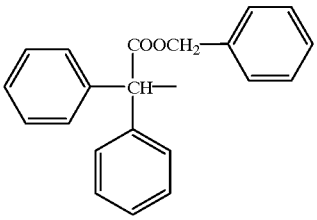 | 70v | 70w | 70g | 70x |

-continued
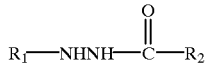
| | $R_2$ = | | | | |
|---|---|---|---|---|---|
| | $R_1$ = | —C≡C—COOCH$_3$ | —NHC$_3$H$_7$ | —CONH— (NH) | —COO—C(CH$_3$)$_3$ |
| H-71 | 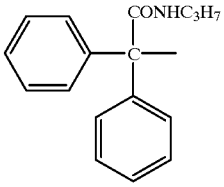 | 71v | 71w | 71g | 71x |

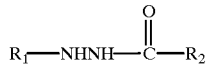
| | $R_1$ = | H | $R_2$ = 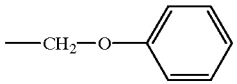 | 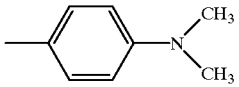 | 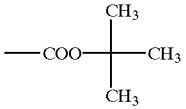 |
|---|---|---|---|---|---|
| H-72 | 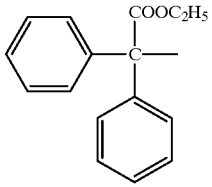 | 72a | 72r | 72y | 72z |
| H-73 | 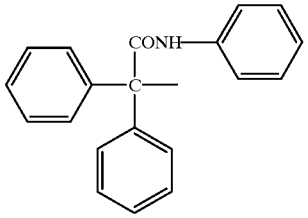 | 73a | 73r | 73y | 73z |
| H-74 | 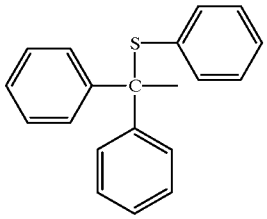 | 74a | 74r | 74y | 74z |

-continued
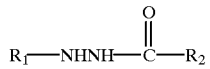
| | $R_1$ = | $R_2$ = 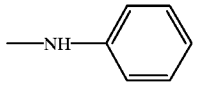 | $-CH_3$ | 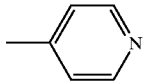 | 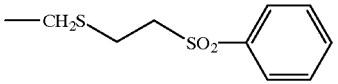 |
|---|---|---|---|---|---|
| H-75 | 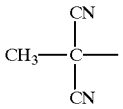 | 75aa | 75bb | 75cc | 75dd |
| H-76 | 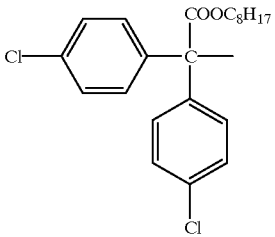 | 76aa | 76bb | 76cc | 76dd |
| H-77 | 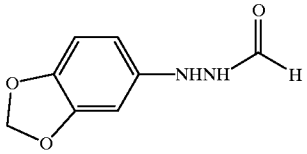 | | | | |
| H-78 | 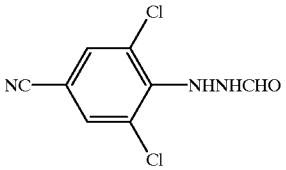 | | | | |

-continued
| | $R_1$—NHNH—C(=O)—$R_2$ |
|---|---|
| H-79 | 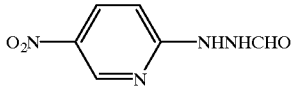 |
| H-80 | 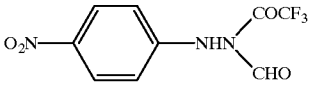 |
| H-81 | 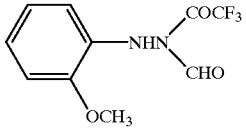 |
| H-82 | 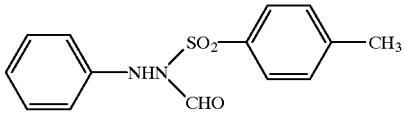 |
| H-83 | 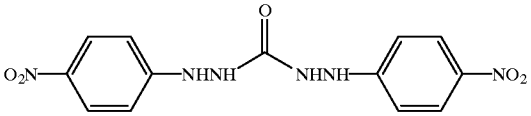 |
| H-84 | 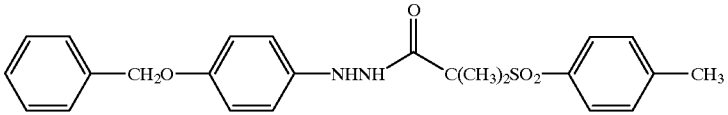 |

-continued
| | $R_1$—NHNH—C(=O)—$R_2$ |
|---|---|
| H-85 | 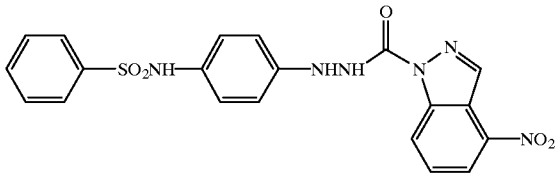 |
| H-86 | 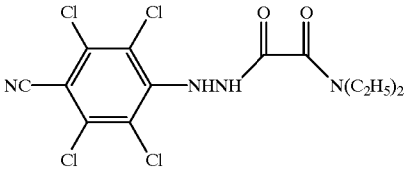 |
| H-87 | 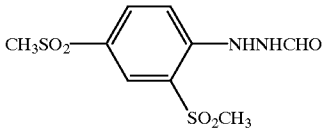 |
| H-88 | 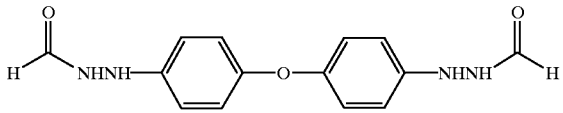 |

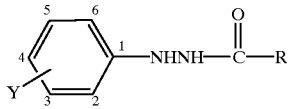
| | Y= | R = 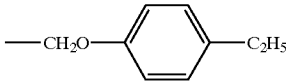 | 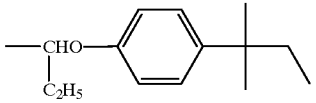 | 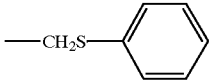 | $-CH_2-Cl$ |
|---|---|---|---|---|---|
| H-89 | 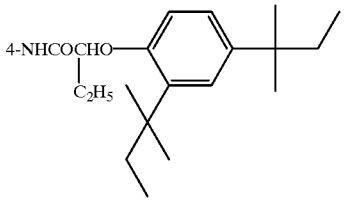 | 89ee | 89ff | 89gg | 89hh |
| H-90 | 4-COOH | 90ee | 90ff | 90gg | 90hh |
| H-91 | 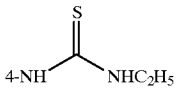 | 91ee | 91ff | 91gg | 91hh |
| H-92 | 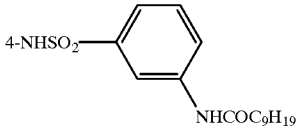 | 92ee | 92ff | 92gg | 92hh |

-continued
| | | | | | |
|---|---|---|---|---|---|
| | 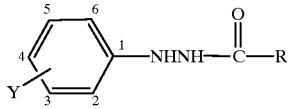 | | | | |
| H-93 | 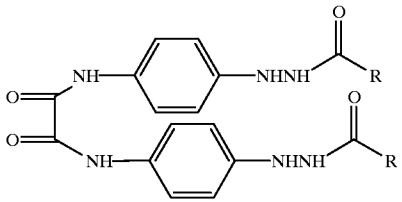 | 93ee | 93ff | 93gg | 93hh |
| H-94 | 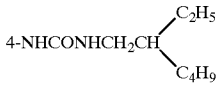 | 94ee | 94ff | 94gg | 94hh |

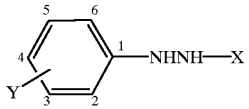
| | Y = | X = | | | |
|---|---|---|---|---|---|
| | | 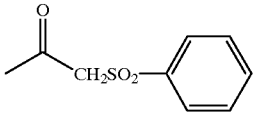 | 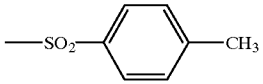 | 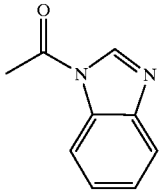 | 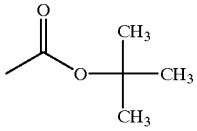 |
| H-95 | 4-$NO_2$ | 95ii | 95jj | 95kk | 95z |
| H-96 | 2,4-$OCH_3$ | 96ii | 96jj | 96kk | 96z |
| H-97 | 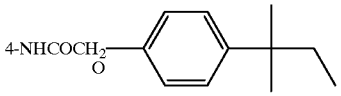 | 97ii | 97jj | 97kk | 97z |
| | Y = | X = | | | |
|---|---|---|---|---|---|
| | | 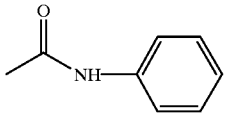 | 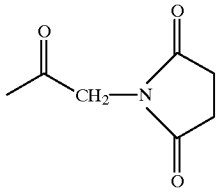 | 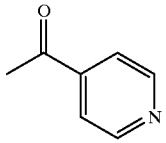 | 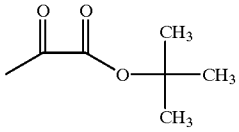 |
| H-98 | 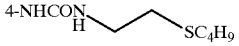 | 98aa | 98ll | 98cc | 98x |

-continued
| | | | | | |
|---|---|---|---|---|---|
| | | 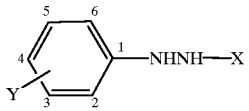 | | | |
| H-99 | 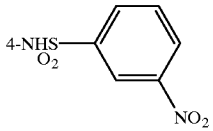 | 99aa | 99ll | 99cc | 99x |

| Y—NH NH—X | | | | | |
|---|---|---|---|---|---|
| | X = | | | | |
| | Y = | 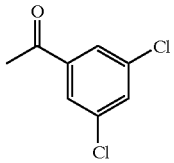 | 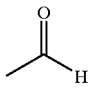 | 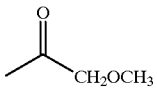 | 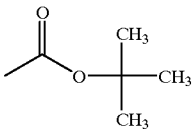 |
| H-100 | 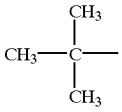 | 100mm | 100a | 100m | 100z |
| H-101 | 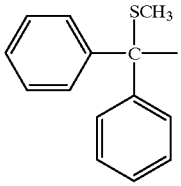 | 101mm | 101a | 101m | 101z |
| H-102 | 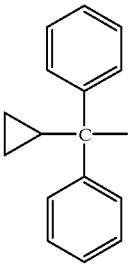 | 102mm | 102a | 102m | 102z |
| H-103 | 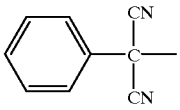 | 103mm | 103a | 103m | 103z |
| H-104 | 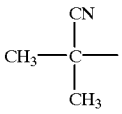 | 104mm | 104a | 104m | 104z |
| H-105 | 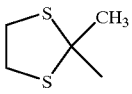 | 105mm | 105a | 195m | 105z |

| | Y—NH NH—X | | | | |
|---|---|---|---|---|---|
| | | X = | | | |
| | Y = | 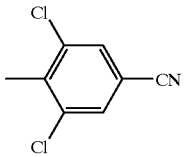 | 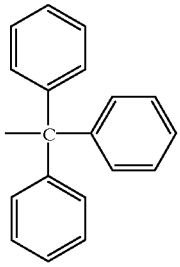 | 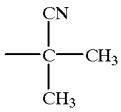 | 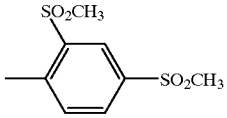 |
| H-106 | 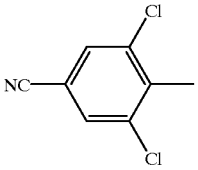 | 106nn | 106pp | 106qq | 106rr |
| H-107 | 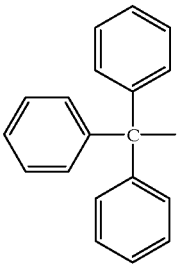 | 107nn | 107pp | 107qq | 107rr |
| H-108 | 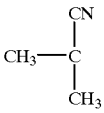 | 108nn | 108pp | 108qq | 108rr |
| H-109 | 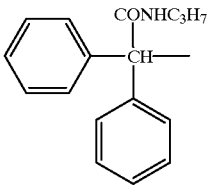 | 109nn | 109pp | 109qq | 109rr |
| H-110 | 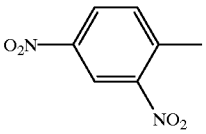 | 110nn | 110pp | 110qq | 110rr |
| H-111 | 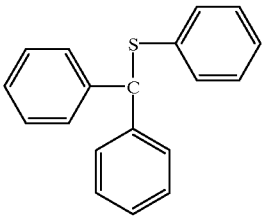 | 111nn | 111pp | 111qq | 111rr |

-continued
Y—NH NH—X
X =
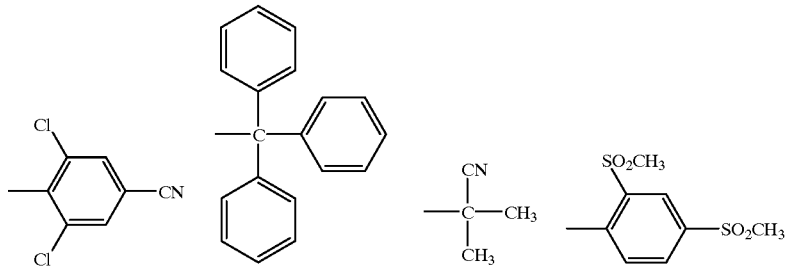
Y =
H-112
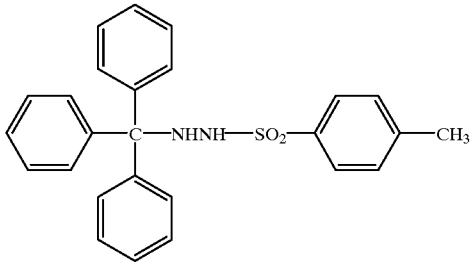
H-113
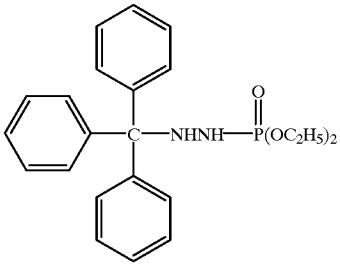
H-114
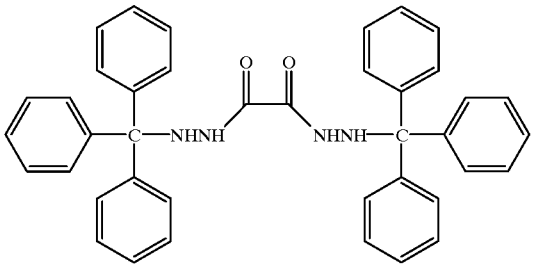
H-115
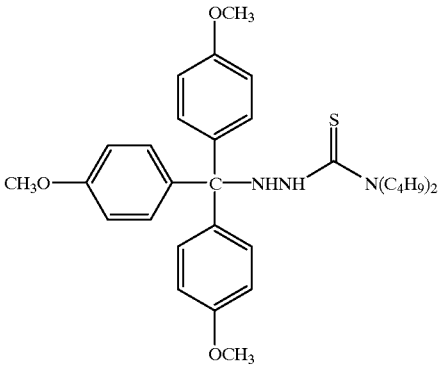

-continued

Y—NH NH—X

X =

Y =

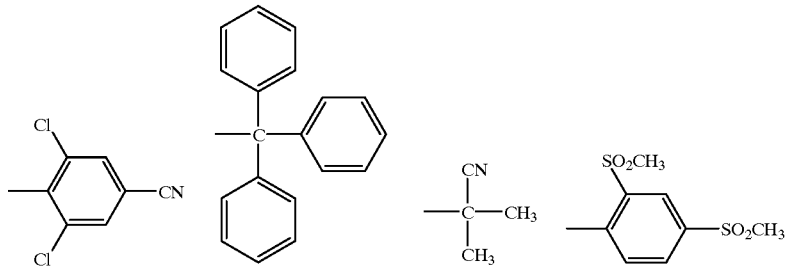

H-116

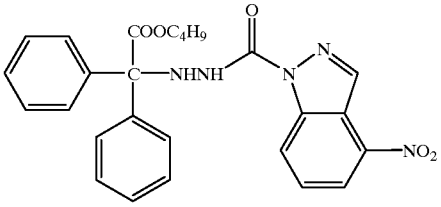

H-117

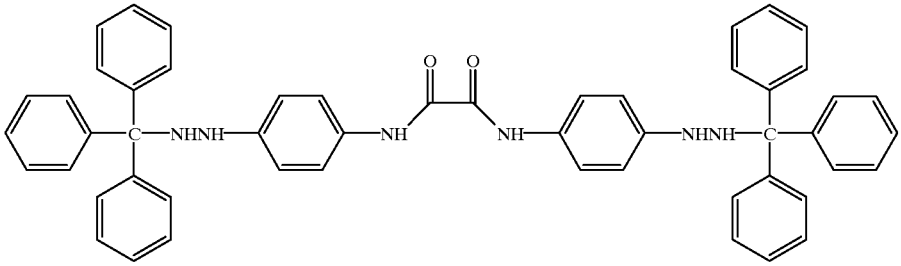

H-118

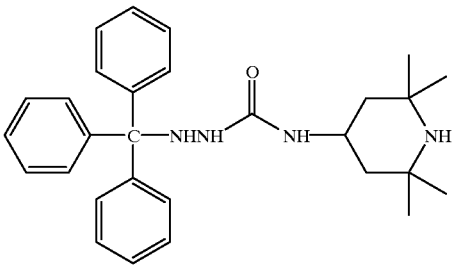

As the hydrazine derivative used herein, any of the hydrazine derivatives described in the following patents may be used in combination with the above-defined hydrazine derivative of the invention. Understandably, the hydrazine derivatives of the invention can be readily synthesized by any of the methods described in the following patents.

Additional useful hydrazine derivatives include the compounds of the chemical formula [1] in JP-B 77138/1994, more specifically the compounds described on pages 3 and 4 of the same; the compounds of the general formula (1) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (I) in JP-A 5610/1995, more specifically compounds I-1 to I-38 described on pages 5 to 10 of the same; the compounds of the general formula (II) in JP-A 77783/1995, more specifically compounds II-1 to II-102 described on pages 10 to 27 of the same; the compounds of the genera; formulae (H) and (Ha) in JP-A 104426/1995, more specifically compounds H-1 to H-44 described on pages 8 to 15 of the same; the compounds having an anionic group in proximity to a hydrazine group or a nonionic group forming an intermolecular hydrogen bond with the hydrogen atom of hydrazine in Japanese Patent Application No. 191007/1995, specifically the compounds of general formulae (A), (B), (C), (D), (E) and (F), more specifically compounds N-1 to N-30; and the compounds of the general formula (1) in Japanese Patent Application No. 191007/1995, more specifically compounds D-1 to D-55.

Also useful are various hydrazine derivatives as described in "Known Technology," pages 25–34, Aztek K.K., Mar. 22, 1991, and compounds D-2 and D-39 described in JP-B 86354/1987, pages 6 to 7.

In the practice of the invention, the hydrazine nucleating agent may be used after it is dissolved in a suitable water-miscible organic solvent, for example, alcohols (e.g., methanol, ethanol, propanol and fluorinated alcohols), ketones (e.g., acetone and methyl ethyl ketone), dimethylformamide, dimethylsulfoxide, and methyl cellosolve.

Also, a well-known emulsifying dispersion method is used for dissolving the hydrazine nucleating agent with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the hydrazine derivative in powder form in water in a ball mill, colloidal mill or ultrasonic mixer.

The hydrazine nucleating agent according to the invention may be added to an image forming layer on a support or another binder layer on the same side as the image forming layer, preferably the image forming layer or a binder layer disposed adjacent thereto.

The hydrazine nucleating agent is preferably used in an amount of $1\times10^{-6}$ mol to $1\times10^{-2}$ mol, more preferably $1\times10^{-5}$ mol to $5\times10^{-3}$ mol, most preferably $2\times10^{-5}$ to $5\times10^{-3}$ mol per mol of silver halide.

Squarylium Dye

According to the invention, the photothermographic material further contains at least one of squarylium dyes or the general formulae (I) to (V).

General formula (I):

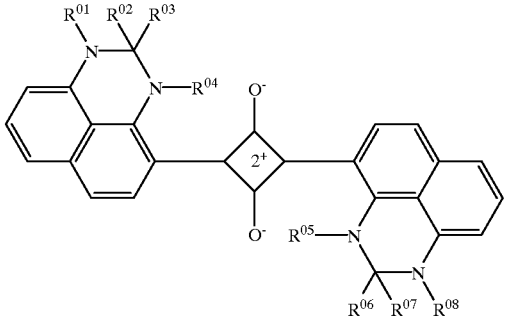

General formula (II):

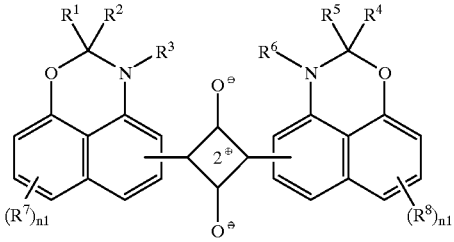

-continued

General formula (III):

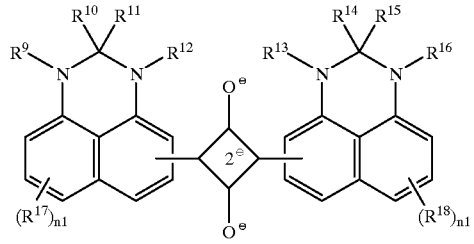

General formula (IV):

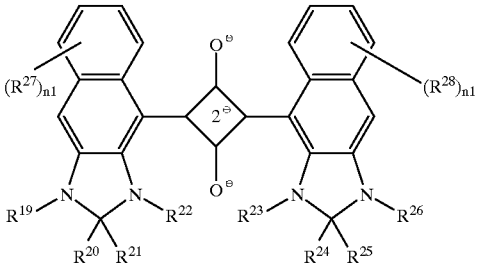

General formula (V):

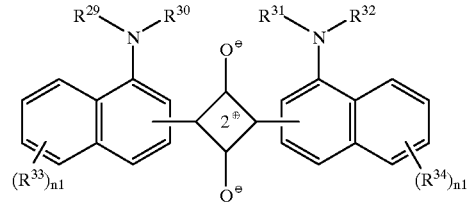

First the hydroperimidine squarylium dyes of the general formula (I) is described.

In formula (I), each of $R^{01}$, $R^{02}$, $R^{03}$, $R^{04}$, $R^{05}$, $R^{06}$, $R^{07}$, and $R^{08}$ is hydrogen or an alkyl, cycloalkyl or aryl group. $R^{01}$ and $R^{02}$, and/or $R^{03}$ and $R^{04}$, and/or $R^{05}$ and $R^{06}$, and/or $R^{07}$ and $R^{08}$, or $R^{02}$ and $R^{03}$, and/or $R^{06}$ and $R^{07}$, taken together, may form a 5- or 6-membered ring.

The alkyl groups represented by $R^{01}$ to $R^{08}$ in formula (I) are generally those having 1 to 20 carbon atoms, preferably 1 to 12 carbon atoms, such as methyl, ethyl, propyl, butyl, hexyl, and undecyl. They may have substituted thereon a halogen atom (e.g., F, Cl and Br), alkoxycarbonyl (e.g., methoxycarbonyl and ethoxycarbonyl), hydroxy, alkoxy (e.g., methoxy, ethoxy, phenoxy, and isobutoxy), or acyloxy (e.g., acetyloxy, butylyloxy, hexylyloxy and benzoyloxy) group. The cycloalkyl groups represented by $R^{01}$ to $R^{08}$ include cyclopentyl and cyclohexyl groups. The aryl groups represented by $R^{01}$ to $R^{08}$ are preferably those having 6 to 12 carbon atoms and include phenyl and naphthyl groups. The aryl groups may be substituted ones wherein the substituent includes alkyl groups having 1 to 8 carbon atoms (e.g., methyl, ethyl, propyl, and butyl), alkoxy groups having 1 to 6 carbon atoms (e.g., methoxy and ethoxy), aryloxy (e.g., phenoxy and p-chlorophenoxy), halogen atoms (e.g., F, Cl, and Br), alkoxycarbonyl (e.g., methoxycarbonyl and ethoxycarbonyl), cyano, nitro and carboxyl groups.

Preferably, $R^{01}$, $R^{04}$, $R^{05}$ and $R^{08}$ are hydrogen.

In formula (II), each of $R^1$, $R^2$, $R^3$, $R^4$, $R^5$, and $R^6$ is hydrogen or an alkyl, cycloalkyl, aryl, heterocyclic or aralkyl group. $R^1$ and $R^2$, and/or $R^4$ and $R^5$, taken together, may form a 5- or 6-membered ring.

The alkyl groups represented by $R^1$ to $R^6$ in formula (II) are generally those having 1 to 20 carbon atoms, preferably 1 to 12 carbon atoms, such as methyl, ethyl, propyl, butyl, hexyl, and undecyl. They may have substituted thereon a halogen atom (e.g., F. Cl and Br), alkoxycarbonyl (e.g., methoxycarbonyl and ethoxycarbonyl), hydroxy, alkoxy (e.g., methoxy, ethoxy, phenoxy, and isobutoxy), or acyloxy (e.g., acetyloxy, butylyloxy, hexylyloxy and benzoyloxy) group. The cycloalkyl groups represented by $R^1$ to $R^6$ include cyclopentyl and cyclohexyl groups. The aryl groups represented by $R^1$ to $R^6$ are preferably those having 6 to 12 carbon atoms and include phenyl and naphthyl groups. The aryl groups may be substituted ones wherein the substituent includes alkyl groups having 1 to 8 carbon atoms (e.g., methyl, ethyl, propyl, and butyl), alkoxy groups having 1 to 6 carbon atoms (e.g., methoxy and ethoxy), aryloxy (e.g., phenoxy and p-chlorophenoxy), halogen atoms (e.g., F. Cl, and Br), alkoxycarbonyl (e.g., methoxycarbonyl and ethoxycarbonyl), amino (e.g., methylamino, acetylamino, and methanesulfonamide), cyano, nitro and carboxyl groups. The aralkyl groups represented by $R^1$ to $R^6$ are preferably those having 7 to 12 carbon atoms (e.g., benzyl and phenylethyl), which may have a substituent such as methyl, methoxy and chlorine atom. The heterocyclic groups represented by $R^1$ to $R^6$ include thienyl, furyl, pyrrolyl, pyrazolyl, pyridyl, and indolyl.

Each of $R^7$ and $R^8$ is hydrogen or a monovalent substituent group which is as exemplified above for the substituent on the aryl group.

$R^1$ and $R^2$ and/or $R^4$ and $R^5$, taken together, may form a cyclopentane or cyclohexane ring, for example.

The squarine ring is generally attached at the ortho-position relative to the amino group, but can be at the para-position as the case may be. The ortho-position is preferred.

In formula (III), each of $R^9$, $R^{12}$, $R^{13}$ and $R^{16}$ is hydrogen or an alkyl group, each of $R^{10}$, $R^{11}$, $R^{14}$, and $R^{15}$ is hydrogen or an alkyl, cycloalkyl, aryl, aralkyl or heterocyclic group. The alkyl groups represented by $R^9$ to $R^{16}$ are as defined for the alkyl groups in formula (II). The cycloalkyl, aryl, aralkyl and heterocyclic groups represented by $R^{10}$, $R^{11}$, $R^{14}$, and $R^{15}$ are as defined for the cycloalkyl, aryl, aralkyl and heterocyclic groups in formula (II), respectively. $R^9$ and $R^{10}$, and/or $R^{11}$ and $R^{12}$, and/or $R^{13}$ and $R^{14}$, and/or $R^{15}$ and $R^{16}$, or $R^{10}$ and $R^{11}$, and/or $R^{14}$ and $R^{15}$, taken together, may form a cyclopentane or cyclohexane ring, for example. The monovalent substituent group represented by $R^{17}$ and $R^{18}$ are as defined for the monovalent substituent in formula (II).

The squarine ring is generally attached at the ortho-position relative to the amino group, but can be at the para-position as the case may be. The ortho-position is preferred.

In formula (IV), each of $R^{19}$, $R^{20}$, $R^{21}$, $R^{22}$, $R^{23}$, $R^{24}$, $R^{25}$, and $R^{26}$ is hydrogen or an alkyl, cycloalkyl, aryl, aralkyl or heterocyclic group. The alkyl, cycloalkyl, aryl, aralkyl and heterocyclic groups represented by $R^{19}$ to $R^{26}$ are as defined for the alkyl, cycloalkyl, aryl, aralkyl and heterocyclic groups in formula (II), respectively. $R^{19}$ and $R^{20}$, and/or $R^{21}$ and $R^{22}$, and/or $R^{23}$ and $R^{24}$, and/or $R^{25}$ and $R^{26}$, or $R^{20}$ and $R^{21}$, and/or $R^{24}$ and $R^{25}$, taken together, may form a cyclopentane or cyclohexane ring. The monovalent substituent group represented by $R^{27}$ and $R^{28}$ are as defined for the monovalent substituent in formula (II).

In formula (V), each of $R^{29}$, $R^{30}$, $R^{31}$, and $R^{32}$ is hydrogen or an alkyl, cycloalkyl, aryl, aralkyl or heterocyclic group. The alkyl, cycloalkyl, aryl, aralkyl and heterocyclic groups represented by $R^{29}$ to $R^{32}$ are as defined for the alkyl, cycloalkyl, aryl, aralkyl and heterocyclic groups in formula (II), respectively. The monovalent substituent group represented by $R^{33}$ and $R^{34}$ are as defined for the monovalent substituent in formula (II).

The squarine ring is generally attached at the ortho-position relative to the amino group, but can be at the para-position as the case may be. The ortho-position is preferred.

Illustrative, non-limiting examples of the squarylium dye are given below.

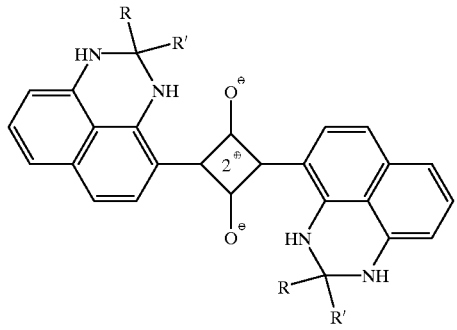

| Compound | R | R' |
|---|---|---|
| 1 | $CH_3$ | n-$C_{11}H_{23}$ |
| 2 | $C_2H_5$ | $C_2H_5$ |
| 3 | $C_3H_7$ | $C_3H_7$ |
| 4 | $C_4H_9$ | $C_4H_9$ |
| 5 | $C_5H_{11}$ | $C_5H_{11}$ |
| 6 | R and R' together form | 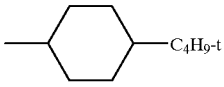 |

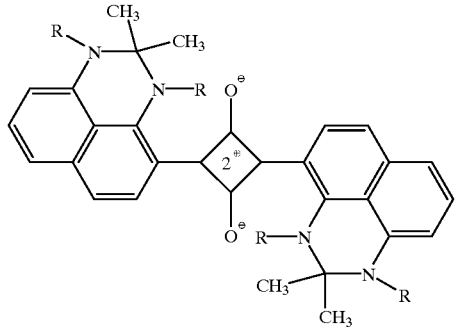

| Compound | R |
|---|---|
| 7 | $CH_3$ |
| 8 | $C_3H_7$ |

-continued
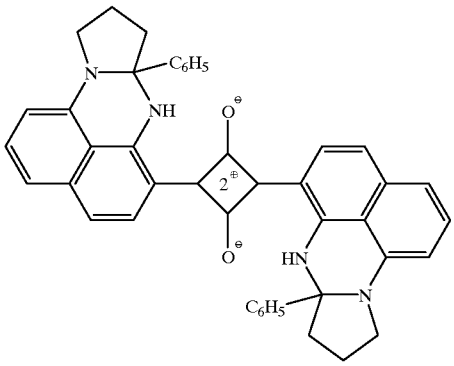
-continued
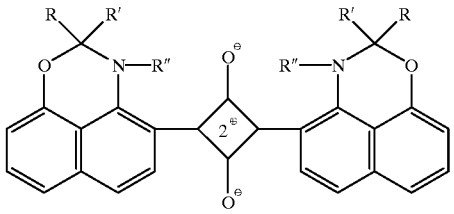
| Compound | R | R' | R" |
|---|---|---|---|
| 10 | $CH_3$ | $CH_3$ | H |
| 11 | $C_5H_{11}$ | $C_5H_{11}$ | H |
| 12 | $CH_3$ | n-$C_{11}H_{23}$ | H |
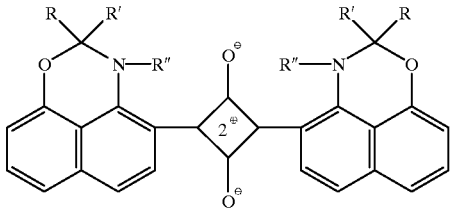
| Compound | R | R' | R" |
|---|---|---|---|
| 13 | R and R' together form | 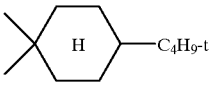 | H |
| 14 | $CH_3$ | 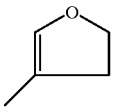 | H |
| 15 | $CH_3$ | $C_6H_5$ | H |
| 16 | $CH_3$ | $C_{11}H_{23}$ | $CH_3$ |
| 17 | $CH_3$ | 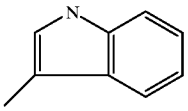 | H |
| 18 | $CH_3$ | 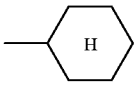 | H |
| Compound | R | R' |
|---|---|---|
| 19 | 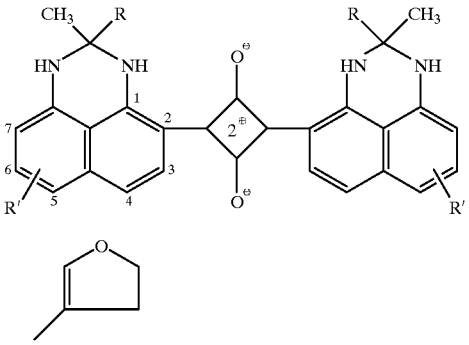 | H |

-continued

| Compound | R | R' |
|---|---|---|
| 20 | 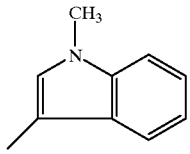 | H |
| 21 | 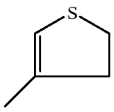 | H |
| 22 | $C_{11}H_{23}$ | 4-$NHCOCH_3$ |
| 23 | $C_{11}H_{23}$ | 4-$NHSO_2CH_3$ |
| 24 | $C_{11}H_{23}$ | 5-$NHCOCH_3$ |
| | 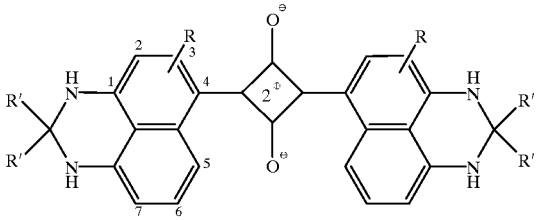 | |
| 25 | 2,7-di-$OCH_3$ | $C_5H_{11}$ |
| 26 | 2,7-di-$OC_4H_9$ | $C_5H_{11}$ |
| 27 | 2,7-di-$OC_4H_9$ | R and R' together form 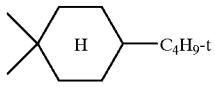 |
| 28 | 2,6-di-$CH_3$ | $C_5H_{11}$ |

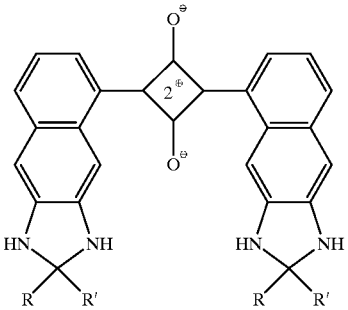

| Compound | R | R' |
|---|---|---|
| 29 | $CH_3$ | $C_{11}H_{23}$ |
| 30 | R and R' together form | 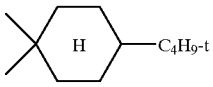 |
| 31 | $C_2H_5$ | $C_{13}H_{27}$ |

-continued

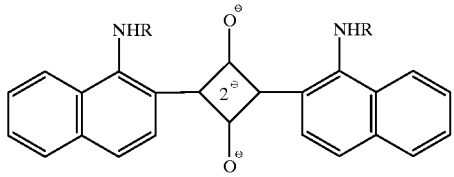

| Compound | R |
|---|---|
| 32 | $C_2H_5$ |
| 33 | $C_4H_9$ |
| 34 | $C_8H_{17}$ |

The squarylium dyes according to the invention may be synthesized in accordance with the following synthesis examples or as taught by U.S. Pat. No. 5,380,635 and Japanese Patent Application No. 189817/1996.

Synthesis Example 1: Synthesis of Compound 2

A mixture of 1.58 g of 1,8-diaminonaphthalene, 10.8 g of diethyl ketone, and 25 mg of p-toluenesulfonic acid monohydrate was heated and stirred for 5 hours in a steam bath and extracted with 100 ml of ethyl acetate and 50 ml of saturated sodium bicarbonate water. The solvent was distilled off, yielding 20 g of 2,2-diethyl-2,3-dihydroperimidine.

A mixture of 5.4 g of the 2,2-diethyl-2,3-dihydroperimidine prepared above, 1.14 g of squaric acid, 50 ml of n-butyl alcohol, and 50 ml of toluene was heated for 5 hours at an external temperature of 130° C. With 20 ml of methyl alcohol added, the precipitated crystals were filtered out. Compound 2 was then isolated by column chromatography using silica gel and chloroform.

Yield 1.2 g

λmax 808.2 nm (acetone)

$\epsilon$ $1.68\times10^5$ $M^{-1}.cm^{-1}$

A single crystal was prepared from the resulting product using tetrahydrofuran. The single crystal was subject to X-ray crystallographic analysis by means of automatic 4-axis diffractometer AFC-5R using CuKα ray (λ=1.5418 Å) as a radiation source. It was found that squaric acid was attached to 2,2-diethyl-2,3-dihydroperimidine at the ortho-position.

Synthesis Example 2

Compounds 1 and 3 to 9 which are exemplary of the compound of formula (I) were synthesized as in Synthesis Example 1.

The compounds synthesized in Synthesis Examples 1 and 2 were measured for maximum absorption wavelength (λmax) and melting point, which are reported in Table 25.

TABLE 25

| Compound | λmax (acetone) | m. p. (° C.) |
|---|---|---|
| 1 | 808.2 nm | 155–160° C. |
| 2 | 808.2 nm | 262–265° C. |
| 3 | 808.5 nm | |
| 4 | 809.0 nm | |
| 5 | 809.0 nm | |
| 6 | 812.2 nm | >300° C. |
| 7 | 755.0 nm | >300° C. |
| 8 | 810.8 nm | >300° C. |
| 9 | 826.0 nm | |

Synthesis Example 3: Synthesis of Compound 11

To 6.3 g of 8-amino-1-naphthol and 20 ml of ethyl alcohol was added 8.1 g of 5-undecane. The mixture was subject to dry distillation for 9 hours. With 15 g of 5-undecanone added, dry distillation was effected for a further 3 hours. The reaction product was concentrated and purified by column chromatography using silica gel and a n-hexane/ethyl acetate (1/5) mixture, obtaining 2.6 g of naphthoxadinine.

A mixture of 2.6 g of the naphthoxadinine prepared above, 0.5 g of 3,4-dihydroxy-3-cyclobutene-1,2-dione, 30 ml of n-butanol, and 30 ml of toluene was heated for 3 hours at an external temperature of 140° C. while the water being formed was driven off. The reaction product was concentrated and purified by column chromatography using silica gel and chloroform, obtaining 0.6 g of Compound 11.

λmax 781.3 nm ($CHCl_3$)

$\epsilon$ $1.69\times10^5$ $M^{-1}.cm^{-1}$ m.p. 193–195° C.

Other compounds could be similarly synthesized.

The dye according to the invention may be added to any layer of the photosensitive material. For example, for the anti-halation purpose, the dye according to the invention may be added to a layer below the emulsion layer or a layer on the back side of the support. For the anti-irradiation purpose, the dye may be added to the silver halide emulsion layer. As a filter dye, the dye may be added to an intermediate layer (for example, an intermediate layer between emulsion layers sensitive to different colors and an intermediate layer between emulsion layers sensitive to substantially identical color) or a protective layer.

The dye according to the invention is not only useful as the anti-halation and anti-irradiation dyes in recording materials, typically photographic silver halide photosensitive materials and photothermographic materials, but is also useful in recording materials adapted to be recorded with near infrared light, especially laser diodes, and as near infrared filters and photo-thermal conversion dyes.

Preferably, the dye according to the invention is added after it is dissolved in organic solvents including ketones (e.g., acetone, methyl ethyl ketone and cyclohexanone), halogenated solvents (e.g., methylene chloride and chloroform), dimethylformamide, and dimethylsulfoxide. The preferred amount of the dye added is 0.1 to 20% by weight of the organic solvent.

The dye is preferably added to the photosensitive material in a coverage of 0.1 to 1,000 $mg/m^2$, more preferably 1 to 200 $mg/m^2$.

Where a binder is used, the amount of the dye is generally 0.1 to 60%, preferably 0.2 to 30%, more preferably 0.5 to 10% by weight of the binder.

For infrared laser diodes (780 and 830 nm), the dye is added so as to provide an absorbance of more than 0.2, preferably at least 0.6 at an exposure wavelength in the range of 750 to 1,500 nm. Furthermore, the dyes may be used alone or in admixture of two or more. Further preferably, the dye provides an absorbance of less than 0.5, especially 0.1 or less in the visible region (300 to 700 nm) after heat development.

Next, the organic silver salt, silver halide and reducing agent used in the photographic photothermographic material of the invention are described.

Organic Silver Salt

The organic silver salt used herein is relatively stable to light, but forms a silver image when heated at 80° C. or higher in the presence of an exposed photocatalyst (as typified by a latent image of photosensitive silver halide) and a reducing agent. The organic silver salt may be of any desired organic compound containing a source capable of reducing silver ion. Preferred are silver salts of organic acids, typically long chain aliphatic carboxylic acids having 10 to 30 carbon atoms, especially 15 to 28 carbon atoms. Also preferred are complexes of organic or inorganic silver salts with ligands having a stability constant in the range of 4.0 to 10.0. A silver-providing substance is preferably used in an amount of about 5 to 30% by weight of an image forming layer. Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver stearate, silver oleate, silver laurate, silver caproate, silver myristate, silver palmitate, silver maleate, silver fumarate, silver tartrate, silver linolate, silver butyrate, silver camphorate and mixtures thereof. The organic silver salt is preferably used-in such amounts to give a coverage of up to 3 $g/m^2$, especially up to 2 $g/m^2$ of silver.

Silver salts of compounds having a mercapto or thion group and derivatives thereof are also useful. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido) benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercaptotriazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thion compounds such as a silver salt of 3-(3-carboxyethyl)-4-methyl-4-thiazoline-2-thione as described in U.S. Pat. No. 3,301,678. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The organic silver salt which can be used herein may take any desired shape although needle crystals having a minor axis and a major axis are preferred. The inverse proportional relationship between the size of silver salt crystal grains and their covering power that is well known for photosensitive silver halide materials also applies to the photothermographic material of the present invention. That is, as organic silver salt grains constituting image forming regions of photothermographic material increase in size, the covering power becomes smaller and the image density becomes lower. It is thus necessary to reduce the grain size. In the practice of the invention, grains should preferably have a minor axis of 0.01 μm to 0.20 μm, more preferably 0.01 μm to 0.15 μm and a major axis of 0.10 μm to 5.0 μm, more preferably 0.10 μm to 4.0 μm. The grain size distribution is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of organic silver salt grains using an image obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the autocorrelation function of the fluctuation of scattering light relative to a time change, and obtaining the grain size (volume weighed mean diameter) therefrom.

Silver Halide

A method for forming a photosensitive silver halide is well known in the art. Any of the methods disclosed in Research Disclosure No. 17029 (June 1978) and U.S. Pat. No. 3,700,458, for example, may be used. Illustrative methods which can be used herein are a method of preparing an organic silver salt and adding a halogen-containing compound to the organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention. The photosensitive silver halide should preferably have a smaller grain size for the purpose of minimizing white turbidity after image formation. Specifically, the grain size is preferably up to 0.25 μm, more preferably 0.01 μm to 0.20 μm, most preferably 0.02 μm to 0.15 μm. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the face indices (Miller indices) of an outer surface of silver halide grains. Preferably silver halide grains have a high proportion of {100} face featuring high spectral sensitization efficiency upon adsorption of a spectral sensitizing dye. The proportion of {100} face is preferably at least 50%, more preferably at least 65%, most preferably at least 80%. Note that the proportion of Miller index {100} face can be determined by the method described in T. Tani, J. Imaging Sci., 29, 165 (1985), utilizing the adsorption dependency of {111} face and {100} face upon adsorption of a sensitizing dye.

The halogen composition of photosensitive silver halide is not critical and may be any of silver chloride, silver chlorobromide, silver bromide, silver iodobromide, silver iodochlorobromide, and silver iodide. Silver bromide or silver iodobromide is preferred in the practice of the invention. Most preferred is silver iodobromide preferably having a silver iodide content of 0.1 to 40 mol %, especially 0.1 to 20 mol %. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, iridium, ruthenium, rhenium, osmium, cobalt, and iron. The metal complexes may be used alone or in admixture of two or more complexes of a common metal or different metals. The metal complex is preferably contained in an amount of $1\times10^{-9}$ to $1\times10^{-2}$ mol, more preferably $1\times10^{-9}$ to $1\times10^{-3}$ mol per mol of silver. Illustrative metal complex structures are those described in JP-A 225449/1995.

The rhodium compounds used herein are preferably water-soluble rhodium compounds. Examples include rhodium(III) halides and rhodium complex salts having halogens, amines and oxalates as a ligand, for example, hexachlororhodium (III) complex salt, hexabromorhodium (III) complex salt, hexaminerhodium(III) complex salt, and trizalatorhodium(III) complex salt. These rhodium compounds are used as a solution in water or a suitable solvent. One method often used for stabilizing a solution of a rhodium compound is by adding an aqueous solution of hydrogen halide (e.g., hydrochloric acid, hydrobromic acid, and hydrofluoric acid) or an alkali halide (e.g., KCl, NaCl, KBr, and NaBr). Instead of using water-soluble rhodium compounds, a rhodium compound can be dissolved during preparation of silver halide by adding separate silver halide grains doped with rhodium thereto. The iridium compounds used herein include hexachloroiridium, hexabromoiridium, and hexamineiridium. The ruthenium compounds used herein include hexachlororuthenium and pentachloronitrosilruthenium. The cobalt and iron compounds are preferably hexacyano metal complexes while illustrative, non-limiting examples include a ferricyanate ion, ferrocyanate ion, and hexacyanocobaltate ion. The distribution of the metal complex in silver halide grains is not critical. That is, the metal complex may be contained in silver halide grains to form a uniform phase or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized. Preferred chemical sensitization methods are sulfur, selenium, and tellurium sensitization methods which are well known in the art. Also useful are a noble metal sensitization method using compounds of gold, platinum, palladium, and iridium and a reduction sensitization method. In the sulfur, selenium, and tellurium sensitization methods, any of compounds well known for the purpose may be used. For example, the compounds described in JP-A 128768/1995 are useful. Exemplary tellurium sensitizing agents include diacyltellurides, bis(oxycarbonyl)tellurides, bis(carbamoyl) tellurides, bis(oxycarbonyl)ditellurides, bis(carbamoyl) ditellurides, compounds having a P—Te bond, tellurocarboxylic salts, Te-organyltellurocarboxylic esters, di(poly) tellurides, tellurides, telluroles, telluroacetals, tellurosulfonates, compounds having a P—Te bond, Te-containing heterocycles, tellurocarbonyl compounds, inorganic tellurium compounds, and colloidal tellurium. The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and UKP 618,061. Illustrative examples of the compound used in the reduction sensitization method include ascorbic acid, thiourea dioxide, stannous chloride, aminoiminomethanesulfinic acid, hydrazine derivatives, boran compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibratory mill or homogenizer or a method of preparing an organic silver salt by adding the already prepared photosensitive silver halide at any timing during preparation of an organic silver salt. Any desired mixing method may be used insofar as the benefits of the invention are fully achievable.

Though not necessary in the practice of the invention, it is sometimes advantageous to add a mercury(II) salt to the emulsion layer as an antifoggant. The mercury(II) salts useful to this end are mercury acetate and mercury bromide.

Reducing Agent

The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 1 to 10% by weight of an image forming layer. In a multilayer embodiment wherein the reducing agent is added to a layer other than an emulsion layer, the reducing agent should preferably be contained in a slightly greater amount of about 2 to 15% by weight of that layer.

For photothermographic materials using organic silver salts, a wide range of reducing agents are disclosed. Exemplary reducing agents include amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2'-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,2'-dihydroxy-1,1'-binaphthyl, and bis(2-hydroxy-1-naphthyl)methane; combinations of bis-β-naphthols with 1,3-dihydroxybenzene derivatives such as 2,4-dihydroxybenzophenone and 2',4'-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidophenol and p-benzenesulfonamidophenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl) methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)propane; ascorbic acid derivatives such as 1-ascorbyl palmitate and ascorbyl stearate; aldehydes and ketones such as benzil and diacetyl; 3-pyrazolidones and certain indane-1,3-diones.

Especially preferred reducing agents used herein are those compounds of the following formulae (R-I), (R-II), (R-III), and (R-IV).

(R-I)

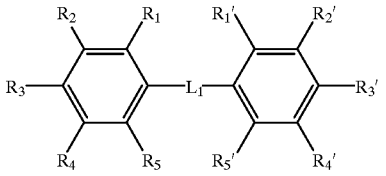

(R-II)

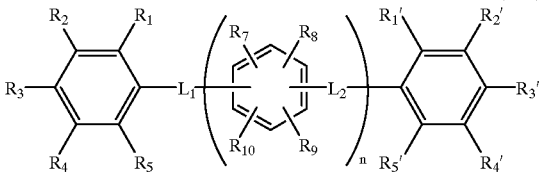

(R-III)

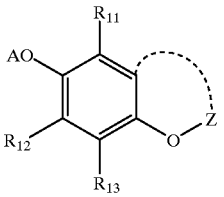

(R-IV)

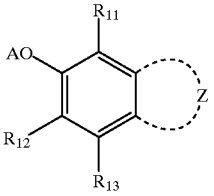

In formula (R-III), Z forms a cyclic structure represented by the following formula (Z-1) or (Z-2).

(Z-1)

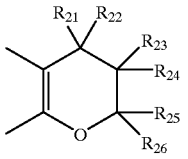

or (Z-2)

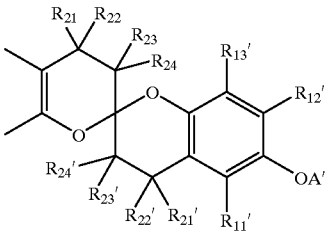

In formula (R-IV), Z forms a cyclic structure presented by the following formula (Z-3) or (Z-4).

(Z-3)

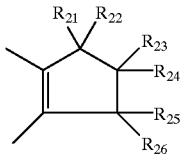

or (Z-4)

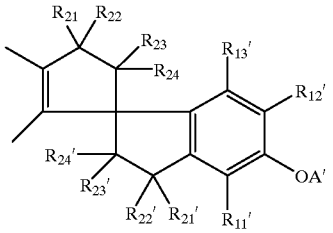

In formulae (R-I) and (R-II), each of $L_1$ and $L_2$ is a group —CH($R_6$)— or —CH($R_6$')— or a sulfur atom, and n is a natural number.

Herein, R is used as a representative of $R_1$ to $R_{10}$, $R_1$' to $R_5$', $R_6$', $R_{11}$ to $R_{13}$, $R_{11}$' to $R_{13}$', $R_{21}$ to $R_{26}$, and $R_{21}$' to $R_{24}$'. R is a hydrogen atom, alkyl group having 1 to 30 carbon atoms, aryl group, aralkyl group, halogen atom, amino group or a substituent represented by —O—A, with the proviso that at least one of $R_1$ to $R_5$, at least one of $R_1$' to $R_5$', and at least one of $R_7$ to $R_{10}$ each are a group represented by —O—A. Alternatively, R groups, taken together, may form a ring. A and A' each are a hydrogen atom, alkyl group having 1 to 30 carbon atoms, acyl group having 1 to 30 carbon atoms, aryl group, phosphate group or sulfonyl group. R, A and A' may be substituted groups while typical examples of the substituent include an alkyl group (inclusive of active methine groups), nitro group, alkenyl group, alkynyl group, aryl group, heterocycle-containing group, group containing a quaternized nitrogen atom-containing heterocycle (e.g., pyridinio group), hydroxyl group, alkoxy group (inclusive of a group containing recurring ethyleneoxy or propyleneoxy units), aryloxy group, acyloxy group, acyl group, alkoxycarbonyl group, aryloxycarbonyl group, carbamoyl group, urethane group, carboxyl group, imide group, amino group, carbonamide group, sulfonamide group, ureido group, thioureido group, sulfamoylamino group, semicarbazide group, thiosemicarbazide group, hydrazino-containing group, quaternary ammonio-containing group, mercapto group, (alkyl, aryl or heterocyclic) thio group, (alkyl or aryl)sulfonyl group, (alkyl or aryl)sulfinyl group, sulfo group, sulfamoyl group, acylsulfamoyl group, (alkyl or aryl)sulfonylureido group, (alkyl or aryl)sulfonylcarbamoyl group, halogen atom, cyano group, phosphoric acid amide group, phosphate structure-containing group, acylurea structure-bearing group, selenium or tellurium atom-containing group, and tertiary or quaternary sulfonium structure-bearing group. The substituent on R, A and A' may be further substituted, with preferred examples of the further substituent being those groups exemplified as the substituent on R. The further substituent, in turn, may be further substituted, the still further substituent, in turn, may be further substituted, and so on. In this way, multiple substitution is acceptable while preferred substituents are those groups exemplified as the substituent on R, A and A'.

Illustrative, non-limiting, examples of the compounds represented by formulae (R-I), (R-II), (R-III) a nd (R-IV) are given below.

TABLE 1

| No. | $R_1$, $R_1$, | $R_2$, $R_2$, | $R_3$, $R_3$, | $R_4$, $R_4$, | $R_5$, $R_5$, | $L_1$ | $R_6$ |
|---|---|---|---|---|---|---|---|
| R-I-1 | —OH | —$CH_3$ | —H | —$CH_3$ | —H | CH-R6 | —H |
| R-I-2 | —OH | —$CH_3$ | —H | —$CH_3$ | —H | CH-R6 | —$CH_3$ |
| R-I-3 | —OH | —$CH_3$ | —H | —$CH_3$ | —H | CH-R6 | —$C_3H_7$ |
| R-I-4 | —OH | —$CH_3$ | —H | —$CH_3$ | —H | CH-R6 | —$C_5H_{11}$ |
| R-I-5 | —OH | —$CH_3$ | —H | —$CH_3$ | —H | CH-R6 | —TMB |
| R-I-6 | —OH | —$CH_3$ | —H | —$CH_3$ | —H | CH-R6 | —$C_9H_{19}$ |
| R-I-7 | —OH | —$CH_3$ | —H | —$CH_3$ | —H | S | — |
| R-I-8 | —OH | —$CH_3$ | —H | —$C_2H_5$ | —H | S | — |
| R-I-9 | —OH | —$CH_3$ | —H | —$C_4H_9$(t) | —H | S | — |
| R-I-10 | —OH | —$C_4H_9$(t) | —H | —$CH_3$ | —H | CH-R6 | —H |
| R-I-11 | —OH | —$C_4H_9$(t) | —H | —$CH_3$ | —H | CH-R6 | —$CH_3$ |
| R-I-12 | —OH | —$C_4H_9$(t) | —H | —$CH_3$ | —H | CH-R6 | —TMB |
| R-I-13 | —OH | —$C_4H_9$(t) | —H | —$C_2H_5$ | —H | CH-R6 | —Ph |
| R-I-14 | —OH | —CHex | —H | —$CH_3$ | —H | S | — |
| R-I-15 | —OH | —$C_4H_9$(t) | —H | —$C_2H_5$ | —H | S | — |
| R-I-16 | —OH | —$C_2H_5$ | —H | —$C_4H_9$(t) | —H | CH-R6 | —H |
| R-I-17 | —OH | —$C_2H_5$ | —H | —$C_4H_9$(t) | —H | CH-R6 | —$CH_3$ |
| R-I-18 | —OH | —$C_2H_5$ | —H | —$C_4H_9$(t) | —H | CH-R6 | —TMB |
| R-I-19 | —OH | —$CH_3$ | —H | —$C_4H_9$(t) | —H | CH-R6 | —Ph |
| R-I-20 | —OH | —$CH_3$ | —Cl | —$C_4H_9$(t) | —H | CH-R6 | —H |
| R-I-21 | —OH | —$CH_3$ | —H | —$C_4H_9$(t) | —$OCH_3$ | CH-R6 | —H |
| R-I-22 | —H | —$C_4H_9$(t) | —OH | —CPen | —H | CH-R6 | —H |
| R-I-23 | —H | —$C_4H_9$(t) | —OH | —$C_4H_9$(t) | —H | CH-R6 | —TMB |
| R-I-24 | —H | —$C_4H_9$(t) | —OH | —H | —H | CH-R6 | —H |
| R-I-25 | —H | —$C_4H_9$(t) | —OH | —H | —H | CH-R6 | —$C_3H_7$ |
| R-I-26 | —H | —$CH_3$ | —OH | —$C_4H_9$(t) | —H | CH-R6 | —TMB |
| R-I-27 | —H | —$C_2H_5$ | —OH | —$C_4H_9$(t) | —H | CH-R6 | —H |
| R-I-28 | —H | —$CH_3$ | —OH | —$C_2H_5$ | —H | CH-R6 | —TMB |
| R-I-29 | —H | —$CH_3$ | —OH | —$CH_3$ | —H | S | — |
| R-I-30 | —H | —$CH_3$ | —OH | —$CH_3$ | —Cl | S | — |
| R-I-31 | —H | —$CH_3$ | —OH | —$C_2H_5$ | —H | S | — |
| R-I-32 | —H | —$C_2H_5$ | —OH | —$C_2H_5$ | —H | S | — |
| R-I-33 | —H | —$C_2H_5$ | —OH | —$CH_3$ | —Cl | S | — |
| R-I-34 | —H | —$CH_3$ | —OH | —$C_4H_9$(t) | —H | S | — |
| R-I-35 | —H | —CHex | —OH | —$C_4H_9$(t) | —H | S | — |

TMB: 1,3,3-trimethylbutyl group —CH(—$CH_3$)—$CH_2$—C(—$CH_3$)$_3$
CPen: cyclopentyl group (R-I)
CHex: cyclohexyl group

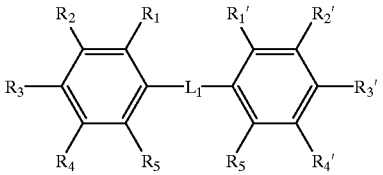

TABLE 2

| No. | $R_1$ | $R_2$ | $R_3$ | $R_4$ | $R_5$ | $R_{1'}$ | $R_{2'}$ | $R_{3'}$ | $R_{4'}$ | $R_{5'}$ | $L_1$ | $R_6$ |
|---|---|---|---|---|---|---|---|---|---|---|---|---|
| R-I-36 | —OH | —$CH_3$ | —H | —$CH_3$ | —H | —H | —$CH_3$ | —OH | —$CH_3$ | —H | CH-R6 | —H |
| R-I-37 | —OH | —$C_4H_9$ (t) | —H | —$CH_3$ | —H | —H | —$CH_3$ | —OH | —$CH_3$ | —H | CH-R6 | —H |
| R-I-38 | —OH | —$CH_3$ | —H | —$CH_3$ | —H | —H | —CHex | —OH | —$CH_3$ | —H | CH-R6 | —$CH_3$ |
| R-I-39 | —OH | —$C_4H_9$ (t) | —H | —$CH_3$ | —H | —H | —$CH_3$ | —OH | —$CH_3$ | —H | CH-R6 | —$CH_3$ |
| R-I-40 | —OH | —$CH_3$ | —H | —$CH_3$ | —H | —H | —$CH_3$ | —OH | —$CH_3$ | —H | CH-R6 | —TMB |
| R-I-41 | —OH | —$C_4H_9$ (t) | —H | —$CH_3$ | —H | —H | —$CH_3$ | —OH | —$CH_3$ | —H | CH-R6 | —TMB |
| R-I-42 | —OH | —$CH_3$ | —H | —$CH_3$ | —H | —H | —$CH_3$ | —OH | —$CH_3$ | —H | S | — |
| R-I-43 | —OH | —$C_4H_9$ (t) | —H | —$CH_3$ | —H | —H | —$CH_3$ | —OH | —$CH_3$ | —H | S | — |
| R-I-44 | —OH | —$CH_3$ | —H | —$CH_3$ | —H | —H | —CHex | —OH | —$CH_3$ | —H | S | — |

CHex: cyclohexyl group
(R-1)

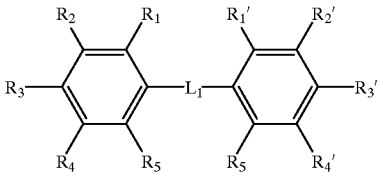

R-I-45
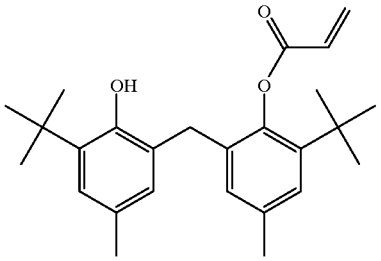
R-I-46
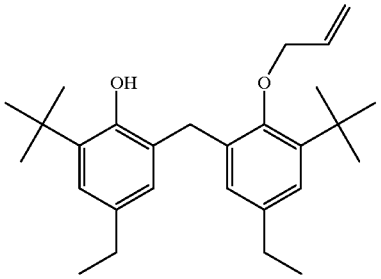
R-I-47
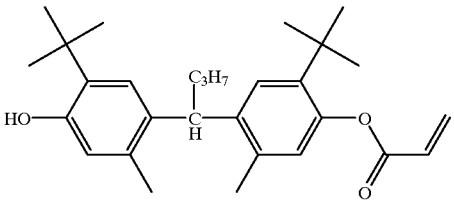
R-I-48
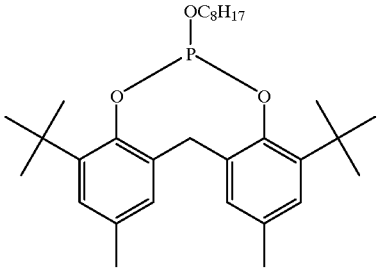
R-I-49
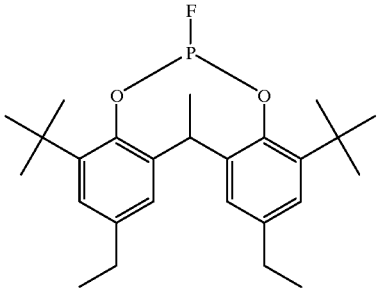
R-I-50
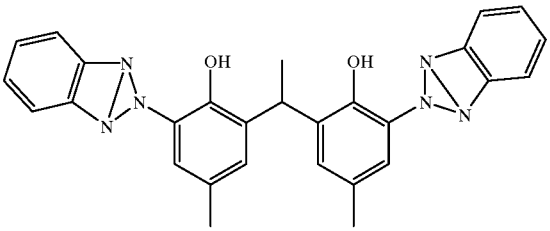
-continued
R-I-51
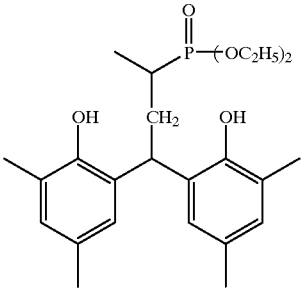
R-I-52
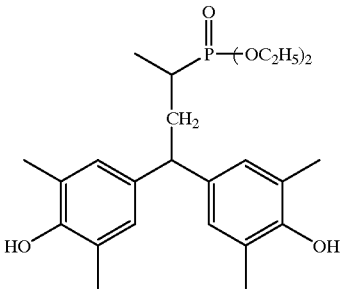
R-I-53
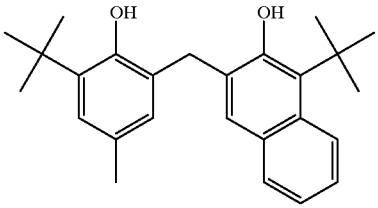
R-I-54
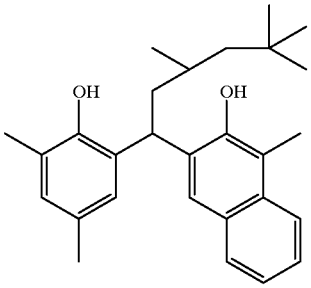
R-I-55
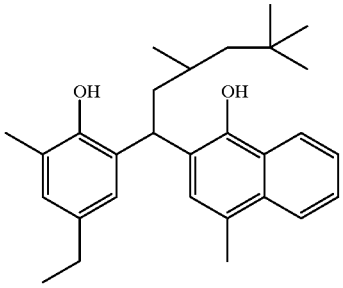

TABLE 3

| No. | $R_1$, $R_{1'}$ | $R_2$, $R_{2'}$ | $R_3$, $R_{3'}$ | $R_4$, $R_{4'}$ | $R_5$, $R_{5'}$ | $R_7$ | $R_8$ | $R_9$ | $R_{10}$ | $L_1$ | $R_6$ | $L_2$ | $R_{6'}$ | n |
|---|---|---|---|---|---|---|---|---|---|---|---|---|---|---|
| R-II-1 | —OH | —$C_4H_9$ (t) | —H | —$CH_3$ | —H | —OH | —$CH_3$ | —$CH_3$ | —H | CH-R6 | —H | CH-R6 | —$CH_3$ | 1 |
| R-II-2 | —OH | —$CH_3$ | —H | —$CH_3$ | —H | —OH | —$C_2H_5$ | —$CH_3$ | —H | CH-R6 | —TMB | CH-R6 | —$CH_3$ | 1 |
| R-II-3 | —OH | —$C_4H_9$ (t) | —H | —$CH_3$ | —H | —OH | —$CH_3$ | —$CH_3$ | —H | CH-R6 | —H | CH-R6 | —TMB | 3 |
| R-II-4 | —OH | —$CH_3$ | —H | —$CH_3$ | —H | —OH | —$C_2H_5$ | —$CH_3$ | —H | CH-R6 | —TMB | CH-R6 | —TMB | 2 |
| R-II-5 | —H | —$C_4H_9$ (t) | —OH | —$CH_3$ | —H | —OH | —$CH_3$ | —$CH_3$ | —H | S | — | CH-R6 | —$CH_3$ | 1 |
| R-II-6 | —H | —$CH_3$ | —OH | —$CH_3$ | —H | —OH | —$C_2H_5$ | —$CH_3$ | —H | S | — | S | — | 1 |
| R-II-7 | —H | —$C_4H_9$ (t) | —OH | —$CH_3$ | —H | —OH | —$CH_3$ | —$CH_3$ | —H | S | — | S | — | 2 |
| R-II-8 | —H | —$CH_3$ | —OH | —$CH_3$ | —H | —OH | —$C_2H_5$ | —$CH_3$ | —H | S | — | CH-R6 | —TMB | 3 |

(R-II)

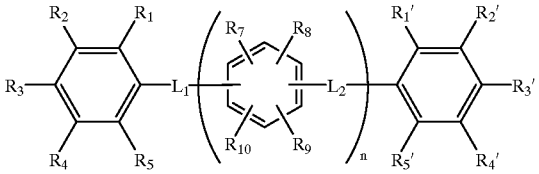

TABLE 4

| No. | Z | $R_{11}$ | $R_{12}$ | $R_{13}$ | $R_{21}$ | $R_{22}$ | $R_{23}$ | $R_{24}$ | $R_{25}$ | $R_{26}$ | A |
|---|---|---|---|---|---|---|---|---|---|---|---|
| R-III-1 | Z-1 | —$CH_3$ | —$CH_3$ | —$CH_3$ | —H | —H | —H | —H | —$CH_3$ | —$C_{16}H_{33}$ | —H |
| R-III-2 | Z-1 | —$CH_3$ | —$CH_3$ | —$CH_3$ | —H | —H | —H | —H | —$CH_3$ | —$C_{16}H_{13}$ | —H |
| R-III-3 | Z-1 | —$CH_3$ | —$C_8H_{17}$ | —H | —H | —$CH_3$ | —H | —H | —$CH_3$ | —$CH_3$ | —H |
| R-III-4 | Z-1 | —H | —$C_8H_{17}$ | —H | —H | —$CH_3$ | —H | —H | —$CH_3$ | —$CH_3$ | —H |
| R-III-5 | Z-1 | —H | —H | —$CH_3$ | —H | —H | —H | —H | —$CH_3$ | —$C_{16}H_{33}$ | —H |
| R-III-6 | Z-1 | —H | —$CH_3$ | —H | —$CH_3$ | —$CH_3$ | —H | —H | —$CH_3$ | —$CH_3$ | —H |
| R-III-7 | Z-1 | —H | —$CH_3$ | —H | —$CH_3$ | —$CH_3$ | —H | —H | —$CH_3$ | —DHP | —H |

DHP: 2,4-dihydroxyphenyl group (R-III)

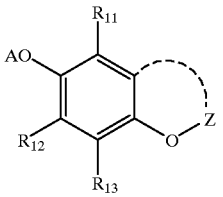

(Z-1)

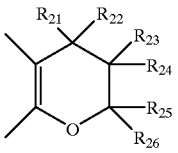

TABLE 5

| No. | Z | $R_{11}$, $R_{11'}$ | $R_{12}$, $R_{12'}$ | $R_{13}$, $R_{13'}$ | $R_{21}$, $R_{22}$ | $R_{21'}$, $R_{22'}$ | $R_{23}$, $R_{24}$ | $R_{23'}$, $R_{24'}$ | A |
|---|---|---|---|---|---|---|---|---|---|
| R-III-8 | Z-2 | —H | —$CH_3$ | —H | —$CH_3$ | —$CH_3$ | —H | —H | —H |
| R-III-9 | Z-2 | —$CH_3$ | —$CH_3$ | —$CH_3$ | —H | —H | —$CH_3$ | —$CH_3$ | —H |
| R-III-10 | Z-2 | —$CH_3$ | —$CH_3$ | —$CH_3$ | —H | —H | —H | —H | —H |
| R-III-11 | Z-2 | —$CH_3$ | —OH | —$CH_3$ | —$CH_3$ | —$CH_3$ | —H | —H | —H |
| R-III-12 | Z-2 | —H | —OH | —$CH_3$ | —$CH_3$ | —$CH_3$ | —H | —H | —H |

TABLE 5-continued
| No. | Z | $R_{11}$, $R_{11'}$ | $R_{12}$, $R_{12'}$ | $R_{13}$, $R_{13'}$ | $R_{21}$, $R_{22}$ | $R_{21'}$, $R_{22'}$ | $R_{23}$, $R_{24}$ | $R_{23'}$, $R_{24'}$ | A |
|---|---|---|---|---|---|---|---|---|---|
(R-III)
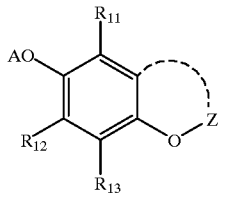
(Z-2)
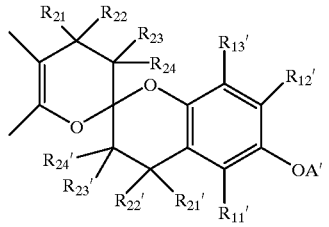
TABLE 6
| No. | Z | $R_{11}$ | $R_{12}$ | $R_{13}$ | $R_{21}$, $R_{22}$ | $R_{23}$, $R_{24}$ | $R_{25}$, $R_{26}$ | A |
|---|---|---|---|---|---|---|---|---|
| R-IV-1 | Z-3 | —H | —OH | —$CH_3$ | —$CH_3$ | —H | —H | —H |
| R-IV-2 | Z-3 | —$CH_3$ | —$CH_3$ | —$CH_3$ | —$CH_3$ | —H | —H | —H |
(R-IV)
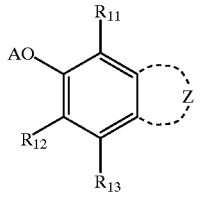
(Z-3)
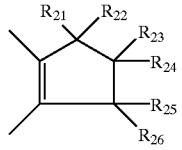
TABLE 7
| No. | Z | $R_{11}$, $R_{11'}$ | $R_{12}$, $R_{12'}$ | $R_{13}$, $R_{13'}$ | $R_{21}$, $R_{21'}$ | $R_{22}$, $R_{22'}$ | $R_{23}$, $R_{24}$ | $R_{23'}$, $R_{24'}$ | A |
|---|---|---|---|---|---|---|---|---|---|
| R-IV-3 | Z-4 | —$CH_3$ | —H | —H | —$CH_3$ | —$CH_3$ | —H | —H | —H |
| R-IV-4 | Z-4 | —$CH_3$ | —$CH_3$ | —H | —$CH_3$ | —$CH_3$ | —H | —H | —H |
| R-IV-5 | Z-4 | —$CH_3$ | —H | —H | —$C_2H_5$ | —$CH_3$ | —H | —H | —H |
(R-IV)
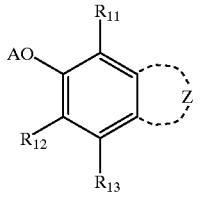

TABLE 7-continued

| No. | Z | $R_{11}$, $R_{11'}$ | $R_{12}$, $R_{12'}$ | $R_{13}$, $R_{13'}$ | $R_{21}$, $R_{21'}$ | $R_{22}$, $R_{22'}$ | $R_{23}$, $R_{24}$ | $R_{23'}$, $R_{24'}$ | A |
|---|---|---|---|---|---|---|---|---|---|
| (Z-4) | 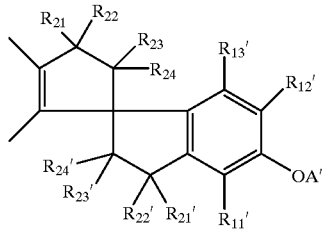 | | | | | | | | |

The reducing agent is preferably used in an amount of $1\times10^{-3}$ to 10 mol, more preferably $1\times10^{-2}$ to 1.5 mol per mol of silver.

Other Additives

Various chemical additives which can be used in the photographic photothermographic material of the invention are now described in sequence.

In the photothermographic material of the invention, a nucleation promoter may be contained. The nucleation promoter used herein includes amine derivatives, onium salts, disulfide derivatives, and hydroxymethyl derivatives. Examples of the nucleation promoter include the compounds described in JP-A 77783/1995, for example, compounds A-1 to A-73 described on pages 49 to 58 thereof; the compounds of chemical formulae [21], [22] and [23] described in JA-A 84331/1995, for example, the compounds described on pages 6 to 8 thereof; the compounds of general formulae [Na] and [Nb] described in JP-A 104426/1995, for example, compounds Na-1 to Na-22 and Nb-1 to Nb-12 described on pages 16 to 20 thereof; the compounds of general formulae (1), (2), (3), (4), (5), (6), and (7) described in Japanese Patent Application No. 37817/1995, for example, compounds 1-1 to 1-19, 2-1 to 2-22, 3-1 to 3-36, 4-1 to 4-5, 5-1 to 5-41, 6-1 to 6-58, and 7-1 to 7-38 described therein.

The nucleation promoter is used as a solution in a suitable organic solvent such as alcohols (e.g., methanol, ethanol, propanol, and fluorinated alcohols), ketones (e.g., acetone and methyl ethyl ketone), dimethylformamide, dimethylsulfoxide and methyl cellosolve.

A well-known emulsifying dispersion method is used for dissolving the nucleation promoter with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the nucleation promoter in powder form in water in a ball mill, colloidal mill or ultrasonic mixer.

The nucleation promoter may be added to a photosensitive layer or any non-photosensitive layer on the same side of the support as the photosensitive layer. Preferably the nucleation promoter is added to the photosensitive layer or a non-photosensitive layer disposed adjacent thereto.

Preferably the nucleation promoter is added in amounts of $1\times10^{-6}$ to $2\times10^{-2}$ mol, more preferably $1\times10^{-5}$ to $2\times10^{31\ 2}$ mol, most preferably $2\times10^{-5}$ to $1\times10^{-2}$ mol per mol of silver.

In the photothermographic material of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar—SM and Ar—S—S—Ar wherein M is a hydrogen atom or alkali metal atom, and Ar is an aromatic ring or fused aromatic ring group having at least one nitrogen, sulfur, oxygen, selenium or tellurium atom. Preferred hetero-aromatic rings in these groups are benzimidazole, naphthimidazole, benzothiazole, naphthothiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole.

These mercapto compounds are preferably added to the emulsion layer in amounts of 0.001 to 1.0 mol, more preferably 0.01 to 0.3 mol per mol of silver.

A sensitizing dye is also useful in the practice of the invention. There may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in Research Disclosure, Item 17643 IV-A (December 1978, page 23), ibid., Item 1831 X (August 1979, page 437) and the references cited therein.

It is advantageous to select a sensitizing dye having appropriate spectral sensitivity to the spectral properties of a particular light source of various scanners, image setters and printing plate-forming cameras. Exemplary sensitizing dyes include (A) compounds (I)-1 to (I)-8 described in JP-A 162247/1985, compounds I-1 to I-28 described in JP-A 48653/1990, compounds I-1 to I-13 described in JP-A 330434/1992, compounds of Examples 1 to 14 described in U.S. Pat. No. 2,161,331, and compounds 1 to 7 described in W. German Patent No. 936,071 for argon laser light sources; (B) compounds I-1 to I-38 described in JP-A 18726/1979, compounds I-1 to I-35 described in JP-A 75322/1994, and compounds I-i to I-34 described in JP-A 287338/1995 for He—Ne laser light sources; (C) dyes 1 to 20 described in JP-B 39818/1980, compounds I-i to I-37 described in JP-A 284343/1987, and compounds I-1 to I-34 described in JP-A 287338/1995 for LED light sources; (D) compounds I-1 to I-12 described in JP-A 191032/1984, compounds I-1 to I-22 described in JP-A 80841/1985, compounds I-1 to I-29 described in JP-A 335342/1992, and compounds I-1 to I-18 described in JP-A 192242/1984 for semiconductor laser light sources; (E) compounds (1) to (19) of general formula [1] described in JP-A 45015/1980, compounds I-1 to I-97 described in Japanese Patent Application No. 346193/1995, and compounds 4-A to 4-S, 5-A to 5-Q, and 6-A to 6-T described in JP-A 242547/1994 for tungsten and xenon light sources for printing plate-forming cameras.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization.

Useful sensitizing dyes, combinations of sensitizing dyes providing supersensitization, and compounds providing supersensitization are described in Research Disclosure, Vol. 176, 17643 (December 1978), item IV-J on page 23, JP-B 25500/1974 and 4933/1968, JP-A 19032/1984 and 192242/1984.

A mixture of two or more sensitizing dyes may be used in the practice of the invention. The sensitizing dye is added to a silver halide emulsion by dispersing the dye directly in the emulsion or by dissolving the dye in a suitable solvent or a mixture of solvents and adding the solution to the emulsion. The solvents used herein include water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to a solution.

The time when the sensitizing dye is added to the silver halide emulsion according to the invention is at any step of an emulsion preparing process which has been acknowledged effective. The sensitizing dye may be added to the emulsion at any stage or step before the emulsion is coated, for example, at a stage prior to the silver halide grain forming step and/or desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

It is sometimes advantageous to use an additive known as a "toner" for improving images in addition to the above-mentioned components. The toner is used in an amount of 0.1 to 10% by weight of the entire silver-carrying components. The toners are compounds well known in the photographic art as described in U.S. Pat. Nos. 3,080,254, 3,847,612 and 4,123,282.

Exemplary toners include imides such as phthalimide and N-hydroxyphthalimide; cyclic imides such as succinimide, pyrazolin-5-one, quinazolinone, 3-phenyl-2-pyrazoline-5-one, 1-phenylurazol, quinazoline and 2,4-thiazolizinedione; naphthalimides such as N-hydroxy-1,8-naphthalimide; cobalt complexes such as cobalt hexamine trifluoroacetate; mercaptans such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as N,N-(dimethylaminomethyl)phthalimide and N,N-(dimethylaminomethyl)naphthalene-2,3-dicarboxyimide; a blocked pyrazole, an isothiuronium derivative and a certain photo-bleaching agent such as N,N'-hexamethylenebis(1-carbamoyl-3,5-dimethylpyrazole), 1,8-(3,6-diazaoctane)bis(isothiuroniumtrifluoroacetate) and 2-tribromomethylsulfonyl-benzothiazole; 3-ethyl-5-[(3-ethyl-2-benzothiazolinylidene)-1-methylethylidene]-2-thio-2,4-oxazolidinedione; phthalazinone, phthalazinone derivatives or metal salts thereof such as 4-(1-naphthyl)phthalazinone, 6-chlorophthalazinone, 5,7-dimethoxyphthalazinone and 2,3-dihydro-1,4-phthalazinedione; combinations of phthalazinones with phthalic acid derivatives (e.g., phthalic acid, 4-methylphthalic acid, 4-nitrophthalic acid and tetrachlorophthalic anhydride); phthalazine, phthalazine derivatives or metal salts such as 4-(1-naphthyl)phthalazine, 6-chlorophthalazine, 5,7-dimethoxyphthalazine and 2,3-dihydrophthalazine; combinations of phthalazine with phthalic acid derivatives (e.g., phthalic acid, 4-methylphthalic acid, 4-nitrophthalic acid and tetrachlorophthalic anhydride); quinazolinedione, benzoxazine, and naphthoxazine derivatives; rhodium complexes which function not only as a toner, but also a halide ion source for forming silver halide in situ, for example, ammonium hexachlororhodate(III), rhodium bromide, rhodium nitrate and potassium hexachlororhodate(III); inorganic peroxides and persulfates such as ammonium peroxydisulfide and hydrogen peroxide; benzoxazine-2,4-diones such as 1,3-benzoxazine-2,4-dione, 8-methyl-1,3-benzoxazine-2,4-dione and 6-nitro-1,3-benzoxazine-2,4-dione; pyrimidine and asym-triazines such as 2,4-dihydroxypyrimidine and 2-hydroxy-4-aminopyrimidine; azauracil and tetraazapentalene derivatives such as 3,6-dimercapto-1,4-diphenyl-1H, 4H-2,3a,5,6a-tetraazapentalene and 1,4-di(o-chlorophenyl)-3,6-dimercapto-1H,4H-2,3a,5,6a-tetraazapentalene.

With antifoggants, stabilizers and stabilizer precursors, the silver halide emulsion and/or organic silver salt according to the invention can be further protected against formation of additional fog and stabilized against lowering of sensitivity during shelf storage. Suitable antifoggants, stabilizers and stabilizer precursors which can be used alone or in combination include thiazonium salts as described in U.S. Pat. Nos. 2,131,038 and 2,694,716, azaindenes as described in U.S. Pat. Nos. 2,886,437 and 2,444,605, mercury salts as described in U.S. Pat. No. 2,728,663, urazoles as described in U.S. Pat. No. 3,287,135, sulfocatechols as described in U.S. Pat. No. 3,235,652, oximes, nitrons and nitroindazoles as described in UKP 623,448, polyvalent metal salts as described in U.S. Pat. No. 2,839,405, thiuronium salts as described in U.S. Pat. No. 3,220,839, palladium, platinum and gold salts as described in U.S. Pat. Nos. 2,566,263 and 2,597,915, halogen-substituted organic compounds as described in U.S. Pat. Nos. 4,108,665 and 4,442,202, triazines as described in U.S. Pat. Nos. 4,128,557, 4,137,079, 4,138,365 and 4,459,350, and phosphorus compounds as described in U.S. Pat. No. 4,411,985.

Especially preferred antifoggants used herein are compounds as disclosed in U.S. Pat. Nos. 3,874,946 and 4,756,999 and heterocyclic compounds having at least one substituent represented by —C($X_1$) ($X_2$) ($X_3$) wherein $X_1$ and $X_2$ are halogen atoms such as F, Cl, Br, and I, and $X_3$ is hydrogen or halogen. Preferred examples of the heterocyclic compound are shown below.

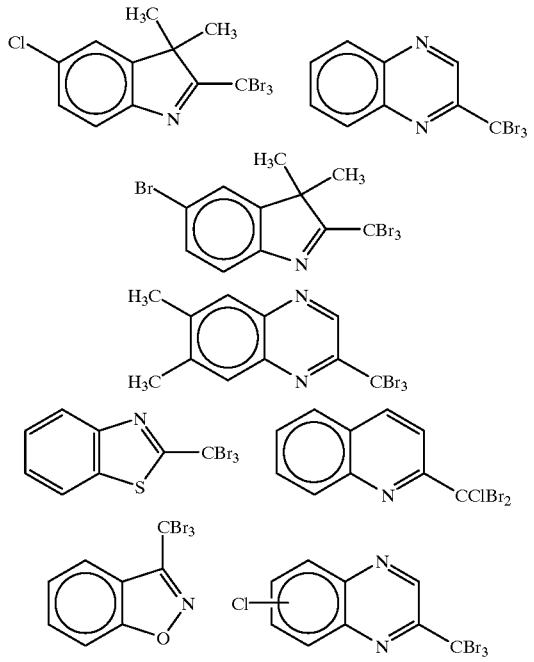

-continued

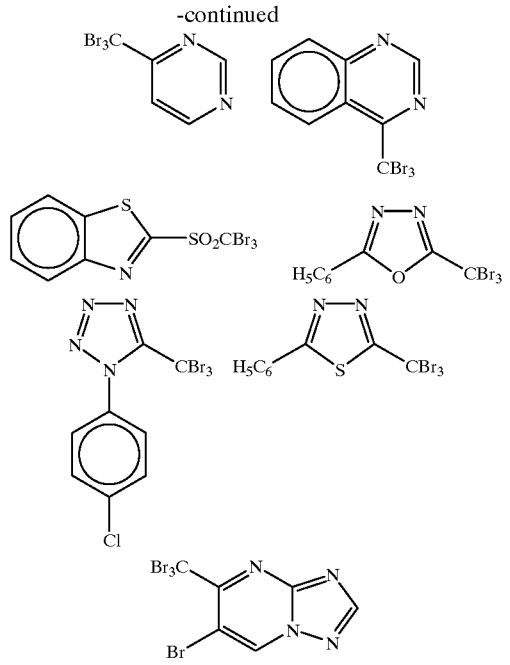

More preferred antifoggants are the heterocyclic compounds disclosed in U.S. Pat. No. 5,028,523, British Patent Application Nos. 92221383.4, 9300147.7 and 9311790.1.

In the photosensitive layer, polyhydric alcohols (e.g., glycerin and diols as described in U.S. Pat. No. 2,960,404), fatty acids and esters thereof as described in U.S. Pat. Nos. 2,588,765 and 3,121,060, and silicone resins as described in UKP 955,061 may be added as a plasticizer and lubricant.

According to the invention, a hardener may be used in various layers including a photosensitive layer, protective layer, and back layer. Examples of the hardener include polyisocyanates as described in U.S. Pat. No. 4,281,060 and JP-A 208193/1994, epoxy compounds as described in U.S. Pat. No. 4,791,042, and vinyl sulfones as described in JP-A 89048/1987.

In the practice of the invention, a surfactant may be used for the purposes of improving coating and electric charging properties. The surfactant used herein may be nonionic, anionic or cationic or a fluorinated one. Examples include fluorinated polymer surfactants as described in JP-A 170950/1987 and U.S. Pat. No. 5,382,504, fluorinated surfactants as described in JP-A 244945/1985 and 188135/1988, polysiloxane surfactants as described in U.S. Pat. No. 3,885,965, and polyalkylene oxide and anionic surfactants as described in JP-A 301140/1994.

A surface protective layer may be provided in the photosensitive material according to the present invention for the purpose of preventing adhesion of an image forming layer. The surface protective layer may be formed of any adhesion-preventing material. Examples of the adhesion-preventing material include wax, silica particles, styrene-containing elastomeric block copolymers (e.g., styrene-butadiene-styrene and styrene-isoprene-styrene), cellulose acetate, cellulose acetate butyrate, cellulose propionate and mixtures thereof.

In the emulsion layer or a protective layer therefor according to the invention, there may be used matte agents, for example, starch, titanium dioxide, zinc oxide, and silica as well as polymer beads including beads of the type described in U.S. Pat. Nos. 2,992,101 and 2,701,245. The emulsion surface may have any degree of matte insofar as no star dust failures occur although a Bekk smoothness of 1,000 to 10,000 seconds, especially 2,000 to 10,000 seconds is preferred.

The emulsion layer is based on a binder. Exemplary binders are naturally occurring polymers and synthetic resins, for example, gelatin, polyvinyl alcohol, polyvinyl acetal, polyvinyl chloride, polyvinyl acetate, cellulose acetate, polyolefins, polyesters, polystyrene, polyacrylonitrile, and polycarbonate. Of course, copolymers and terpolymers are included. Preferred polymers are polyvinyl butyral, butylethyl cellulose, methacrylate copolymers, maleic anhydride ester copolymers, polystyrene and butadiene-styrene copolymers. These polymers may be used alone or in admixture of two or more as desired. The polymer is used in such a range that it may effectively function as a binder to carry various components. The effective range may be properly determined by those skilled in the art without undue experimentation. Taken at least as a measure for carrying the organic silver salt in the film, the weight ratio of the binder to the organic silver salt is preferably in the range of from 15:1 to 1:2, more preferably from 8:1 to 1:1.

In addition to the squarylium dye according to the invention, any of well-known dyes may be used. Such additional dyes are compounds which have absorption in the desired wavelength range and sufficiently low absorption in the visible region and provide a desired absorbance spectral profile. Exemplary compounds are described in U.S. Pat. No. 5,380,635, JP-A 13295/1995, 68539/1990 (pages 13 to 14), and 24539/1991 (pages 14 to 16).

For the purposes of preventing halation and irradiation and correcting the tone of developed silver, the dye is preferably added to a photosensitive layer on a support, a non-photosensitive layer between the photosensitive layer and the support, or a non-photosensitive layer on the support remote from the photosensitive layer. For the purpose of preventing safe light fogging, the dye is preferably added to a protective layer or a non-photosensitive layer on the support remote from the photosensitive layer.

The photothermographic material of the present invention is preferably in the form of a one-side photosensitive material having at least one photosensitive layer containing a silver halide emulsion on one surface of a support and a back layer on the other surface thereof.

In the practice of the invention, a matte agent may be added to the one-side photosensitive material for improving feed efficiency. The matte agent used herein is generally a microparticulate water-insoluble organic or inorganic compound. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-α-methylstyrene copolymers, polystyrene, styrene-divinyl-benzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, urea-formaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. The size and shape of the matte agent are not critical. The matte agent of any particle size may be used although matte agents having a particle size of 0.1 μm to 30 μm are preferably used in the practice of the invention. The particle size distribution of the matte agent may be either narrow or wide. Nevertheless, since the haze and surface luster of photosensitive material are largely affected by the matte agent, it is preferred to adjust the particle size, shape and particle size distribution of a matte agent as desired during preparation of the matte agent or by mixing plural matte agents.

In the practice of the invention, the backing layer should preferably have a degree of matte as expressed by a Bekk smoothness of 10 to 250 seconds, more preferably 50 to 180 seconds.

In the photosensitive material of the invention, the matte agent is preferably contained in an outermost surface layer, a layer functioning as an outermost surface layer, a layer close to the outer surface or a layer functioning as a so-called protective layer.

In the practice of the invention, the binder used in the backing layer is preferably transparent or semi-transparent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly (vinyl pyrrolidone), casein, starch, poly(acrylic acid), poly (methyl methacrylate), polyvinyl chloride, poly(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

A backside resistive heating layer as described in U.S. Pat. Nos. 4,460,681 and 4,374,921 may be used in a photothermographic image system according to the present invention.

According to the invention, the photothermographic emulsion may be coated on various supports. Typical supports include polyester film, undercoated polyester film, poly(ethylene terephthalate) film, polyethylene naphthalate film, cellulose nitrate film, cellulose ester film, poly(vinyl acetal) film, polycarbonate film, polyimides, and associated or resinous materials, as well as glass, paper and metals. Also useful are metal laminated and metallized paper and plastic film. The support may be either transparent or opaque, preferably transparent.

When plastic film is passed through a photothermographic processor, the film experiences dimensional shrinkage or expansion. When the photosensitive material is intended for printing purposes, this dimensional shrinkage or expansion gives rise to a serious problem for precision multi-color printing. Therefore, the invention favors the use of a film experiencing a minimal dimensional change. Exemplary materials are styrene polymers having a syndiotactic structure and heat-treated polyethylene. Also useful are materials having a high glass transition temperature, for example, polyether ethyl ketone, polystyrene, polysulfone, polyether sulfone, and polyarylate.

The photosensitive material of the invention may have an antistatic or electroconductive layer, for example, a layer containing soluble salts (e.g., chlorides and nitrates), a metallized layer, or a layer containing ionic polymers as described in U.S. Pat. Nos. 2,861,056 and 3,206,312 or insoluble inorganic salts as described in U.S. Pat. No. 3,428,451.

A method for producing color images using the photothermographic material of the invention is as described in JP-A 13295/1995, page 10, left column, line 43 to page 11, left column, line 40. Stabilizers for color dye images are exemplified in UKP 1,326,889, U.S. Pat. Nos. 3,432,300, 3,698,909, 3,574,627, 3,573,050, 3,764,337, and 4,042,394.

In the practice of the invention, the photothermographic emulsion can be coated by various coating procedures including dip coating, air knife coating, flow coating, and extrusion coating using a hopper of the type described in U.S. Pat. No. 2,681,294. If desired, two or more layers may be concurrently coated by the methods described in U.S. Pat. No. 2,761,791 and UKP 837,095.

In the photothermographic material of the invention, there may be contained additional layers, for example, a dye accepting layer for accepting a mobile dye image, an opacifying layer when reflection printing is desired, a protective topcoat layer, and a primer layer well known in the photothermographic art. The photosensitive material of the invention is preferably such that only a single sheet of the photosensitive material can form an image. That is, it is preferred that a functional layer necessary to form an image such as an image receiving layer does not constitute a separate photosensitive material.

EXAMPLE

Examples of the invention are given below by way of illustration and not by way of limitation.

The trade names used in Examples have the following meaning.

Denka Butyral: polyvinyl butyral by Denki Kagaku Kogyo K.K. CAB 171-15S: cellulose acetate butyrate by Eastman Chemical Products, Inc.

Sildex: spherical silica by Dokai Chemical K.K.

Sumidur N3500: polyisocyanate by Sumitomo-Bayern Urethane K.K.

Megafax F-176P: fluorinated surfactant by Dai-Nihon Ink Chemical Industry K.K.

Example 1

Preparation of Organic Acid Silver Emulsion A

To 12 liters of water were added 840 grams of behenic acid and 95 grams of stearic acid. To the solution kept at 90° C., a solution of 48 grams of sodium hydroxide and 63 grams of sodium carbonate in 1.5 liters of water was added. The solution was stirred for 30 minutes and then cooled to 50° C. whereupon 1.1 liters of a 1% aqueous solution of N-bromosuccinimide was added. With stirring, 2.3 liters of a 17% aqueous solution of silver nitrate was slowly added. While the solution was kept at 35° C., with stirring, 1.5 liters of a 2% aqueous solution of potassium bromide was added over 2 minutes. The solution was stirred for 30 minutes whereupon 2.4 liters of a 1% aqueous solution of N-bromosuccinimide was added. With stirring, 3,300 grams of a solution containing 1.2% by weight of polyvinyl acetate in butyl acetate was added to the aqueous mixture. The mixture was allowed to stand for 10 minutes, separating into two layers. After the aqueous layer was removed, the remaining gel was washed twice with water. There was obtained a gel-like mixture of silver behenate, silver stearate, and silver bromide, which was dispersed in 1,800 grams of a 2.6% 2-butanone solution of polyvinyl butyral (Denka Butyral #3000-K). The dispersion was further dispersed in 600 grams of polyvinyl butyral (Denka Butyral #4000-2) and 300 grams of 2-butanone, obtaining an organic acid silver salt emulsion of needle grains having a mean minor diameter of 0.05 $\mu$m, a mean major diameter of 1.2 $\mu$m, and a coefficient of variation of 25%.

Preparation of Emulsion Layer Coating Solution A

With stirring at 25° C., the following chemicals were added to the above-prepared organic acid silver salt emulsion A in amounts per mol of silver.

| | |
|---|---|
| Sodium phenylthiosulfonate | 10 mg |
| Sensitizing dye-1 | 5.5 mg |
| 2-mercapto-5-methylbenzimidazole | 2 g |
| 2-mercapto-5-methylbenzothiazole | 1 g |
| 4-chlorobenzophenone-2-carboxylic acid | 21.5 g |
| 2-butanone | 580 g |
| Dimethyl formamide | 220 g |

The emulsion was allowed to stand for 3 hours. With stirring, the following chemicals were further added.

| | |
|---|---|
| 4,6-ditrichloromethyl-2-phenyltriazine | 4.5 g |
| Disulfide compound A | 2 g |
| 1,1-bis (2-hydroxy-3,5-dimethylphenyl)-3,5,5-trimethylhexane | 160 g |
| Phthalazine | 15 g |
| Tetrachlorophthalic acid | 5 g |
| Hydrazine derivative H-62u | 1.1 g |
| Megafax F-176P | 1.1 g |
| 2-butanone | 590 g |
| Methyl isobutyl ketone | 10 g |
| Dye (Table 26) | (Table 26) |

The dye was added as a 2% solution in acetone and optionally dimethylformamide.

Note that sensitizing dye-1, disulfide compound A, and hydrazine derivative H-62u are shown below.

Sensitizing dye-1

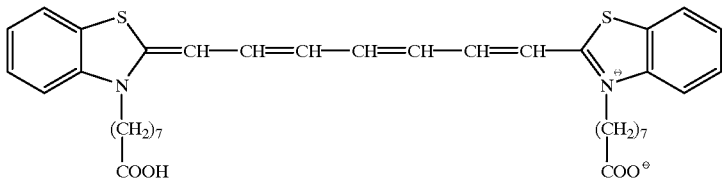

Disulfide compound A

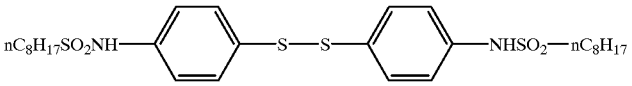

Hydrazine derivative H-62u

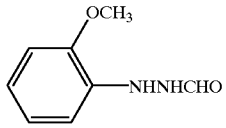

Preparation of Emulsion Layer Surface Protective Layer Coating Solution A

A coating solution A for an emulsion layer surface protective layer was prepared by mixing and dissolving the following chemicals at room temperature.

| | |
|---|---|
| CAB 171-15S | 75 g |
| 4-methylphthalic acid | 5.7 g |
| Tetrachlorophthalic anhydride | 1.5 g |
| 2-tribromomethylsulfonylbenzothiazole | 10 g |
| Phthalazone | 2 g |
| Megafax F-176P | 0.3 g |
| Sildex H31 (spherical silica, 3 $\mu$m) | 2 g |
| Sumidur N3500 | 5 g |
| 2-butanone | 3070 g |
| Ethyl acetate | 30 g |
| Preparation of back surface coating solution | |
| Back layer | |
| Denka Butyral #4000-2 | 7.5 g |
| CAB 171-15S | 7.5 g |
| Isopropyl alcohol | 150 ml |
| Dye (Table 26) | (Table 26) |

The dye was added as a 2% solution in acetone and optionally dimethylformamide.

A polyethylene terephthalate film having a moisture-proof undercoat of vinylidene chloride on either surface was coated on one surface with the back surface coating solution to a wet thickness of 80 $\mu$m.

TABLE 26

| Sample No. | Dye in emulsion layer | Dye in back layer | Remarks |
|---|---|---|---|
| 101 | none | none | comparison |
| 102 | none | Dye D-1 (80) | comparison |
| 103 | none | Dye D-2 (80) | comparison |
| 104 | none | Dye 2 (80) | invention |
| 105 | none | Dye 5 (80) | invention |
| 106 | Dye D-1 (30) | Dye D-1 (80) | comparison |
| 107 | Dye D-2 (30) | Dye D-2 (80) | comparison |
| 108 | Dye 7 (30) | Dye 7 (80) | invention |
| 109 | Dye 8 (30) | Dye 8 (80) | invention |
| 110 | Dye 2 (30) | Dye 2 (80) | invention |

TABLE 26-continued

| Sample No. | Dye in emulsion layer | Dye in back layer | Remarks |
|---|---|---|---|
| 111 | Dye 5 (30) | Dye 5 (80) | invention |
| 112 | Dye 2 (30) | Dye 5 (80) | invention |

Dye D-1 which is an indolenine dye described in Example 1 of JP-A 182640/1992 and Dye D-2 which is Dye-2 (AH-2) described in Example of U.S. Pat. No. 5,545,515 have the following structure.

Dye D-1

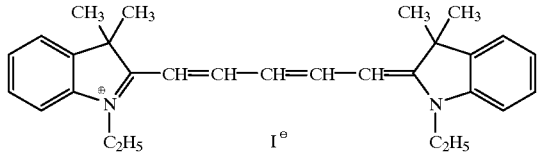

Dye D-2

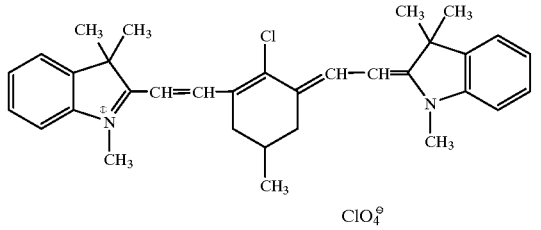

On the thus prepared support, the emulsion layer coating solution was coated so as to give a coverage of 2 g/m$^2$ of silver and the emulsion layer protective layer coating solution was then coated on the emulsion layer so as to give a dry thickness of 5 $\mu$m, obtaining sample Nos. 101 to 112.

Photographic Property Test

The photographic material samples prepared above were exposed to xenon flash light for an emission time of $_{10}^{-6}$ sec through an interference filter having a peak at 780 nm and a step wedge and heated for development at 115° C. for 25 seconds on a heat drum. The resulting images were determined for Dmax and gradation by a densitometer. The gradation γ is the gradient of a straight line connecting points of density 0.3 and 3.0 on a characteristic curve.

Dot Sharpness Test

Using laser light of 780 nm, a 50% screen tint of 100 lines was output to a coated sample, which was developed under the same conditions as above. Through a 100× magnifier, the image was visually observed for sharpness of dots. The results of evaluation were reported in Table 27 using a five-point scale between point 5 for good image quality and point 1 for poor image quality. Point 3 or higher is necessary for practical use.

Evaluation of Residual Color in Minimum Density Area

Three imaged samples were laid one on top of the other so that their minimum density areas overlapped. By a visual observation, the sample was rated "passed" when it was practically acceptable and otherwise rated "rejected."

The results are shown in Table 27.

TABLE 27

Test results of photsensitive material

| Sample No. | Gradation γ | Image quality | Residual color | Remarks |
|---|---|---|---|---|
| 101 | 12.2 | 1 | passed | comparison |
| 102 | 11.4 | 2 | rejected | comparison |
| 103 | 11.5 | 2 | rejected | comparison |
| 104 | 11.8 | 3 | passed | invention |
| 105 | 11.9 | 3 | passed | invention |
| 106 | 7.4 | 2 | rejected | comparison |
| 107 | 7.3 | 2 | rejected | comparison |
| 108 | 11.8 | 4 | passed | invention |
| 109 | 11.9 | 4 | passed | invention |
| 110 | 12.1 | 4 | passed | invention |
| 111 | 11.8 | 4 | passed | invention |
| 112 | 11.9 | 4 | passed | invention |

It is evident that samples containing a dye according to the invention in an emulsion layer are photothermographic materials featuring minimal residual color and high image quality. Comparative sample Nos. 106 and 107 containing an indolenine dye in an emulsion layer produce images of low contrast, poor image quality and unsatisfactory residual color. When a dye is added to only a back layer, comparative sample Nos. 102 and 103 containing an indolenine dye fail to produce images of practically acceptable quality.

Example 2

Preparation of Silver Halide Grains B

In 900 ml of water were dissolved 7.5 grams of inert gelatin and 10 mg of potassium bromide. The solution was adjusted to pH 3.0 at a temperature of 35° C. To the solution, 370 ml of an aqueous solution containing 74 grams of silver nitrate and an aqueous solution containing potassium bromide and potassium iodide in a molar ratio of 94:6 and $K_4[Fe(CN)_6]$ were added over 10 minutes by the controlled double jet method while maintaining the solution at pAg 7.7. Note that $[Fe(CN)_6]^{4-}$ was added in an amount of $3\times10^{-5}$ mol/mol of silver. Thereafter, 0.3 gram of 4-hydroxy-6-methyl-1,3,3a,7-tetraazaindene was added to the solution, which was adjusted to pH 5 with NaOH. There were obtained cubic silver iodobromide grains B having a mean grain size of 0.06 μm, a coefficient of variation of projected area diameter of 8%, and a {100} face ratio of 87%. The emulsion was desalted by adding a gelatin flocculant thereto to cause flocculation and sedimentation and then adjusted to pH 5.9 and pAg 7.5 by adding 0.1 gram of phenoxyethanol.

Preparation of Organic Acid Silver Emulsion B

A mixture of 10.6 grams of behenic acid and 300 ml of water was mixed for 15 minutes at 90° C. With vigorous stirring, 31.1 ml of 1N sodium hydroxide was added over 15 minutes to the solution, which was allowed to stand at the temperature for one hour. The solution was then cooled to 30° C., 7 ml of 1N phosphoric acid was added thereto, and with more vigorous stirring, 0.13 gram of N-bromosuccinimide was added. Thereafter, with stirring, the above-prepared silver halide grains B were added to the solution in such an amount as to give 2.5 mmol of silver halide. Further, 25 ml of 1N silver nitrate aqueous solution was continuously added over 2 minutes, with stirring continued for a further 90 minutes. With stirring, 37 grams of a 1.2 wt % n-butyl acetate solution of polyvinyl acetate was slowly added to the aqueous mixture to form flocs in the dispersion. Water was removed, and water washing and water removal were repeated twice. With stirring, 20 grams of a solution of 2.5% by weight polyvinyl butyral (Denka Butyral #3000-K) in a 1/2 solvent mixture of butyl acetate and 2-butanone was added. To the thus obtained gel-like mixture of organic acid silver and silver halide, 7.8 grams of polyvinyl butyral (Denka Butyral #4000-2) and 57 grams of 2-butanone were added. The mixture was dispersed by a homogenizer, obtaining a silver behenate emulsion of needle grains having a mean minor diameter of 0.04 μm, a mean major diameter of 1 μm and a coefficient of variation of 30%.

Preparation of Emulsion Layer Coating Solution B

With stirring at 25° C., the following chemicals were added to the above-prepared organic acid silver salt emulsion B in amounts per mol of silver.

| | |
|---|---|
| Sodium phenylthiosulfonate | 10 mg |
| Sensitizing dye-1 | 5.5 mg |
| 2-mercapto-5-methylbenzimidazole | 2 g |
| 2-mercapto-5-methylbenzothiazole | 1 g |
| 4-chlorobenzophenone-2-carboxylic acid | 21.5 g |
| 2-butanone | 580 g |
| Dimethyl formamide | 220 g |

The emulsion was allowed to stand for 3 hours. With stirring, the following chemicals were further added.

| | |
|---|---|
| 4,6-ditrichloromethyl-2-phenyltriazine | 4.5 g |
| Disulfide compound A | 2 g |
| 1,1-bis (2-hydroxy-3,5-dimethylphenyl)-3,5,5-trimethylhexane | 160 g |
| Phthalazine | 15 g |
| Tetrachlorophthalic acid | 5 g |
| Hydrazine derivative H-62u | 1.1 g |
| Megafax F-176P | 1.1 g |
| 2-butanone | 590 g |
| Methyl isobutyl ketone | 10 g |
| Dye (Table 28) | (Table 28) |

The dye was added as a 2% solution in acetone and optionally dimethylformamide.

Note that sensitizing dye-1, disulfide compound A, and hydrazine derivative H-62u are shown below.

Sensitizing dye-1

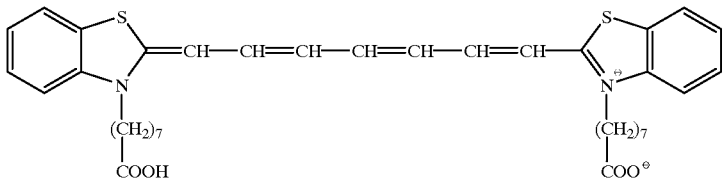

Disulfide compound A

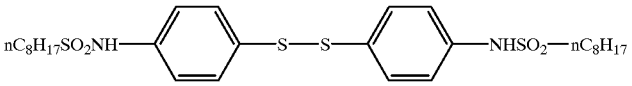

Hydrazine derivative H-62u

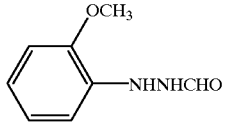

Coated samples were prepared as in Example 1 except that emulsion layer coating solution B was used instead of emulsion layer coating solution A and the dye in some back layers was replaced as shown in Table 28. There were obtained sample Nos. 201 to 212 in which the emulsion layer coating solution was coated on the support in a coverage of 2 g/m$^2$ of silver and the emulsion surface protective layer coating solution was coated to a dry thickness of 5 $\mu$m.

TABLE 28

| Sample No. | Dye in emulsion layer | Dye in back layer | Remarks |
|---|---|---|---|
| 201 | none | none | comparison |
| 202 | none | Dye D-1 (80) | comparison |
| 203 | none | Dye D-2 (80) | comparison |
| 204 | none | Dye 2 (80) | invention |
| 205 | none | Dye 5 (80) | invention |
| 206 | Dye D-1 (30) | Dye D-1 (80) | comparison |
| 207 | Dye D-2 (30) | Dye D-2 (80) | comparison |
| 208 | Dye 7 (30) | Dye 8 (80) | invention |
| 209 | Dye 8 (30) | Dye 8 (80) | invention |
| 210 | Dye 2 (30) | Dye 2 (80) | invention |
| 211 | Dye 5 (30) | Dye 5 (80) | invention |
| 212 | Dye 5 (30) | Dye 2 (80) | invention |

The additive amount is expressed in mg in parentheses.

Dye D-1 which is an indolenine dye described in Example 1 of JP-A 182640/1992 and Dye D-2 which is Dye-2 (AH-2) described in Example of U.S. Pat. No. 5,545,515 have the following structure.

Dye D-1

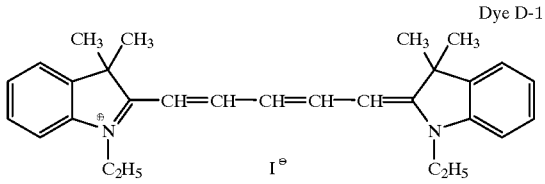

-continued

Dye D-2

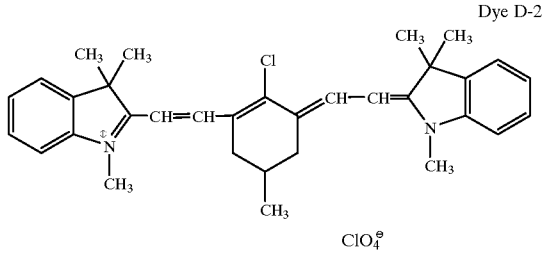

The samples were evaluated for photographic properties, dot sharpness, and residual color in minimum density area as in Example 1. The results are shown in Table 29.

TABLE 29

Test results of photosensitive material

| Sample No. | Gradation γ | Image quality | Residual color | Remarks |
|---|---|---|---|---|
| 201 | 12.5 | 1 | passed | comparison |
| 202 | 12.2 | 2 | rejected | comparison |
| 203 | 12.1 | 2 | rejected | comparison |
| 204 | 12.2 | 3 | passed | invention |
| 205 | 12.3 | 3 | passed | invention |
| 206 | 7.2 | 2 | rejected | comparison |
| 207 | 7.5 | 2 | rejected | comparison |
| 208 | 12.1 | 4 | passed | invention |
| 209 | 12.2 | 4 | passed | invention |
| 210 | 12.1 | 4 | passed | invention |
| 211 | 12.3 | 4 | passed | invention |
| 212 | 12.2 | 4 | passed | invention |

It is evident that samples containing a dye according to the invention in an emulsion layer are photothermographic materials featuring minimal residual color and high image quality. Comparative sample Nos. 206 and 207 containing an indolenine dye in an emulsion layer produce images of low contrast, poor image quality and unsatisfactory residual color. When a dye is added to only a back layer, comparative sample Nos. 202 and 203 containing an indolenine dye fail to produce images of practically acceptable quality.

Example 3

Samples were prepared as in Examples 1 and 2 except that the "polyethylene terephthalate film having a moisture-proof undercoat of vinylidene chloride on either surface" was replaced a polyethylene terephthalate film having a moisture-proof undercoat of vinylidene chloride on one surface and that the back surface coating solution, emulsion layer coating solution, and emulsion surface protective layer coating solution were coated in sequence on the undercoat surface.

The samples were evaluated for photographic properties, dot sharpness, and residual color in minimum density area as in Example 1. It was found that photosensitive material samples containing a dye according to the invention produced images of minimal residual color and high quality.

Example 4

Samples were prepared as sample No. 112 of Example 1 except that the hydrazine derivative H-62u used in sample No. 112 was replaced by hydrazine derivatives as shown in Table 30 and the additive amount was adjusted so as to provide a photographic sensitivity approximately equal to that of sample No. 112. The samples were evaluated as in Example 1. The results are shown in Table 30.

TABLE 30

Test results of photosensitive material

| Sample No. | Hydrazine derivative | Gradation γ | Image quality | Residual color | Remarks |
|---|---|---|---|---|---|
| 401 | H-62a | 14.5 | 5 | passed | invention |
| 402 | H-217 | 12.3 | 4 | passed | invention |
| 403 | H-226 | 11.2 | 4 | passed | invention |
| 404 | H-89ee | 15.2 | 5 | passed | invention |
| 405 | H-58s | 14.6 | 5 | passed | invention |
| 406 | H-89hh | 14.7 | 5 | passed | invention |
| 407 | H-100m | 14.1 | 5 | passed | invention |
| 408 | none | 6.5 | 1 | passed | comparison |

It is evident that sample Nos. 401 to 407 using a hydrazine derivative according to the invention produce high contrast images of quality. Inter alia, sample Nos. 401, 404 to 407 achieve excellent image quality. Comparative sample No. 408 containing no hydrazine derivative fail to produce an image of practically acceptable quality.

Example 5

Samples were prepared as sample No. 212 of Example 2 except that the hydrazine derivative H-62u used in sample No. 212 was replaced by hydrazine derivatives as shown in Table 31 and the additive amount was adjusted so as to provide a photographic sensitivity approximately equal to that of sample No. 112. The samples were evaluated as in Example 1. The results are shown in Table 31.

TABLE 31

Test results of photosensitive material

| Sample No. | Hydrazine derivative | Gradation γ | Image quality | Residual color | Remarks |
|---|---|---|---|---|---|
| 501 | H-62a | 14.3 | 5 | passed | invention |
| 502 | H-217 | 12.0 | 4 | passed | invention |
| 503 | H-226 | 12.1 | 4 | passed | invention |
| 504 | H-89ee | 15.0 | 5 | passed | invention |
| 505 | H-58s | 14.4 | 5 | passed | invention |
| 506 | H-89hh | 14.5 | 5 | passed | invention |
| 507 | H-100m | 14.3 | 5 | passed | invention |
| 508 | none | 6.7 | 1 | passed | comparison |

It is evident that sample Nos. 501 to 507 using a hydrazine derivative according to the invention produce high contrast images of quality. Inter alia, sample Nos. 501, 504 to 507 achieve excellent image quality. Comparative sample No. 508 containing no hydrazine derivative fail to produce an image of practically acceptable quality.

Example 6

Preparation of Organic Acid Silver Emulsion A

To 12 liters of water were added 840 grams of behenic acid and 95 grams of stearic acid. To the solution kept at 90° C., a solution of 48 grams of sodium hydroxide and 63 grams of sodium carbonate in 1.5 liters of water was added. The solution was stirred for 30 minutes and then cooled to 50° C. whereupon 1.1 liters of a 1% aqueous solution of N-bromosuccinimide was added. With stirring, 2.3 liters of a 17% aqueous solution of silver nitrate was slowly added. While the solution was kept at 35° C., with stirring, 1.5 liters of a 2% aqueous solution of potassium bromide was added over 2 minutes. The solution was stirred for 30 minutes whereupon 2.4 liters of a 1% aqueous solution of N-bromosuccinimide was added. With stirring, 3,300 grams of a solution containing 1.2% by weight of polyvinyl acetate in butyl acetate was added to the aqueous mixture. The mixture was allowed to stand for 10 minutes, separating into two layers. After the aqueous layer was removed, the remaining gel was washed twice with water. There was obtained a gel-like mixture of silver behenate, silver stearate, and silver bromide, which was dispersed in 1,800 grams of a 2.6% 2-butanone solution of polyvinyl butyral (Denka Butyral #3000-K). The dispersion was further dispersed in 600 grams of polyvinyl butyral (Denka Butyral #4000-2) and 300 grams of 2-butanone, obtaining an organic acid silver salt emulsion of needle grains having a mean minor diameter of 0.05 μm, a mean major diameter of 1.2 μm, and a coefficient of variation of 25%.

Preparation of Emulsion Layer Containing Solution A

With stirring at 25° C., the following chemicals were added to the above-prepared organic acid silver salt emulsion A in amounts per mol of silver.

| | |
|---|---|
| Sodium phenylthiosulfonate | 10 mg |
| Sensitizing dye-1 | 5.5 mg |
| 2-mercapto-5-methylbenzimidazole | 2 g |
| 2-mercapto-5-methylbenzothiazole | 1 g |
| 4-chlorobenzophenone-2-carboxylic acid | 21.5 g |
| 2-butanone | 580 g |
| Dimethylformamide | 220 g |

The emulsion was allowed to stand for 3 hours. With stirring, the following chemicals were further added.

| | |
|---|---|
| 4,6-ditrichloromethyl-2-phenyltriazine | 4.5 g |
| Disulfide compound A | 2 g |
| 1,1-bis(2-hydroxy-3,5-dimethylphenyl)-3,5,5-trimethylhexane | 160 g |
| Phthalazine | 15 g |
| Tetrachlorophthalic acid | 5 g |
| Hydrazine derivative H-62u | 1.1 g |
| Megafax F-176P | 1.1 g |
| 2-butanone | 590 g |
| Methyl isobutyl ketone | 10 g |
| Dye (Table 32) | (Table 32) |

The dye was added as a 2% solution in acetone and optionally dimethylformamide.

Note that sensitizing dye-l, disulfide compound A, and hydrazine derivative H-62u are shown below.

Sensitizing dye-1

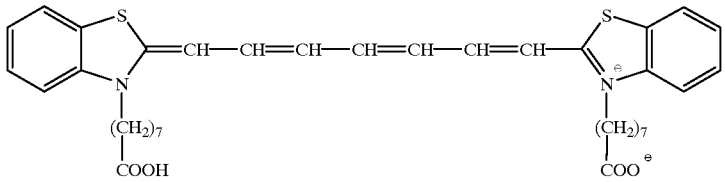

Disulfide compound A

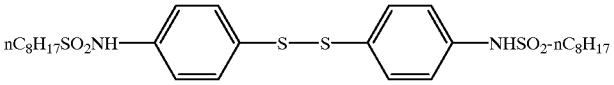

Hydrazine derivative H-62u

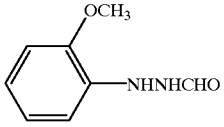

Preparation of Emulsion Layer Surface Protective Layer Coating Solution A

A coating solution A for an emulsion layer surface protective layer was prepared by mixing and dissolving the following chemicals at room temperature.

| | |
|---|---|
| CAB 171-15S | 75 g |
| 4-methylphthalic acid | 5.7 g |
| Tetrachlorophthalic anhydride | 1.5 g |
| 2-tribromomethylsulfonylbenzothiazole | 10 g |
| Phthalazone | 2 g |
| Megafax F-176P | 0.3 g |
| Sildex H31 (spherical silica, 3 μm) | 2 g |
| Sumidur N3500 | 5 g |
| 2-butanone | 3070 g |
| Ethyl acetate | 30 g |

Preparation of back surface coating solution

| Back layer | |
|---|---|
| Denka Butyral #4000-2 | 7.5 g |
| CAB 171-15S | 7.5 g |
| Isopropyl alcohol | 150 ml |
| Dye (Table 32) | (Table 32) |

The dye was added as a 2% solution in acetone and optionally dimethylformamide.

A polyethylene terephthalate film having a moisture-proof undercoat of vinylidene chloride on either surface was coated on one surface with the back surface coating solution to a wet thickness of 80 μm.

TABLE 32

| Sample No. | Dye in emulsion layer | Dye in back layer | Remarks |
|---|---|---|---|
| 601 | none | none | comparison |
| 602 | none | Dye D-1 (80) | comparison |
| 603 | none | Dye D-2 (80) | comparison |
| 604 | none | Dye 11 (80) | invention |
| 605 | none | Dye 18 (80) | invention |
| 606 | Dye D-1 (30) | Dye D-1 (80) | comparison |
| 607 | Dye D-2 (30) | Dye D-2 (80) | comparison |
| 608 | Dye 16 (30) | Dye 16 (80) | invention |
| 609 | Dye 15 (30) | Dye 15 (80) | invention |
| 610 | Dye 11 (30) | Dye 11 (80) | invention |
| 611 | Dye 16 (30) | Dye 25 (80) | invention |
| 612 | Dye 11 (30) | Dye 18 (80) | invention |

The additive amount is expressed in mg in parentheses.

Dye D-1 which is an indolenine dye described in Example 1 of JP-A 182640/1992 and Dye D-2 which is Dye-2 (AH-2) described in Example of U.S. Pat. No. 5,545,515 have the following structure.

Dye D-1

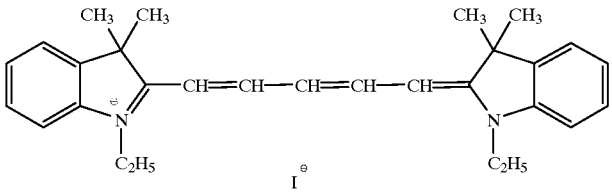

-continued

Dye D-2

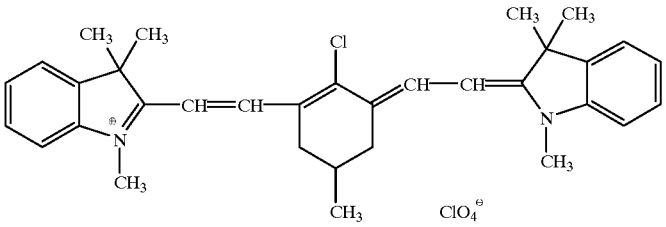

On the thus prepared support, the emulsion layer coating solution was coated so as to give a coverage of 2 g/m$^2$ of silver and the emulsion layer protective layer coating solution was then coated on the emulsion layer so as to give a dry thickness of 5 $\mu$m, obtaining sample Nos. 601 to 612.

Photographic Property Test

The photographic material samples prepared above were exposed to xenon flash light for an emission time of $10^{-6}$ sec through an interference filter having a peak at 780 nm and a step wedge and heated for development at 115° C. for 25 seconds on a heat drum. The resulting images were determined for a density relative to an exposure by a densitometer. Evaluated were Dmax and gradation $\gamma$ which is the gradient of a straight line connecting points of density 0.3 and 3.0 on a characteristic curve.

Dot Hardness Test

Using laser light of 780 nm, a 50% screen tint of 100 lines was output to a coated sample, which was developed under the same conditions as above. Through a 100× magnifier, the image was visually observed for sharpness of dots. The results of evaluation were reported in Table 33 using a five-point scale between point 5 for good image quality and point 1 for poor image quality. Point 3 or higher is necessary for practical use.

Evaluation of Residual Color in Minimum Density Area

Three imaged samples were laid one on top of the other so that their minimum density areas overlapped. By a visual observation, the sample was rated "passed" when it was practically acceptable and "rejected" otherwise, for example, when the minimum density area was blue tinted.

The results are shown in Table 33.

TABLE 33

Test results of photosensitive material

| Sample No. | Gradation $\gamma$ | Image quality | Residual color | Remarks |
|---|---|---|---|---|
| 601 | 12.5 | 1 | passed | comparison |
| 602 | 11.3 | 2 | rejected | comparison |
| 603 | 11.2 | 2 | rejected | comparison |
| 604 | 12.0 | 3 | passed | invention |
| 605 | 12.4 | 3 | passed | invention |
| 606 | 7.6 | 2 | rejected | comparison |
| 607 | 7.3 | 2 | rejected | comparison |
| 608 | 12.2 | 4 | passed | invention |
| 609 | 12.1 | 4 | passed | invention |
| 610 | 12.5 | 4 | passed | invention |
| 611 | 11.9 | 4 | passed | invention |
| 612 | 11.9 | 4 | passed | invention |

It is evident that samples containing a dye according to the invention in an emulsion layer are photothermographic materials featuring minimal residual color and high image quality. Comparative sample Nos. 606 and 607 containing an indolenine dye in an emulsion layer produce images of low contrast, poor image quality and unsatisfactory residual color. When a dye is added to only a back layer, comparative sample Nos. 602 and 603 containing an indolenine dye fail to produce images of practically acceptable quality.

Example 7

Preparation of Silver Halide Grains B

In 900 ml of water were dissolved 7.5 grams of inert gelatin and 10 mg of potassium bromide. The solution was adjusted to pH 3.0 at a temperature of 35° C. To the solution, 370 ml of an aqueous solution containing 74 grams of silver nitrate and an aqueous solution containing potassium bromide and potassium iodide in a molar ratio of 94:6 and $K_4[Fe(CN)_6]$ were added over 10 minutes by the controlled double jet method while maintaining the solution at pAg 7.7. Note that $[Fe(CN)_6]^{4-}$ was added in an amount of $3\times10^{-5}$ mol/mol of silver. Thereafter, 0.3 gram of 4-hydroxy-6-methyl-1,3,3a,7-tetraazaindene was added to the solution, which was adjusted to pH 5 with NaOH. There were obtained cubic silver iodobromide grains B having a mean grain size of 0.06 $\mu$m, a coefficient of variation of projected area diameter of 8%, and a {100} face ratio of 87%. The emulsion was desalted by adding a gelatin flocculant thereto to cause flocculation and sedimentation and then adjusted to pH 5.9 and pAg 7.5 by adding 0.1 gram of phenoxyethanol.

Preparation of Organic Acid Silver Emulsion B

A mixture of 10.6 grams of behenic acid and 300 ml of water was mixed for 15 minutes at 90° C. With vigorous stirring, 31.1 ml of 1N sodium hydroxide was added over 15 minutes to the solution, which was allowed to stand at the temperature for one hour. The solution was then cooled to 30° C., 7 ml of 1N phosphoric acid was added thereto, and with more vigorous stirring, 0.13 gram of N-bromosuccinimide was added. Thereafter, with stirring, the above-prepared silver halide grains B were added to the solution in such an amount as to give 2.5 mmol of silver halide. Further, 25 ml of 1N silver nitrate aqueous solution was continuously added over 2 minutes, with stirring continued for a further 90 minutes. With stirring, 37 grams of a 1.2 wt % n-butyl acetate solution of polyvinyl acetate was slowly added to the aqueous mixture to form flocs in the dispersion. Water was removed, and water washing and water removal were repeated twice. With stirring, 20 grams of a solution of 2.5% by weight polyvinyl butyral (Denka Butyral #3000-K) in a 1/2 solvent mixture of butyl acetate and 2-butanone was added. To the thus obtained gel-like mixture of organic acid silver and silver halide, 7.8 grams of polyvinyl butyral (Denka Butyral #4000-2) and 57 grams of 2-butanone were added. The mixture was dispersed by a homogenizer, obtaining a silver behenate emulsion of needle grains having a mean minor diameter of 0.04 μm, a mean major diameter of 1 μm and a coefficient of variation of 30%.

Preparation of Emulsion Layer Coating Solution B

With stirring at 25° C., the following chemicals were added to the above-prepared organic acid silver salt emulsion B in amounts per mol of silver.

| | |
|---|---|
| Sodium phenylthiosulfonate | 10 mg |
| Sensitizing dye-1 | 5.5 mg |
| 2-mercapto-5-methylbenzimidazole | 2 g |
| 2-mercapto-5-methylbenzothiazole | 1 g |
| 4-chlorobenzophenone-2-carboxylic acid | 21.5 g |
| 2-butanone | 580 g |
| Dimethylformamide | 220 g |

The emulsion was allowed to stand for 3 hours. With stirring, the following chemicals were further added.

| | |
|---|---|
| 4,6-ditrichloromethyl-2-phenyltriazine | 4.5 g |
| Disulfide compound A | 2 g |
| 1,1-bis(2-hydroxy-3,5-dimethylphenyl)-3,5,5-trimethylhexane | 160 g |
| Phthalazine | 15 g |
| Tetrachlorophthalic acid | 5 g |
| Hydrazine derivative H-62u | 1.1 g |
| Megafax F-176P | 1.1 g |
| 2-butanone | 590 g |
| Methyl isobutyl ketone | 10 g |
| Dye (Table 34) | (Table 34) |

The dye was added as a 2% solution in acetone and optionally dimethylformamide.

Note that sensitizing dye-1, disulfide compound A, and hydrazine derivative H-62u are shown below.

Coated samples were prepared as in Example 6 except that emulsion layer coating solution B was used instead of emulsion layer coating solution A and the dye in some back layers was replaced as shown in Table 34. There were obtained sample Nos. 701 to 712 in which the emulsion layer coating solution was coated on the support in a coverage of 2 g/m$^2$ of silver and the emulsion surface protective layer coating solution was coated to a dry thickness of 5 μm.

TABLE 34

| Sample No. | Dye in emulsion layer | Dye in back layer | Remarks |
|---|---|---|---|
| 701 | none | none | comparison |
| 702 | none | Dye D-1 (80) | comparison |
| 703 | none | Dye D-2 (80) | comparison |
| 704 | none | Dye 11 (80) | invention |
| 705 | none | Dye 25 (80) | invention |
| 706 | Dye D-1 (30) | Dye D-1 (80) | comparison |
| 707 | Dye D-2 (30) | Dye D-2 (80) | comparison |
| 708 | Dye 16 (30) | Dye 16 (80) | invention |
| 709 | Dye 15 (30) | Dye 15 (80) | invention |
| 710 | Dye 11 (30) | Dye 11 (80) | invention |
| 711 | Dye 18 (30) | Dye 25 (80) | invention |
| 712 | Dye 11 (30) | Dye 18 (80) | invention |

The additive amount is expressed in mg in parentheses.

Dye D-1 which is an indolenine dye described in Example 1 of JP-A 182640/1992 and Dye D-2 which is Dye-2 (AH-2) described in Example of U.S. Pat. No. 5,545,515 have the following structure.

Sensitizing dye-1

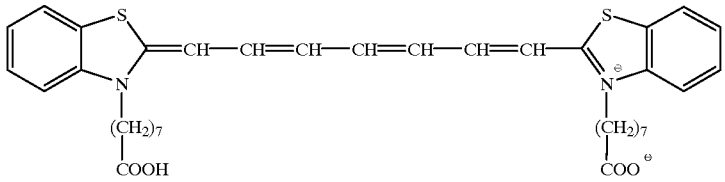

Disulfide compound A

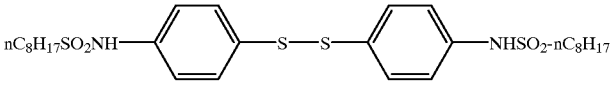

Hydrazine derivative H-62u

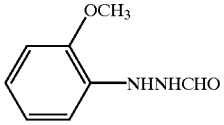

Dye D-1

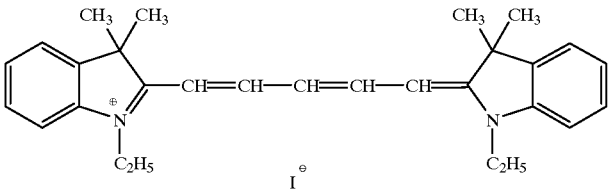

Dye D-2

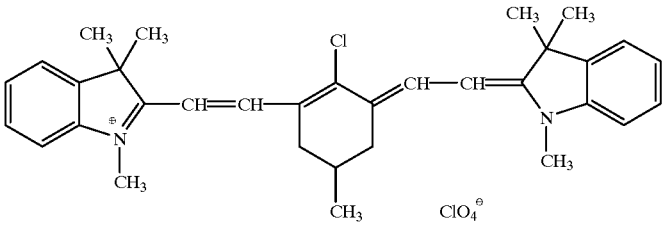

The samples were evaluated for photographic properties, dot sharpness, and residual color in minimum density area as in Example 6. The results are shown in Table 35.

TABLE 35

Test results of photosensitive material

| Sample No. | Gradation γ | Image quality | Residual color | Remarks |
|---|---|---|---|---|
| 701 | 12.5 | 1 | passed | comparison |
| 702 | 11.0 | 2 | rejected | comparison |
| 703 | 11.1 | 2 | rejected | comparison |
| 704 | 12.2 | 3 | passed | invention |
| 705 | 12.3 | 3 | passed | invention |
| 706 | 7.6 | 2 | rejected | comparison |
| 707 | 7.4 | 2 | rejected | comparison |
| 708 | 12.2 | 4 | passed | invention |
| 709 | 12.1 | 4 | passed | invention |
| 710 | 12.4 | 4 | passed | invention |
| 711 | 12.0 | 4 | passed | invention |
| 712 | 12.4 | 4 | passed | invention |

It is evident that samples containing a dye according to the invention in an emulsion layer are photothermographic materials featuring minimal residual color and high image quality. Comparative sample Nos. 706 and 707 containing an indolenine dye in an emulsion layer produce images of low contrast, poor image quality and unsatisfactory residual color. When a dye is added to only a back layer, comparative sample Nos. 702 and 703 containing an indolenine dye fail to produce images of practically acceptable quality.

Example 8

Samples were prepared as in Examples 6 and 7 except that the "polyethylene terephthalate film having a moisture-proof undercoat of vinylidene chloride on either surface" was replaced a polyethylene terephthalate film having a moisture-proof undercoat of vinylidene chloride on one surface and that the back surface coating solution, emulsion layer coating solution, and emulsion surface protective layer coating solution were coated in sequence on the undercoat surface.

The samples were evaluated for photographic properties, dot sharpness, and residual color in minimum density area as in Example 6. It was found that photosensitive material samples containing a dye according to the invention produced images of minimal residual color and high quality.

Example 9

Samples were prepared as sample No. 612 of Example 6 except that the hydrazine derivative H-62u used in sample No. 612 was replaced by hydrazine derivatives as shown in Table 36 and the additive amount was adjusted so as to provide a photographic sensitivity approximately equal to that of sample No. 612. The samples were evaluated as in Example 6. The results are shown in Table 36.

TABLE 36

Test results of photosensitive material

| Sample No. | Hydrazine derivative | Gradation γ | Image quality | Residual color | Remarks |
|---|---|---|---|---|---|
| 901 | H-208a | 14.2 | 4 | passed | invention |
| 902 | H-217 | 12.3 | 4 | passed | invention |
| 903 | H-226a | 11.2 | 4 | passed | invention |
| 904 | H-89ee | 14.2 | 5 | passed | invention |
| 905 | H-58s | 13.6 | 5 | passed | invention |
| 906 | H-89hh | 14.4 | 5 | passed | invention |
| 907 | H-100m | 14.1 | 5 | passed | invention |
| 908 | none | 5.4 | 1 | passed | comparison |

It is evident that sample Nos. 901 to 907 using a hydrazine derivative according to the invention produce high contrast images of quality. Inter alia, sample Nos. 901, 904 to 907 achieve excellent image quality. Comparative sample No. 908 containing no hydrazine derivative fail to produce an image of practically acceptable quality.

Example 10

Samples were prepared as sample No. 712 of Example 7 except that the hydrazine derivative H-62u used in sample No. 712 was replaced by hydrazine derivatives as shown in Table 37 and the additive amount was adjusted so as to provide a photographic sensitivity approximately equal to that of sample No. 712. The samples were evaluated as in Example 6. The results are shown in Table 37.

TABLE 37

Test results of photosensitive material

| Sample No. | Hydrazine derivative | Gradation γ | Image quality | Residual color | Remarks |
|---|---|---|---|---|---|
| 1001 | H-208a | 13.5 | 4 | passed | invention |
| 1002 | H-217 | 12.0 | 4 | passed | invention |
| 1003 | H-226a | 12.1 | 4 | passed | invention |
| 1004 | H-89ee | 14.5 | 5 | passed | invention |
| 1005 | H-58s | 14.2 | 5 | passed | invention |
| 1006 | H-89hh | 14.1 | 5 | passed | invention |
| 1007 | H-100m | 14.0 | 5 | passed | invention |
| 1008 | none | 5.7 | 1 | passed | comparison |

It is evident that sample Nos. 1001 to 1007 using a hydrazine derivative according to the invention produce high contrast images of quality. Inter alia, sample Nos. 1001, 1004 to 1007 achieve excellent image quality. Comparative sample No. 1008 containing no hydrazine derivative fail to produce an image of practically acceptable quality.

There has been described a photographic photothermographic material capable of forming images of high Dmax, ultrahigh contrast, satisfactory resolution, and minimal residual color after processing owing to the containment of a specific hydrazine derivative and a specific squarylium dye.

Reasonable modifications and variations are possible from the foregoing disclosure without departing from either the spirit or scope of the present invention as defined by the claims.

We claim:

1. A photographic photothermographic material comprising a silver organic acid, a silver halide, and a reducing agent on a transparent support, wherein said photothermographic material further comprises a hydrazine derivative of formula (H) and at least one squarylium dye of formulae (I), II, IV and (V) is contained in at least one of the following layers: (1) a photosensitive layer on one surface of the support, (2) a layer disposed between the support and the photosensitive layer, (3) a layer coated on the opposite surface of the support of the photosensitive layer, and (4) a layer disposed on the same surface of the support as the photosensitive layer and more remote from the support than the photosensitive layer;

formula (H):

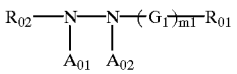

wherein $R_{02}$ aliphatic, aromatic or heterocyclic group, $R_{01}$ is hydrogen or a block group selected from the group consisting of aliphatic, aromatic, heterocyclic, alkoxy, aryloxy, amino and hydrazino groups, and $R_{03}$ is hydrogen or a block group selected from the group consisting of aliphatic, aromatic, heterocyclic, alkoxy, aryloxy, amino and hydrazino groups, $G_1$ is a group represented by —CO—, —COCO—, —C(=S)—, —$SO_2$—, —SO— or —PO($R_{03}$)— or iminomethylene group, $A_{01}$ and $A_{02}$ are both hydrogen atoms, or one of $A_{01}$ and $A_{02}$ is a hydrogen atom and the other is a substituted or unsubstituted alkylsulfonyl group, substituted and unsubstituted arylsulfonyl group or substituted or unsubstituted acyl group, and letter ml is equal to 0 or 1, with the proviso that $R_{01}$ is an aliphatic, aromatic or heterocyclic group when m1 is 0;

formula (I):

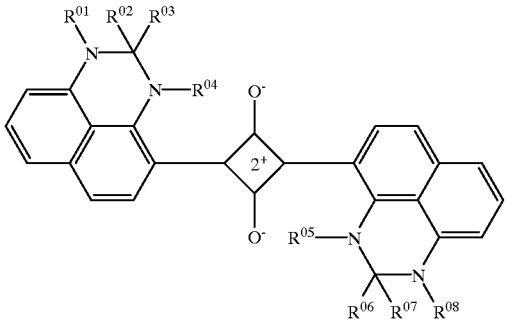

wherein $R^{01}$, $R^{02}$, $R^{03}$, $R^{04}$, $R^{05}$, $R^{06}$, $R^{07}$, and $R^{08}$ are independently selected from the group consisting of hydrogen, alkyl, cycloalkyl and aryl groups, or at least one pair of ($R^{01}$ and $R^{02}$), ($R^{03}$ and $R^{04}$), ($R^{05}$ and $R^{06}$), ($R^{07}$ and $R^{08}$), ($R^{02}$ and $R^{03}$), or ($R^{06}$ and $R^{07}$), taken together, may form a 5- or 6-membered ring;

formula (II):

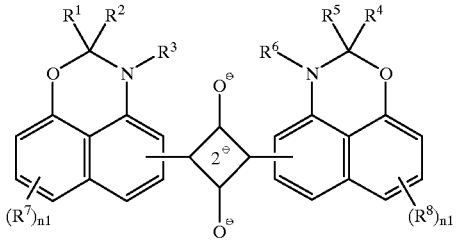

wherein $R^1$, $R^2$, $R^3$, $R^4$, $R^5$, and $R^6$ are independently selected from the group consisting of hydrogen, alkyl, cycloalkyl, aryl, heterocyclic and aralkyl groups, or ($R^1$ and $R^2$), ($R^4$ and $R^5$), or both ($R^1$ and $R^2$) and ($R^4$ and $R^5$), taken together, may form a 5- or 6-member ring, $R^7$ and $R^8$ each are hydrogen or a monovalent group, and letter n1 is an integer of 1 to 3;

formula (IV):

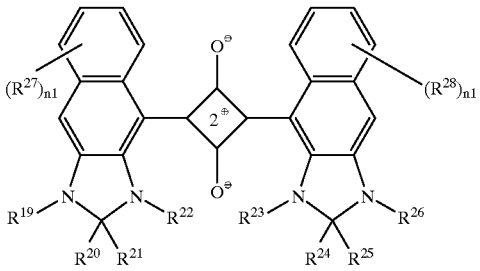

wherein $R^{19}$, $R^{20}$, $R^{21}$, $R^{22}$, $R^{23}$, $R^{24}$, $R^{25}$, and $R^{26}$ are independently selected from the group consisting of hydrogen, alkyl, cycloalkyl, aryl, aralkyl, and heterocyclic groups, or at least one pair of ($R^{19}$ and $R^{20}$) ($R^{21}$ and $R^{22}$), ($R^{23}$ and $R^{24}$), ($R^{25}$ and $R^{26}$) ($R^{20}$ and $R^{21}$) or ($R^{24}$ and $R^{25}$) taken together, may form a 5- or 6-membered ring, each of $R^{27}$ and $R^{28}$ is hydrogen or a monovalent substituent group, and letter n1 is an integer of 1 to 3;

formula (V):

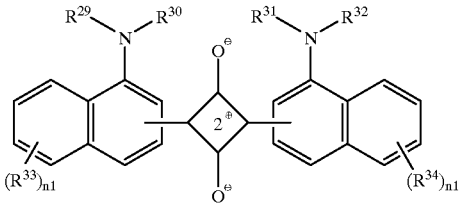

wherein $R^{29}$, $R^{30}$, $R^{31}$, and $R^{32}$ are independently selected from the group consisting of hydrogen, alkyl, cycloalkyl, aryl, aralkyl, and heterocyclic groups, each of $R^{33}$ and $R^{34}$ is hydrogen or a monovalent substituent group, and letter n1 is an integer of 1 to 3.

2. The photothermographic material of claim 1 wherein said squarylium dye is contained in the photosensitive layer containing the photosensitive silver halide.

3. The photothermographic material of claim 1, wherein said hydrazine derivative is at least one member selected from hydrazine derivatives of formulae (H-I) to (H-VIII):

formula (H-I)

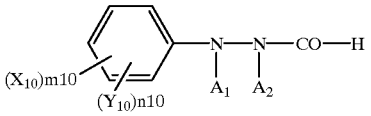

formula (H-II)

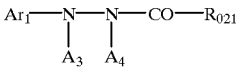

formula (H-III)

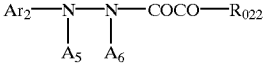

formula (H-IV)

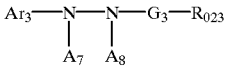

formula (H-V)

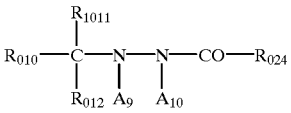

formula (H-VI)

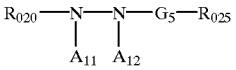

formula (H-VII)

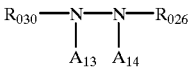

formula (H-VIII)

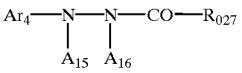

in formula (H-I), $Y_{10}$ is a nitro, methoxy, alkyl or acetamide group, $X_{10}$ is any substituent group except a nitro, methoxy, alkyl or acetamide group, letter m10 is an integer of 0 to 5, n10 is an integer of 0 to 4, the sum of m10 and n10 is not more than 5, $A_1$ and $A_2$ are both hydrogen atoms or one of $A_1$ and $A_2$ is a hydrogen atom and the other is a substituted or unsubstituted alkylsulfonyl group, substituted or unsubstituted arylsulfonyl group or substituted or unsubstituted acyl group, with the proviso that either the $A_1$ and $A_2$ is not hydrogen when m10 is 0;

in formula (H-II), $Ar_1$ is an aromatic or heterocyclic group, $A_3$ and $A_4$ are as defined for $A_1$ and $A_2$ in formula (H-I), and $R_{021}$ is selected from the group consisting of an alkyl group having at least one electron attractive group substituted thereon, aryl group having at least one electron attractive group substituted thereon, alkenyl group, alkynyl group, heterocyclic group, amino group, hydrazino group, alkoxy group, and aryloxy group;

in formula (H-III), $Ar_2$ is an aromatic or heterocyclic group, $A_5$ and $A_6$ are as defined for $A_1$ and $A_2$ in formula (H-I), and $R_{022}$ is hydrogen or a block group;

in formula (H-IV), $Ar_3$ is an aromatic or heterocyclic group, $A_7$ and $A_8$ are as defined for $A_1$ and $A_2$ in formula (H-I), and $R_{023}$ is hydrogen or a block group selected from the group consisting of aliphatic, aromatic, heterocyclic, alkoxy, aryloxy, amino and hydrazino groups, and $G_3$ is a group represented by —C(=S)—, —$SO_2$—, —SO— or —PO($R_{033}$)— or iminomethylene group wherein $R_{033}$ is as defined for $R_{23}$ and may be identical with or different from $R_{023}$;

in formula (H-V), each of $R_{010}$, $R_{011}$, and $R_{012}$ is hydrogen or a monovalent substituent group, with the proviso that all $R_{010}$, $R_{011}$, and $R_{012}$ are not aromatic groups at the same time, $A_9$ and $A_{10}$ are as defined for $A_1$ and $A_2$ in formula (H-I), and $R_{024}$ is hydrogen or a block group selected from the group consisting of aliphatic, aromatic, heterocyclic, alkoxy, aryloxy, amino and hydrazino groups;

in formula (H-VI), $R_{020}$ is an aliphatic group, $R_{025}$ is hydrogen or a block group selected from the group consisting of aliphatic, aromatic, heterocyclic, alkoxy, aryloxy, amino and hydrazino groups, $G_5$ is a group —COCO— or a group as defined for $G_3$ in formula (H-IV), and $A_{11}$ and $A_{12}$ are as defined for $A_1$ and $A_2$ in formula (H-I), with the proviso that $R_{025}$ is not an unsubstituted anilino group when G5 is a group —C(=S)—;

in formula (H-VII), $R_{030}$ is an aliphatic group, $R_{26}$ is an aliphatic, aromatic or heterocyclic group, and $A_{13}$ and $A_{14}$ are as defined for $A_1$ and $A_2$ in formula (H-I), with the proviso that $R_{026}$ is not an unsubstituted phenyl group when $R_{030}$ is a trityl group;

in formula (H-VIII), $Ar_4$ is an aromatic or heterocyclic group, $R_{027}$ is an unsubstituted amino, alkylamino, heterocyclic amino or alkynyl group, and $A_{15}$ and $A_{16}$ are as defined for $A_1$ and $A_2$ in formula (H-I).

4. The photothermographic material of claim 3 wherein the amino group is unsubstituted amino, alkylamino, arylamino, or heterocylic amino.

5. The photothermographic material of claim 3, wherein $X_{10}$ is selected from the group consisting of a sulfonamide, ureido, thioureido, alkoxy having at least 2 carbon atoms in total, acylamino having at least 3 carbon atoms in total, carbamoyl, sulfamoyl and carboxy group.

6. The photothermographic material of claim 3, wherein $R_{026}$ is an aromatic or aliphatic group.

7. The photothermographic material of claim 6, wherein $R_{026}$ is a substituted phenyl group or substituted methyl group.

8. The photothermographic material of claim 6, wherein $R_{026}$ is a substituted phenyl group and the substituent is selected from the group consisting of sulfonamide, ureido, thioureido, alkoxy, acylamino, carbamoyl, sulfamoyl, nitro, chloro, cyano, and carboxy groups.

9. The photothermographic material of claim 6, wherein $R_{026}$ is a substituted methyl group.

10. The photothermographic material of claim 3, wherein $R_{026}$ or $R_{030}$ is a di- or tri-substituted methyl group having at least two aryl groups substituted thereon, or $R_{030}$ is a di- or tri-substituted methyl group having at least two aryl groups substituted thereon, and $R_{026}$ is a substituted phenyl group having a sulfonamide, ureido, thioureido, alkoxy, acylamino, carbamoyl, sulfamoyl, nitro, chloro, cyano or carboxy group substituted thereon, and $A_{13}$ and $A_{14}$ are hydrogen.

11. The photothermographic material of claim 1, wherein $R_{01}$ and $R_{02}$ are each independently a substituted or unsubstituted alkyl group, a substituted or unsubstituted alkenyl group having one to ten carbon atoms, a monocyclic or fused ring aryl group, a five or six membered, saturated or unsaturated, monocylic or fused ring, heterocyclic group containing at least one of nitrogen, oxygen or sulfur atoms, a substituted or unsubstituted alkoxy group having one to eight carbon atoms, a substituted or unsubstituted phenoxy group, an unsubstituted amino, an alkylamino having one to ten carbon atoms, arylamino, a saturated or unsaturated heterocyclic amino group, substituted or unsubstituted hydrazino group, or substituted or unsubstituted phenylhydrazino group.

* * * * *

UNITED STATES PATENT AND TRADEMARK OFFICE

CERTIFICATE OF CORRECTION

PATENT NO. : 6,063,560
DATED : May 16, 2000
INVENTOR(S) : Suzuki et al.

It is certified that error appears in the above-identified patent and that said Letters Patent is hereby corrected as shown below:

In column 135 (claim 1) line 53, after the phrase "wherein $R_{02}$"

please add -- is an --.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*